US011623445B2

(12) United States Patent
Arnold et al.

(10) Patent No.: US 11,623,445 B2
(45) Date of Patent: Apr. 11, 2023

(54) PRINTING PRESS AND METHOD FOR CLEANING AT LEAST ONE NOZZLE BAR OF AT LEAST ONE PRINTING UNIT

(71) Applicant: KOENIG & BAUER AG, Würzburg (DE)

(72) Inventors: Christian Arnold, Rimpar (DE); Joachim Keupp, Rimpar (DE); Wolfgang Reder, Veitshöchheim (DE); Karl Schäfer, Kürnach (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/795,046

(22) PCT Filed: Dec. 7, 2020

(86) PCT No.: PCT/EP2020/084871
§ 371 (c)(1),
(2) Date: Jul. 25, 2022

(87) PCT Pub. No.: WO2021/175469
PCT Pub. Date: Sep. 10, 2021

(65) Prior Publication Data

US 2023/0077916 A1 Mar. 16, 2023

(30) Foreign Application Priority Data

Mar. 5, 2020 (DE) ..... 10 2020 105 962.0

(51) Int. Cl.
*B41J 2/165* (2006.01)
*B41J 25/34* (2006.01)
*B41J 25/304* (2006.01)

(52) U.S. Cl.
CPC ..... *B41J 2/16552* (2013.01); *B41J 2/16505* (2013.01); *B41J 2/16585* (2013.01);
(Continued)

(58) Field of Classification Search
CPC ..... B41J 2/16552; B41J 2/16505; B41J 2/16585; B41J 2002/1655; B41J 2002/16558
See application file for complete search history.

(56) References Cited

U.S. PATENT DOCUMENTS 5,984,450 A 11/1999 Becker et al.
2010/0091066 A1 4/2010 Lee et al.
(Continued)

FOREIGN PATENT DOCUMENTS

CN 102555489 A 7/2012
CN 102886986 A 1/2013
(Continued)

OTHER PUBLICATIONS

International Search Report of PCT/EP2020/084871 dated Mar. 15, 2021.
(Continued)

*Primary Examiner* — Sharon Polk
(74) *Attorney, Agent, or Firm* — Mattingly & Malur, PC

(57) ABSTRACT

In some examples, a printing press includes a printing unit with at least four nozzle bars, each including a print head. At least one nozzle bar has a printing position and at least one service position. For instance, in a first service position, the at least one nozzle bar has a first distance to the transport path of a printing substrate, and in a second service position the at least one nozzle bar has a second distance to the transport path. The printing unit includes at least one cleaning device and/or cleaning system that is selectively arranged in an area between the at least one nozzle bar and the transport path. The at least one service position may be arranged in vertical direction above the printing position, and the second distance of the second service position of the nozzle bar may be less than in the first service position.

15 Claims, 36 Drawing Sheets

(52) U.S. Cl.
CPC ..... *B41J 25/304* (2013.01); *B41J 25/34* (2013.01); *B41J 2002/1655* (2013.01); *B41J 2002/16558* (2013.01)

(56) References Cited

U.S. PATENT DOCUMENTS

| | | | | |
|---|---|---|---|---|
| 2010/0214355 | A1 | 8/2010 | Inoue | |
| 2012/0038707 | A1 | 2/2012 | Maida et al. | |
| 2012/0186606 | A1 | 7/2012 | Barss et al. | |
| 2013/0106940 | A1 | 5/2013 | Kyotani et al. | |
| 2014/0292911 | A1 | 10/2014 | Kajimoto et al. | |
| 2015/0158304 | A1 | 6/2015 | Kida et al. | |
| 2017/0313108 | A1 | 11/2017 | Profaca et al. | |
| 2018/0229505 | A1* | 8/2018 | Eck | B41J 2/16588 |
| 2019/0283431 | A1 | 9/2019 | Kyotani et al. | |
| 2020/0215822 | A1 | 7/2020 | Ozaki et al. | |

FOREIGN PATENT DOCUMENTS

| | | | | |
|---|---|---|---|---|
| CN | 107921779 | A | 4/2018 | |
| CN | 109070610 | A | 12/2018 | |
| CN | 109070611 | A | 12/2018 | |
| DE | 69602301 | T2 | 9/1999 | |
| DE | 112014003630 | T5 | 4/2016 | |
| DE | 102016214356 | A1 | 2/2018 | |
| DE | 102016125321 | A1 | 6/2018 | |
| EP | 1218193 | A1 | 7/2002 | |
| WO | 2019059099 | A1 | 3/2019 | |
| WO | WO-2020169321 | A1 * | 8/2020 | B41J 2/16508 |

OTHER PUBLICATIONS

Chinese Office Action received in corresponding Chinese Application No. 202080094352.1 dated Nov. 9, 2022.

* cited by examiner

PRINTING PRESS AND METHOD FOR CLEANING AT LEAST ONE NOZZLE BAR OF AT LEAST ONE PRINTING UNIT

CROSS-REFERENCES TO RELATED APPLICATIONS

This application is the US national phase, under 35 USC § 371, of PCT/EP2020/084871, filed on Dec. 7, 2020, published as WO 2021/175469 A1 on Sep. 10, 2021, and claiming priority to DE 10 2020 105 962.0, filed Mar. 5, 2020, the disclosures of which are expressly incorporated by reference herein in their entireties.

TECHNICAL FIELD

Examples herein relate to a printing press that includes at least one printing unit comprising at least four nozzle bars, each comprising at least one print head. At least one nozzle bar of the at least four nozzle bars may have at least one printing position and at least one service position. The at least one nozzle bar may be selectively arranged in the printing position or in the at least one service position, the at least one service position being configured as a first service position. In the first service position the at least one nozzle bar has a first distance with respect to the transport path of printing substrate, and in at least one second service position being configured as a second service position, the at least one nozzle bar may have a second distance with respect to the transport path. The at least one printing unit includes at least one cleaning device and at least one cleaning system. The at least one cleaning device includes at least one cleaning element including at least one fluid supply opening. The at least one cleaning system includes at least one removal unit comprising at least one contact element. The contact of the at least one print head with the at least one cleaning device corresponds to a contactless cleaning operation of at least one exit surface of the at least one print head. The first service position corresponds to a positioning of the at least one nozzle bar during a contactless cleaning operation of the at least one exit surface of the at least one print head of the at least one nozzle bar. The at least one nozzle bar may be arranged in the second service position when contact with the at least one cleaning system occurs.

Examples herein further relate to a method for cleaning at least one nozzle bar of at least one printing unit in which the at least one printing unit includes at least four nozzle bars, each including at least one print head. At least one print head of at least one nozzle bar of the at least four nozzle bars may be cleaned by at least one cleaning device comprising at least one cleaning element, which is arranged in an operating position, including at least one fluid supply opening. The at least one print head of the at least one nozzle bar of the at least four nozzle bars may be cleaned by at least one cleaning system that includes at least one removal unit, which is arranged in at least one operating position, comprising at least one contact element. An x direction corresponds to a direction along a shortest side of the respective nozzle bar), and a y direction corresponds to a direction along a longest side of the respective nozzle bar. The at least one cleaning device may be moved along at least one guide element of at least one guide system from at least one storage position into at least one usage position, or vice versa.

BACKGROUND

Various methods are available for printing onto printing substrate using a printing press, for example letterpress, gravure, or non-impact printing methods. Non-impact printing methods, for example thermographic methods or in particular the ink jet method, do not have a fixed, physically invariable printing forme and can, for example, generate different print images on a printing material during each printing operation. A non-impact printing press usually comprises at least one image-producing device, in particular at least one printing unit comprising preferably at least one print head, for example preferably an ink jet print head. In the case of the ink jet printing method, individual drops of a printing fluid are ejected as needed from at least one volume of the print head and transferred onto a printing substrate, yielding a print image on the printing substrate. By individually activating a multiplicity of volumes of the print head, different print images are generated, for example, which are individualized and/or personalized, for example, and/or are cost-effectively produced, for example, in particular in small print runs.

In particular in the field of application of package printing, regular cleaning of the components of the printing press, in particular of the print heads of the nozzle bars and/or the gaps thereof, is indispensable.

A printing press comprising a cleaning device for cleaning at least one print head of a nozzle bar is known from DE 10 2016 214 356 A1.

DE 11 2014 003 630 T5 discloses a cleaning device comprising a spray nozzle for spraying a cleaning solution onto a gap between two head modules of an ink jet print head and two removal elements, configured as wiping cloths, for removing the cleaning solution.

US 2013/0106940 A1 discloses an ink jet printing press comprising an ink jet print head. The printing press comprises at least one wiping device including a wiper for cleaning an ejecting surface and a wiper for cleaning a liquid collection point. Furthermore, an annular member is disclosed, which seals a liquid ejection area with respect to its surrounding area when arranged in a capping position.

US 2015/0158304 A1 teaches a cleaning system for cleaning an ink jet printer comprising multiple print heads. In particular poorly soluble UV-based ink is cleaned off the exit surface of the print head using a wiping device. A cover seals the nozzles of the exit surface with respect to its surrounding area.

WO 2019/059099 A1 discloses a printing device comprising ink jet print heads, wherein the print heads are moved horizontally from a printing position into a service position. A cleaning system comprises a wiping unit including a wiping cloth, wherein the nozzle surface is cleaned using a dry cleaning mode and a moist cleaning mode under pressure contact. In addition, sealing elements for sealing the nozzle surface are provided.

US 2010/0214355 A1 discloses a service device for cleaning a print head of a printing press. A device for spraying cleaning liquid is used to carry out contactless cleaning of the print head. Contact cleaning is carried out by means of a device including a wiping cloth. A cap is used to cover the nozzle surface after cleaning has been carried out. The print head is moved from its printing position into a service position for cleaning. The device including a wiping cloth is moved from a non-contact position into a contact position for carrying out the contact cleaning.

US 2012/0038707 A1 teaches a printing device comprising ink jet print heads. A print head is supported by a frame, with the frame having a printing position and a service position. The service position is shifted laterally along the axis of an impression cylinder with respect to the printing position. A device for ejecting cleaning liquid is used for cleaning with indirect contact with the nozzle surface. A device including a wiping cloth and a blade is used for cleaning with direct contact with the nozzle surface. The devices cleaning the nozzle surface are arranged between the printing position and the service position, wherein the nozzle surface is cleaned during the movement from the service position into the printing position, or vice versa.

DE 696 02 301 T2 discloses an ink jet printing system comprising multiple print heads in a carriage element. The carriage element moves along a print path through a print zone. A first service station for carrying out a first wiping operation at a first print head and a second service station for carrying out a second wiping operation at a second print head are positioned in the print head path. The first wiping operation employs a flexible wiper blade, while a stationary blade is used during the second wiping operation. The first and second service stations are arranged on a first side of the print zone, adjacent to one another.

US 2014/0292911 A1 discloses an ink jet printing device comprising a service unit. The service unit comprises a unit for applying cleaning liquid onto the nozzle surface of a print head, and an absorption unit comprising a wiping element and at least one covering unit. The nozzle surface and the service device are arranged opposite one another, relative to one another, by a moving device.

DE 10 2016 125 321 A1 teaches a device for cleaning print heads. The device comprises at least one spray nozzle for generating a cleaning jet, and at least one wiping lip. The spray nozzle and the wiping lip are arranged on a shared carriage or on separate carriages, wherein the carriage is, or the carriages are, movably arranged on a linear guide.

EP 1 218 193 A1 teaches a service station for cleaning a print head. If multiple print heads are present, multiple service stations are lined up in an array, one service station per print head. The assembly of the service station comprises a wiper and at least one sprayer. The service station can be arranged in the standby, wiping and sealing positions. For cleaning, the print head is moved from its printing position horizontally into a position directly above the service station.

US 2019/0283431 A1 discloses a cleaning device for cleaning a nozzle bar. A first cleaning element and a second cleaning element wipe the nozzle surface of the print heads. The nozzle bar is raised prior to cleaning and is then lowered onto the cleaning device, with contact cleaning by means of the first or the second cleaning element being carried out in the lowered position.

SUMMARY

It is an object of the invention to create a printing press and a method for cleaning at least one nozzle bar of at least one printing unit.

This object is achieved in some examples by a printing press in which the at least one cleaning device or the at least one cleaning system is selectively arranged in an area between the at least one nozzle bar and a transport path of the printing substrate. The at least one service position may be arranged in a vertical direction above the printing position, and the second distance of the second service position of the nozzle bar may be less than when in the first service position. Additionally, in some examples, a method includes that, in the at least one storage position, the at least one cleaning device is arranged along the x direction upstream or downstream from the at least one nozzle bar, and, in the operating position, the at least one cleaning element is arranged within an area between the at least one nozzle bar and a transport path of the printing substrate. Further, the at least one contact element may be configured as a wiping cloth, and, in the at least one operating position, the at least one removal unit may be arranged within the area between the at least one nozzle bar and the transport path of printing substrate. The at least one removal unit may be moved along at least one guide element, along a longest side of the at least one nozzle bar and/or along a y direction.

The advantages to be achieved with the invention are, in particular, that a printing press is created. The printing press comprises at least one printing unit including at least four nozzle bars, each including at least one print head. The at least one printing unit comprises at least one cleaning device. The at least one printing unit comprises the at least one cleaning device and at least one cleaning system. The at least one cleaning device comprises at least one cleaning element including at least one fluid supply opening. The at least one cleaning system comprises at least one removal unit including at least one contact element. The at least one contact element is configured as a wiping cloth. The at least one removal unit has at least one supply position and at least one operating position. In the at least one operating position, the at least one removal unit is arranged within an area between at least one nozzle bar of the at least four nozzle bars and a transport path of a printing substrate. The at least one cleaning element has at least one supply position and at least one operating position. In the at least one operating position, the at least one cleaning element is arranged within the area between the at least one nozzle bar and the transport path of a printing substrate. Selectively, the at least one cleaning device or the at least one cleaning system is arranged in the area between the at least one nozzle bar and the transport path of printing substrate. At least one nozzle bar of the at least four nozzle bars has at least one printing position and at least one service position. The at least one nozzle bar is selectively arranged in the printing position or in the at least one service position. The at least one service position is arranged in the vertical direction, preferably in a z direction, above the printing position. The at least one cleaning device is configured to clean the at least one print head, preferably at least one exit surface, in a contactless manner. In addition or as an alternative, the at least one cleaning system is preferably configured to make direct contact with the at least one print head. The at least one cleaning device has at least one storage position and at least one usage position. In the at least one storage position, the at least one cleaning device is arranged along a transport direction of printing substrate at the position of the transport path beneath the at least one nozzle bar upstream or downstream from the at least one nozzle bar. In the at least one storage position, the at least one cleaning device is arranged along an x direction, which corresponds to a direction along a shortest side of the respective nozzle bar, upstream or downstream from the at least one nozzle bar. In the at least one usage position, the at least one cleaning device is preferably arranged within an area between the at least one nozzle bar and the transport path of printing substrate.

Advantageously, a method for cleaning at least one nozzle bar of at least one printing unit is created. The at least one printing unit comprises at least four nozzle bars, each comprising at least one print head. At least one print head, preferably at least one exit surface of at least one print head, of at least one nozzle bar of the at least four nozzle bars is cleaned in a contactless manner by at least one cleaning device. At least one print head, preferably at least one exit surface of at least one print head, of at least one nozzle bar of the at least four nozzle bars is cleaned in a contactless manner by at least one cleaning device comprising at least one cleaning element, which is arranged in an operating position, including at least one fluid supply opening. In the operating position, the at least one cleaning element is preferably arranged within an area between the at least one nozzle bar and a transport path of printing substrate. In at least one storage position, the at least one cleaning device is arranged along a transport direction of printing substrate at the position of the transport path beneath the at least one nozzle bar upstream or downstream from the at least one nozzle bar. In at least one usage position, the at least one cleaning device is preferably arranged within an area between the at least one nozzle bar and the transport path of the at least one printing substrate. The at least one print head of the at least one nozzle bar of the at least four nozzle bars is cleaned by at least one cleaning system comprising at least one removal unit, which is arranged in at least one operating position, comprising at least one contact element configured as a wiping cloth. In at least one operating position, the at least one removal unit is arranged within the area between the at least one nozzle bar and the transport path of printing substrate. Preferably selectively, the at least one cleaning device and/or the at least one cleaning system clean the at least one print head of the at least one nozzle bar of the at least four nozzle bars. The at least one nozzle bar is selectively arranged in a printing position or in at least one service position. The at least one nozzle bar is preferably moved in a direction having a larger vertical component and a smaller horizontal component from the printing position into the at least one service position and/or from the at least one service position into the printing position. Selectively, the at least one cleaning device and/or the at least one cleaning system are preferably displaced into an area between the at least one nozzle bar and the transport path of printing substrate.

The printing press comprises at least one printing unit including at least one nozzle bar, wherein the at least one printing unit comprises at least one cleaning device, the at least one nozzle bar comprising at least one print head, the at least one nozzle bar having at least one printing position and at least one service position, and the at least one printing unit comprising at least one cleaning system. The at least one cleaning device comprises at least one cleaning element including at least one fluid supply opening. In addition or as an alternative, the at least one cleaning system comprises at least one removal unit including at least one contact element. The at least one cleaning device or the at least one cleaning system selectively makes contact with the at least one print head.

The at least one printing unit comprises the at least one cleaning device and the at least one cleaning system. Advantageously, this enables optimal cleaning of the at least one nozzle bar and/or of its at least one print head of the at least one printing unit of the printing press. Advantageously, a distinction can be made between a cleaning device and a cleaning system for cleaning the at least one nozzle bar. This makes it possible to advantageously react to the respective requirements and/or in accordance with the operating states of the at least one nozzle bar that occur or are present, in particular to the duration for which the at least one nozzle bar had a printing or non-printing operating state and/or in particular will have subsequent to the cleaning process. In addition or as an alternative, it is possible to react to the degree of soiling that is present and/or to the intensity with which the at least one nozzle bar and/or its at least one print head, for example due to the printing fluid used, is to be cleaned.

Advantageously, a disruption of the transport of a printing substrate that is being conveyed along the transport path by the at least one cleaning device and/or the at least one cleaning system is avoided. Preferably, at least one printing substrate is conveyed along the transport path by the at least one printing unit, while at least one nozzle bar of the printing unit is being cleaned by the at least one cleaning device and/or by the at least one cleaning system. For example, this at least one printing substrate is printed by at least one further nozzle bar, for example of the at least one printing unit and/or of at least one further printing unit. Advantageously, down times of the printing press are minimized.

The contact between the at least one print head and the at least one cleaning device is advantageously configured to be gentle on the print head, in particular its exit surface, since in this way in particular the exit surface of the print head is advantageously arranged so as not to be in direct contact with the cleaning device, and consequently damage, in particular to the exit surface, is avoided. In particular, the at least one cleaning system is configured to make direct contact with the at least one print head. In this way, the at least one cleaning system is preferably configured to clean off heavy dirt and/or at least partially insoluble residue of printing fluid and/or to carry out a thorough cleaning of the at least one print head. Cleaning of the at least one print head using direct contact with the at least one contact element advantageously removes dirt and/or printing fluid that, for example, was not removed by the cleaning operation by way of the at least one cleaning element and/or that, for example, has completely dried.

In particular a combination of cleaning by way of at least one cleaning element of the cleaning device and at least one contact unit of the cleaning system advantageously completely removes dirt and/or printing fluid from the at least one print head of the at least one nozzle bar and/or from a positioning gap between two adjacent print heads.

The at least one cleaning device comprises at least one guide system. The at least one guide system comprises at least one guide element. The at least one cleaning device is configured to move and/or be movable and/or is moved along the at least one guide element of the at least one guide system from the at least one storage position into the at least one usage position, or vice versa.

Advantageously, the at least one guide element enables rapid and secure guidance of the at least one cleaning device. The risk of the cleaning device tilting and, for example, thereby damaging the at least one exit surface, is minimized.

Advantageously, at least two cleaning devices comprise a shared guide system, more preferably at least one shared guide element of the guide system. In this way, the at least two cleaning devices are advantageously configured to be movable and/or to move jointly, in particular from the at least one storage position into the at least one usage position, or vice versa. This advantageously results in a space-saving design of the at least one guide system and/or in easy handling of the at least two cleaning devices. Advantageously, the at least two cleaning devices, as a result of the advantageous design of the at least one guide system, are configured to move into or out of an area between the at least one nozzle bar and a transport path of at least one printing substrate, in particular without, for example, interrupting and/or influencing a movement of a printing substrate moving along the transport path. Advantageously, the at least two cleaning devices are arranged so as to be aligned with respect to the at least one nozzle bar, regardless of their position, for example as a result of being inclined with respect to the z direction, and are advantageously configured to be movable and/or to move in the aligned arrangement.

Advantageously, the at least two cleaning devices comprise at least two shared guide systems. In particular, this prevents the cleaning devices from tilting along the working width of the printing unit and additionally establishes, or alternatively fixes, the printing unit across the working width the positioning and/or the aligned arrangement of the at least two cleaning devices. Advantageously, multiple rows of print heads are thus cleaned simultaneously, for example. Advantageously, a cost-effective guide system is created.

The at least one cleaning system is configured to move and/or be movable along at least one guide element. In an advantageous embodiment, at least two removal units of the at least one cleaning system are configured to move and/or be movable along the at least one guide element. The advantageous embodiment of the at least one guide element results in space savings within the printing unit.

Advantageously, the printing unit comprises the at least one sealing element. Advantageously, the at least one sealing element is configured in particular to protect the at least one print head, preferably the at least two print heads, of the at least one nozzle bar. In this way, printing fluid is advantageously conserved in the at least two print heads, in particular by the at least one sealing element, and/or is protected against drying out and/or is prevented from clogging at least one nozzle of the exit surface of the print head. Advantageously, the at least one sealing element is arranged to be in contact with the at least two print heads when the at least one nozzle bar is in a service position, but is arranged within the printing unit. In this way, the print heads advantageously remain in the printing unit or in their position in the nozzle bar. Advantageously, in this way an alignment of the print heads is dispensed with before these are being arranged and/or are arranged in at least one printing position again, after having made contact with the at least one sealing element. In particular, it is advantageously possible to arrange at least one nozzle bar of the printing unit in the printing position or in at least one service position and/or at least one nozzle bar of the printing unit is arranged in the printing position or in the at least one service position when at least one nozzle bar different therefrom, in particular at least two print heads of the nozzle bar different therefrom, are in contact with the at least one sealing element. The nozzle bar that is arranged in the at least one service position, which is not in contact with the at least one sealing element, is advantageously cleaned in the at least one service position by a cleaning device and/or a cleaning system, and/or advantageously another service operation, such as a replacement of print heads, is carried out. In an advantageous embodiment, the at least one cleaning device comprises the at least one sealing element. Advantageously, the at least one sealing element is then configured to be movable and/or to move by way of at least one guide system of the cleaning device, which, for example, results in space savings and/or easier handling within the printing unit.

Another advantage is that the at least one removal unit of the at least one cleaning system is configured to clean the at least one print head of the at least one nozzle bar. The at least one removal unit is advantageously configured to clean at least two print heads arranged in a row, in particular consecutively, along the longest side of the at least one nozzle bar, in particular by way of a displacement along the guide element. Advantageously in addition or as an alternative, the at least one removal unit is arranged in at least one supply position or at least one operating position as a result of the displacement along the at least one guide element. In particular, the at least one removal unit remains within the printing unit, regardless of its position. By arranging at least two removal units on at least one shared carrier, advantageously at least two rows of print heads can be cleaned and/or are cleaned, in particular simultaneously.

This, for example, results in time savings of the cleaning step as well as, in addition or as an alternative, in space savings, in particular since no guide elements of the individual removal units are required. In an advantageous embodiment, a driven storage device of the contact element, or a storage device connected to a drive, which is configured as a wiping cloth, makes it possible for the contact between a contact element that is used in a cleaning step and the at least one print head to be dissolved, and for a contact element that has not yet been used in a cleaning step and/or is clean to make contact with the at least one print head. The advantageous embodiment of the at least one pressing element advantageously ensures that the at least one contact element is gently brought in contact with the at least one print head. In particular, the resilient design and/or the setting of the contact pressure protects the at least one print head, in particular its exit surface, against damage. In particular, it is ensured that the at least one contact element is optimally set against the at least one print head, and thus is optimally cleaned, as a result of an inclination of the removal unit corresponding to the inclination of the print head.

Further advantages are apparent from the following description.

BRIEF DESCRIPTION OF THE DRAWINGS

Exemplary embodiments of the invention are illustrated in the drawings and will be described in greater detail below. The drawings show.

DETAILED DESCRIPTION

Figure 1:
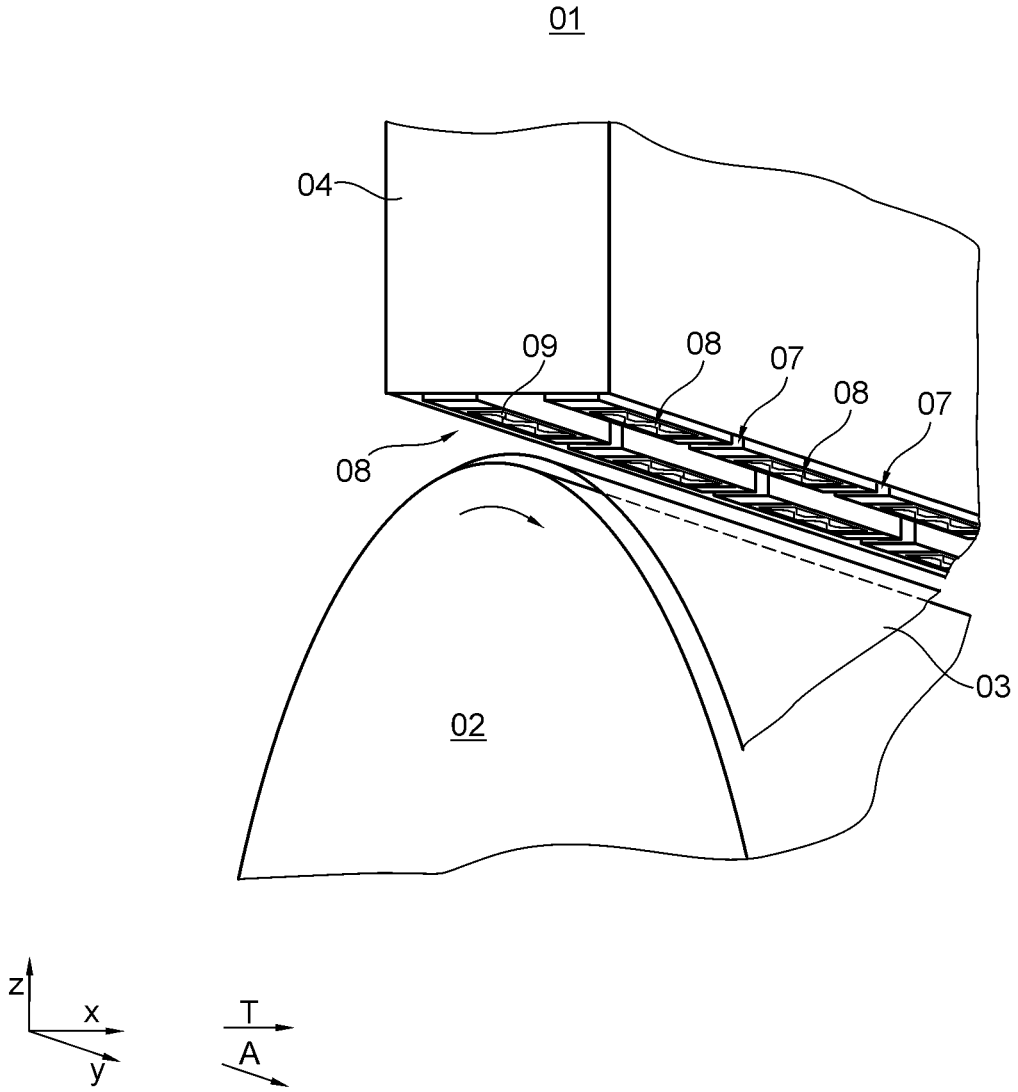
FIG. 1 a schematic perspective illustration of at least one printing unit comprising at least one nozzle bar and at least one opposite printing substrate guide element as well as a printing substrate.
Figure 2A:
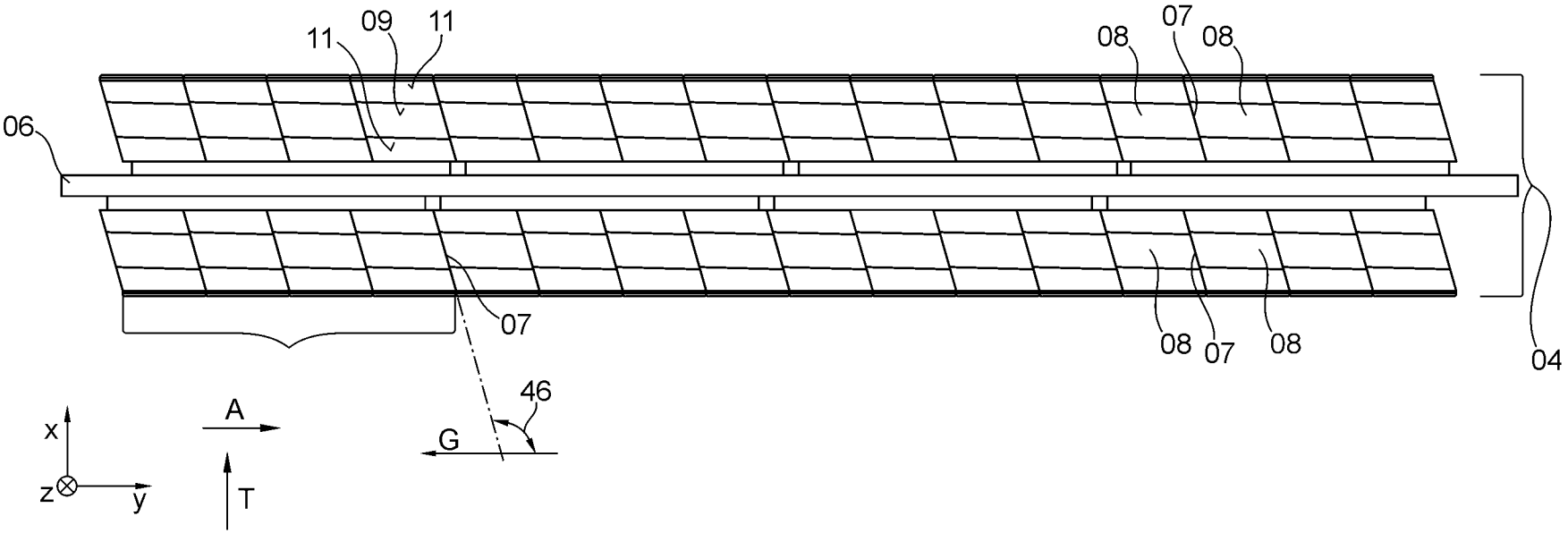
FIG. 2*a* shows a schematic illustration of at least one nozzle bar comprising two rows of diagonally overlapping print heads.
Figure 2B:
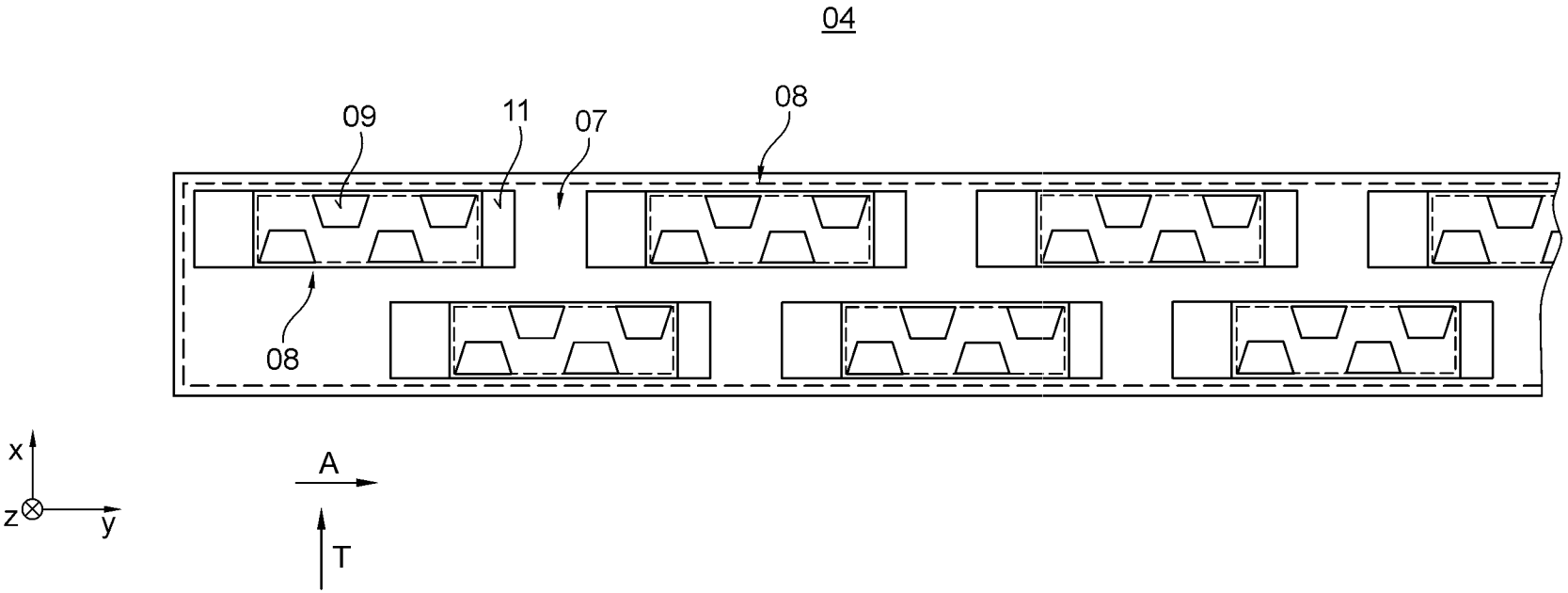
FIG. 2*b* shows a schematic illustration of an alternative embodiment of at least one nozzle bar comprising multiple print heads, which are arranged offset from one another in a double row.

A printing press comprises at least one printing unit 01 and at least one printing substrate guide element 02 for guiding at least one printing substrate 03. The at least one printing unit 01, which is in particular configured as a non-impact printing unit 01, preferably as an ink jet printing unit 01, comprises at least one nozzle bar 04, comprising at least one print head 08, preferably at least one ink jet print head 08, more preferably a print head 08 operating according to the piezo ink jet method. Preferably, at least one printing substrate guide element 02 is assigned to the relevant nozzle bar 04. The at least one print head 08 comprises at least one exit surface 09. In the case of the piezo ink jet method, a formation and an ejection of drops of the print head 08 preferably take place by way of mechanical deformation of at least one nozzle chamber of the print head 08, in particular as a result of an electronic signal and the piezoelectric properties of the material of the nozzle chamber. For example, the printing press comprises at least two printing units 01, each comprising at least one, preferably at least two, more preferably at least four, nozzle bars 04. For example, at least eight different colors can thus be printed and/or the printing substrate 03 can be printed both on the upper side and on the underside.

The printing press, within this patent specification, is a machine that applies and/or is capable of applying at least one printing fluid onto at least one printing substrate 03.

Above and below, the at least one printing substrate 03 is a substrate onto which a medium, in particular a printing fluid, can be printed by the at least one printing unit 01. Preferably, the printing substrate 03 is preferably configured as paper and/or cardboard and/or corrugated cardboard and/or paperboard. The printing substrate 03 is in particular configured as a web or a sheet.

According to DIN 6730, paper is a flat material, consisting mainly of fibers derived from vegetable sources, which is formed by the dewatering of a fiber suspension on a sieve. In the process, a card web is created, which is subsequently dried. The basis weight of paper is preferably a maximum of 225 g/m$^2$. According to DIN 6730, cardboard is a flat material, consisting mainly of fibers derived from vegetable sources, which is formed by the dewatering of a fiber suspension on a sieve or between two sieves. The fiber structure is compressed and dried. Cardboard is preferably manufactured from cellulose by gluing or pressing the cellulose together. Cardboard is preferably configured as solid board or corrugated cardboard. The basis weight of cardboard is preferably more than 225 g/m$^2$. Corrugated cardboard is cardboard made of one or more layers of corrugated paper that is glued to one layer or between multiple layers of another, preferably smooth, paper or cardboard. Above and below, the term paperboard preferably refers to a sheet material that is preferably primed on one side and made of paper, having a basis weight of at least 150 g/m$^2$ and no more than 600 g/m$^2$. Paperboard preferably has high strength relative to paper.

Preferably, the at least one printing substrate 03, for example at least a portion of the at least one printing substrate 03, is configured as an intermediate product for producing an end product, and/or is, for example, further processed and/or is configured to be further processable into a desired or required end product. For example, the at least one printing substrate 03 is configured as paper and is further processed to corrugated cardboard. The desired or required end product, which was preferably generated by further processing at least part of the printing substrate 03, is preferably a packaging material, and more preferably at least one folding box.

The at least one printing substrate 03 preferably includes at least one pigment coating. The at least one printing substrate 03 preferably includes a pigment coating of at least 5%, preferably at least 8%, more preferably at least 10%, of the total weight of the at least one printing substrate 03. In addition or as an alternative, the at least one printing substrate 03 includes a pigment coating of no more than 30%, preferably no more than 25%, more preferably no more than 20%, of the total weight of the at least one printing substrate 03. Above and below, a pigment coating preferably denotes a coating material that is applied to the surface of the at least one printing substrate 03. The printing substrate 03 comprising at least one coating material is preferably referred to as a coated printing substrate 03. The surface of the printing substrate 03 is preferably at least partially finished by the application of the at least one coating material. Compared to an uncoated printing substrate 03 having no coating material applied thereto, a coated printing substrate 03 preferably has improved printability and/or a smoother surface, and/or accepts printing fluid in a way that is adapted to the required print image. The at least one coating material preferably comprises at least one binding agent and/or at least one additive and/or at least one pigment.

Preferably, the at least one printing substrate 03 has a total weight, that is, preferably including the at least one pigment coating, of at least 120 g/m$^2$ (one hundred twenty grams per square meter), preferably of at least 130 g/m$^2$ (one hundred thirty grams per square meter), more preferably of at least 145 g/m$^2$ (one hundred forty-five grams per square meter), and, additionally or alternatively, a total weight of no more than 260 g/m$^2$ (two hundred sixty grams per square meter), preferably of no more than 240 g/m$^2$ (two hundred forty grams per square meter), more preferably of no more than 230 g/m$^2$ (two hundred thirty grams per square meter). Preferably in addition or as an alternative, the at least one printing substrate 03 has a thickness of at least 120 μm (one hundred twenty micrometers), preferably at least 140 μm (one hundred forty micrometers), more preferably 160 μm (one hundred sixty micrometers), and, additionally or alternatively, a thickness of no more than 300 μm (three hundred micrometers), preferably no more than 280 μm (two hundred eighty micrometers), more preferably no more than 260 μm (two hundred sixty micrometers).

Preferably, the at least one nozzle bar 04 in each case comprises at least two print heads 08, which are arranged next to one another in a y direction, in particular abutting one another, preferably adjacent to one another, and/or which extend in particular across the entire working width of the printing unit 01. Preferably, the number of print heads 08 arranged along the longest side of the nozzle bar 04 in the nozzle bar 04 is such that an entire working width of the printing unit 01 and/or of the nozzle bar 04 and/or of the printing press is covered in each case by at least one print head 08. The at least one nozzle bar 04 preferably extends across the entire working width of the printing unit 01 and/or of the printing press. The respective print heads 08 of a nozzle bar 04 are preferably in each case arranged, in the y direction, in at least one row, preferably in at least two rows, for example in exactly two rows. The at least one nozzle bar 04 preferably comprises the at least two rows of in each case at least two print heads 08 that are arranged next to one another. The at least one nozzle bar 04 preferably extends across the entire working width of the printing unit 01. In particular, for example, at least two print heads 08 of the nozzle bar 04 are in each case arranged next to one another in a y direction and/or connected to one another via a for example fixed axis in the y direction to form a group of print heads 08. The at least one nozzle bar 04 preferably has a longitudinal extension in the y direction. The at least one nozzle bar 04 preferably has an extension along its width in the x direction. The longitudinal extension is preferably greater than the extension in the width. The longitudinal extension preferably includes a larger number of print heads 08 than the extension in the direction of the width.

The y direction and an x direction and a z direction form a Cartesian coordinate system. The x direction corresponds to a direction along a shortest side of the respective nozzle bar 04. The y direction corresponds to a direction along a longest side of the respective nozzle bar 04. The y direction is preferably parallel to an axis of rotation of the at least one printing substrate guide element 02. The x direction and the y direction preferably span a horizontal plane. The longest side of the at least one nozzle bar 04 is preferably the side of the at least one nozzle bar 04 along which at least two, preferably at least four, more preferably at least eight, print heads 08 are arranged in a row. Preferably, the at least one row of print heads 08 extends, preferably at least two rows of print heads 08 extend, along the longest side of the at least one nozzle bar 04. The shortest side of the at least one nozzle bar 04 is preferably arranged orthogonally to its longest side. Preferably, only one print head 08 of a respective row is arranged along the shortest side of the at least one nozzle bar 04. For example, two print heads 08 of a respective row of print heads 08 are arranged one behind the other along the shortest side of the at least one nozzle bar. The z direction is preferably parallel to a normal vector of a plane spanned by the x direction and the y direction. The z direction preferably corresponds to a vertical direction.

A transverse direction A is preferably a direction that extends in each case parallel to a longest side of the at least one nozzle bar 04. The transverse direction A is preferably situated parallel to the y direction. The x direction is preferably situated orthogonally to the transverse direction A. The working width is in particular parallel to the transverse direction A. Furthermore, the transverse direction A is preferably orthogonal to a transverse direction T.

Above and below, the working width is the maximum width that a printing substrate 03 is allowed to have to be able to still be processed by the at least one printing unit 01 of the printing press, which thus corresponds to the maximum width of the respective printing substrate 03 that can be processed by the at least one printing unit 01 of the printing press. The working width preferably corresponds to an extension of the at least one exit surface 09 of at least one print head 08 along the y direction which is preferably utilized for printing onto the printing substrate 03.

The spatial area intended for transporting a printing substrate 03, which the printing substrate 03, if present, at least temporarily occupies, is the transport path. The transport path is established by at least one transport means, in particular by the at least one printing substrate guide element 02. Preferably, the at least one printing substrate guide element 02 is in each case configured as at least one roller and/or at least one cylinder and/or at least one supporting surface and/or at least one other device for guiding the printing substrate 03 in a printing operating mode of the printing press.

The transport direction T is a direction T which is intended for a printing operating mode of at least one printing unit 01 of the printing press and in which the printing substrate 03, if present, is transported at each point of the transport path. The transport direction T is preferably a direction that extends in each case parallel to a shortest side of the at least one nozzle bar 04. The transverse direction A is the axial direction orthogonal to the transport direction T. Preferably, for example, the transport direction T is parallel to the x direction and/or, for example, the transverse direction A is parallel to the y direction of the Cartesian coordinate system at a point of the shortest distance between a relevant print head 08 and the transport path.

Above and below, a printing fluid refers to inks, printing colors and/or varnishes, as well as further materials that are transferred and/or can be transferred by a printing press or at least one printing unit 01 of the printing press onto a printing substrate 03. A printing fluid that is present in a volume of the print head 08 can preferably exit the volume of the relevant print head 08 through an opening in the exit surface 09, in particular in the form of drops. The at least one nozzle bar 04 preferably includes cyan (C) or magenta (M) or yellow (Y) or black (K) as colors of the printing fluid. Preferably, two different nozzle bars 04 include different printing fluids. Preferably, in each case at least one nozzle bar 04, preferably in each case at least one nozzle bar 04 of the at least four nozzle bars 04, of the printing press or of the at least one printing unit 01 includes cyan (C) or magenta (M) or yellow (Y) or black (K) as colors of the printing fluid. For example, at least one nozzle bar 04 includes a further printing fluid, which is embodied as a varnish or primer, for example. The at least four nozzle bars 04 of the printing unit 01 preferably include different colors.

The printing fluid of the at least one print head 08 is preferably embodied as printing fluid for package printing and/or for printing a packaging material. Preferably, the at least one nozzle bar 04, in particular the at least one print head 08, includes printing fluid having a viscosity, preferably a dynamic viscosity, of at least 3 mPa*s (three millipascal seconds), preferably at least 4.5 mPa*S (four point five millipascal seconds), and/or having a viscosity of no more than 6 mPa*s (six millipascal seconds), preferably no more than 5.5 mPa*s (five point five millipascal seconds). The preceding viscosity values preferably refer to the viscosity between 20° C. (twenty degrees Celsius) and 40° C. (forty degrees Celsius), preferably of at least 25° C. (twenty-five degrees Celsius) and/or no more than 35° C. (thirty-five degrees Celsius), and/or were preferably determined according to DIN EN ISO 2884-1:2006-09. The printing fluid is preferably water-based and/or at least partially water-soluble and/or preferably includes at least one pigment. Preferably, the at least one nozzle bar 04 includes printing fluid having a pigment content of the printing fluid of at least 1%, preferably of at least 2%, more preferably of at least 3%, more preferably of at least 4%, and/or preferably having a pigment content of the printing fluid of no more than 18%, preferably of no more than 14%, more preferably of no more than 10%, more preferably of no more than 7%. For example, the fully dried printing fluid is more difficult to dissolve using cleaning agent than printing fluid having a residual content of liquid printing fluid.

Above and below, a cleaning agent and/or cleaning fluid in particular denotes a liquid that is employed when cleaning individual components of a printing press, in particular for cleaning at least one exit surface 09 of at least one print head 08. The cleaning agent is preferably employed for removing residues of the at least one printing fluid on components of the printing press, in particular of the exit surface 09 of at least one print head 08 and/or of a positioning gap 07 between two print heads 08 that are arranged next to one another. For example, the cleaning agent comprises water and/or at least one surfactant and/or at least one solvent. For example, the at least one cleaning fluid comprises printing fluid that preferably does not include any pigments. The at least one cleaning fluid is preferably configured to at least partially dissolve the printing fluid of the at least one nozzle bar 04.

A printing unit 01 comprises at least one nozzle bar 04. A printing unit 01 comprises at least four nozzle bars 04, for example exactly four nozzle bars 04. The at least one nozzle bar 04 is, for example, arranged in at least one printing position, for example shown in FIG. 1. The printing position describes the position of the nozzle bar 04 in which the nozzle bar 04 is arranged in a printing operating mode of the printing press. Printing fluid is preferably printed onto least one printing substrate 03 in the printing operating mode by the at least one print head 08 of the at least one nozzle bar 04 that is arranged in the printing position, preferably of the at least one nozzle bar 04 of the at least four nozzle bars 04. Preferably, a respective print head 08 that is arranged in its printing position is characterized in that the respective exit surface 09 has a distance, with respect to the intended transport path for at least one printing substrate 03 and/or with respect to the at least one printing substrate 03 and/or with respect to the printing substrate guide element 02 assigned to the respective nozzle bar 04, which is no more than 5 mm (five millimeters), preferably no more than 1.5 mm (one point five millimeters) and/or which is at least 0.5 mm (zero point five millimeters), preferably at least 1.0 mm (one point zero millimeters). The at least one printing unit 01 comprises at least one cleaning device 18 and/or at least one cleaning system 61.

In a printing operating mode of the printing press, for example, at least one printing substrate 03 is guided along the transport direction T by means of the at least one printing substrate guide element 02, through a spatial area between the respective printing substrate guide element 02 and the relevant nozzle bar 04. The at least one print head 08 is positioned with at least one exit surface 09 in each case in the relevant nozzle bar 04, facing the printing substrate guide element 02.

The at least one nozzle bar 04 comprises at least one print head 08, and in particular at least two print heads 08. The at least two print heads 08 are preferably arranged next to one another, in particular adjacent to one another. Preferably, the at least two print heads 08 are arranged along the y direction next to one another, in particular abutting one another, preferably adjacent to one another, and/or preferably in a partially overlapping manner in the x direction. The individual print heads 08 of the relevant nozzle bar 04 are preferably arranged along the y direction within at least one row, preferably within at least two, in particular parallel, rows of print heads 08. Preferably, the respective exit surfaces 09 of at least two print heads 08 that are arranged next to one another, and preferably adjacent to one another, are in each case positioned spaced apart from one another, in particular in the y direction, in particular within a row, by the at least one positioning gap 07. Preferably, the at least two print heads 08 that are arranged next to one another in the y direction are arranged spaced apart from one another by the at least one positioning gap 07. More preferably, the at least two print heads 08 that are arranged next to one another in the y direction, in particular adjacent to one another, in particular the respective exit surfaces 09 of the print heads 08, which are in particular arranged next to one another in the y direction, delimit the corresponding positioning gap 07 in the y direction. This, for example, facilitates a positioning of the respective print heads 08.

In one exemplary embodiment of a nozzle bar 04, the print heads 08 of the nozzle bar 04, which are preferably arranged in a row in the y direction, are in each case arranged so as to at least partially diagonally overlap, for example in the x direction, preferably in the transport direction T, and/or the respective exit surfaces 09 of the corresponding print heads 08 are preferably arranged spaced apart from one another in the y direction by the respective one positioning gap 07.

In an alternative embodiment of a nozzle bar 04, the nozzle bar 04, for example, comprises at least two, preferably parallel, rows of print heads 08, wherein a row in the y direction comprises at least two print heads 08, preferably a multiplicity of print heads 08. The print heads 08 of the rows arranged in each case in the y direction are preferably in each case arranged offset from one another in the x direction, whereby the respective exit surfaces 09 of the print heads 08 that are in each case arranged offset from one another preferably at least partially overlap.

A print head 08 comprises the at least one exit surface 09 and at least one, in particular at least two bearing surfaces 11. The at least one bearing surface 11 is preferably configured as a spacer surface 11. The bearing surface 11 is preferably configured in such a way that the exit surface 09 is arranged to avoid undesirable contact with components or other elements, for example when cleaning the exit surface 09. The spacer surface 11 preferably extends across an entire extension of the respective print head 08. However, dimensions across only a portion of the extension of the respective print head 08 are also possible.

The exit surface 09 of a print head 08 is a surface of the respective print head 08 that faces the transport path and is in particular located in a plane whose normal vector is situated parallel to the z direction. The exit surface 09 is, for example, configured as a parallelogram, preferably as a non-rectangular parallelogram. A trapezoid, in particular an isosceles trapezoid, is another exemplary embodiment of the exit surface 09. Preferably, the exit surface 09 includes at least one opening, in particular a multiplicity of openings, through which the printing fluid can exit at least one volume, in particular a multiplicity of volumes, of the relevant print head 08, preferably in the form of drops.

An exit direction of the at least one exit surface 09 is the direction in which the printing fluid exits and/or is able to exit the respective print head 08 through at least one opening of the corresponding exit surface 09, in particular in the form of drops. The exit direction of the exit surface 09 is preferably, at least in one component, and more preferably completely, parallel to a surface normal of the exit surface 09 of the respective print head 08.

The respective exit surfaces 09 of the relevant print heads 08 of a nozzle bar 04, which are arranged next to one another in the y direction, are preferably arranged so as to at least partially abut one another in the x direction, and more preferably so as to at least partially overlap. Preferably, the sum of all exit surfaces 09 within at least one row of print heads 08 of a nozzle bar 04 which is arranged in the y direction, for example also of at least two rows, extends across the entire working width of the respective nozzle bar 04. In this way, each position along a straight line, in the y direction on the transport path, is assigned an opening within an exit surface 09 of the relevant nozzle bar 04 through which the printing fluid can exit a volume of a corresponding print head 08 of the nozzle bar 04.

Within a nozzle bar 04, preferably at least two print heads 08 are in each case arranged next to one another, and in particular adjacent to one another, in the y direction. Within a row of print heads 08, in particular two print heads 08 are in each case arranged adjacent to one another in the y direction. For example, for positioning the relevant at least two adjacent print heads 08 of the corresponding nozzle bar 04, the respective exit surfaces 09 of the at least two print heads 08 are preferably arranged spaced apart from one another by the one positioning gap 07. Preferably, the at least one positioning gap 07 in each case has an extension in the y direction of no more than 0.5 mm (zero point five millimeters), and in particular of no more than 0.2 mm (zero point two millimeters). In particular, the at least one positioning gap 07 has an extension in the y direction of at least 0.05 mm (zero point zero five millimeters), and preferably of at least 0.1 mm (zero point one millimeter).

Preferably, a cleaning direction G and/or the y direction has a preferably plane angle, in particular a positioning angle 46, of at least 50° (fifty degrees), preferably of at least 60° (sixty degrees), and of no more than 130° (one hundred thirty degrees), preferably of no more than 120° (one hundred twenty degrees), with respect to a longitudinal direction of the positioning gap 07, in a positive mathematical direction of rotation, which means rotated counterclockwise. From this, it is in particular apparent, for example, that the longitudinal direction of the positioning gap 07, preferably of the positioning angles 46 of the longitudinal direction of the positioning gap 07, is arranged in the plane spanned by the x direction and the y direction. The longitudinal direction of the positioning gap 07 is preferably the direction in which the greatest extension of the positioning gap 07 takes place. The longitudinal direction of the positioning gap 07 is preferably oriented, at least with one component, orthogonally to the cleaning direction G within the plane spanned by the x direction and the y direction. The positioning angle 46 thus, for example, corresponds to the at least partially diagonal overlap in the x direction of at least two print heads 08 that are arranged next to one another, and in particular adjacent to one another.

Preferably, at least one feed device 13 for ejecting a fluid is in each case assigned to the respective positioning gap 07. The at least one feed device 13 is preferably in each case configured as a nozzle 13, in particular as a cleaning nozzle 13. More preferably, the feed device 13 is configured as a nozzle 13 for ejecting fluid, preferably a gaseous fluid and/or compressed gas. The feed device 13 is preferably arranged in such a way that a fluid, for example a compressed gas and/or a gas mixture, in particular air, and/or a liquid, is able to flow through the respective feed device 13 such that the fluid is able to exit the feed device 13, in particular through an outlet opening 17, in an outlet direction L. At least one component of the outlet direction L, preferably in the z direction, is preferably directed at the respective positioning gap 07. Preferably, at least one feed device 13 for ejecting a fluid with an outlet direction L is assigned to the respective positioning gap 07, wherein at least one component of the outlet direction L is directed at the respective positioning gap 07. The outlet opening 17 of the feed device 13 is preferably directed at the positioning gap 07, for example, from the top and/or from above the printing substrate guide element 02, in the direction of the printing substrate guide element 02.

The at least one feed device 13, which is directed at the at least one positioning gap 07 between at least two print heads 08 that are arranged next to one another, for example, preferably impedes and/or prevents printing fluid and/or dirt from penetrating into the positioning gap 07, and/or printing fluid and/or dirt from accumulating and/or depositing in the relevant positioning gap 07. This, for example, during a cleaning process, supports the cleaning of the relevant positioning gap 07, for example by the at least one cleaning device 18, and/or impedes printing fluid and/or dirt from accumulating and/or depositing during a printing operation.

The feed device 13 preferably comprises at least one feed element 14 and/or at least one outlet element 16; 43, wherein the at least one outlet element 16; 43 is preferably in each case configured as at least one delimiting element 16 and/or at least one opening element 43, and/or the at least one outlet opening 17. The feed device 13 preferably comprises at least one cavity, which is preferably connected to the at least one outlet opening 17. For example, the at least one outlet element 16; 43 is in each case configured as at least one metal plate or a tube. The delimiting element 16 is preferably configured in a planar manner, for example as a planar metal plate. The at least one opening element 43 preferably includes at least one recess 17, which more preferably is configured as the at least one outlet opening 17.

In a preferred embodiment, the at least one feed device 13 is preferably in each case connected to at least one print head 08 of the relevant print heads 08, which delimit the respective positioning gap 07. In addition or as an alternative, the at least one nozzle bar 04 preferably comprises the at least one feed device 13, wherein the feed device 13 is preferably positioned in the z direction on the side of the exit surface 09 which faces away from the at least one opening of the respective exit surface 09. In addition or as an alternative, the at least one nozzle bar 04 preferably comprises the at least one feed device 13, wherein the feed device 13 is preferably arranged in the z direction on the side, facing away from the transport path, of at least one exit surface 09 of at least one print head 08 of the corresponding nozzle bar 04, and/or wherein the respective outlet direction L of the at least one feed device 13 is in each case directed at least one positioning gap 07 between two print heads 08 that are in particular adjacent to one another, preferably in the y direction.

The at least one feed device 13 is preferably arranged in the z direction of the side of the respective exit surface 09 which faces away from the transport path. More preferably, the at least one feed device 13 is positioned on the side of the print head 08, in particular of the exit surface 09, at which the print head 08 is attached to the corresponding nozzle bar 04. More preferably, the at least one feed device 13 is positioned in such a way that the outlet direction L is directed from a side of the print head 08, in particular a side of the exit surface 09, at the at least one positioning gap 07 at which the print head 08 is attached to the corresponding nozzle bar 04.

The feed device 13 is preferably arranged so as to be spaced apart from the positioning gap 07 in the z direction. More preferably, the feed device 13 is arranged so as to abut the positioning gap 07 in the z direction. The outlet opening 17 is preferably arranged so as to be spaced apart from the positioning gap 07 in the z direction. More preferably, the outlet opening 17 is arranged so as to abut the positioning gap 07 in the z direction. This means that the feed device 13, in particular the respective outlet opening 17, is arranged so as to be spaced apart, preferably in the z direction, from the respective exit surfaces 09 of two print heads 08, which are arranged next to one another in the y direction, and whose exit surfaces 09 delimit the corresponding positioning gap 07.

The outlet direction L is preferably a direction in which a fluid, for example a gas and/or a gas mixture, in particular air, and/or a liquid, is able to exit the relevant feed device 13, preferably through the at least one outlet element 16; 43, in particular the at least one outlet opening 17. The outlet direction L is preferably parallel, at least in one component, and/or shows an identical direction to the exit direction of the at least one exit surface 09 of a print head 08 of the nozzle bar 04. More preferably, at least one component of the outlet direction L is parallel and/or shows an identical direction to the surface normal of the exit surface 09 of the respective print head 08 and/or a direction in which the printing fluid is able to exit the respective exit surface 09.

The outlet direction L is preferably parallel to a main direction, which is preferably established by at least one side wall of the feed device 13, which more preferably is established by the at least one delimiting element 16. The outlet direction L preferably has at least one component in the z direction, wherein the component in the z direction preferably faces the transport path. For example, the outlet direction L includes at least one component in the z direction and at least one component in the x direction, wherein the component in the z direction is greater than the component in the x direction.

The outlet direction L is preferably a direction within a plane spanned at the position of the positioning gap 07, for example shifted along the y direction, by the z direction and at least one direction of a shortest delimitation, which is spanned in a plane of the x direction and y direction, of the respective exit surface 09 of the relevant print head 08, which preferably delimits the positioning gap 07.

In a preferred embodiment, the at least one feed device 13, in the y direction, has an extension that is identical to the extension of the respective positioning gap 07 in the y direction. More preferably, the at least one feed device 13, in the y direction, has an extension of no more than 0.5 mm (zero point five millimeters), and in particular of no more than 0.2 mm (zero point two millimeters). More preferably, the at least one feed device 13, in the y direction, has an extension of at least 0.05 mm (zero point zero five millimeters), and preferably of at least 0.1 mm (zero point one millimeter).

In the plane that is spanned by the z direction and at least one direction of the shortest delimitation, which is spanned in a plane of the x direction and y direction, of the respective exit surface 09 of the relevant print head 08, wherein the respective exit surface 09 delimits the positioning gap 07, the outlet opening 17 is preferably configured in such a way that the relevant outlet opening 17 in the z direction, away from the respective exit surface 09, and in particular away from the transport path, has a smaller dimension than in the z direction close to the exit surface 09, and in particular close to the transport path. In the plane that is spanned at the position of the positioning gap 07, for example shifted along the y direction, by the z direction and at least one direction of the shortest delimitation, which is spanned in a plane of the x direction and y direction, of the respective exit surface 09 of the relevant print head 08, which delimits the positioning gap 07, the outlet opening 17 preferably has a shape that corresponds to a two-dimensional longitudinal section of a cone, for example. In addition or as an alternative, the diameter of the outlet opening 17, measured in the direction of the shortest delimitation, which is spanned in a plane of the x direction and y direction, of the exit surface 09, which delimits the positioning gap 07, preferably increases along the z direction in the direction of the transport path. The at least one outlet opening 17 preferably has a maximum diameter at the point of the feed device 13 which has the smallest distance with respect to the respective positioning gap 07. More preferably, the maximum diameter of the corresponding outlet opening 17 is greater than the extension of the at least one exit surface 09 of the relevant print head 08, which is arranged at the corresponding positioning gap 07, in the direction of the shortest delimitation of the respective exit surface 09.

Preferably, the delimiting element 16 delimits the respective outlet opening 17 in the y direction, preferably on one side. The respective delimiting element 16 is preferably in direct contact with the respective opening element 43. More preferably, the feed element 14 is in direct contact with the respective opening element 43, so that a connection preferably exists between at least one cavity of the feed element 14 and the respective outlet opening 17. More preferably, the opening element 43 and in particular the respective outlet opening 17 of the corresponding feed device 13 is arranged between the respective delimiting element 16 and the respective feed element 14.

The feed element 14 preferably comprises the at least one cavity, wherein the cavity is connected to at least one source for supplying the at least one fluid, for example a gas and/or a gas mixture, in particular air, and/or a liquid, and to the outlet opening 17.

Figure 3A:
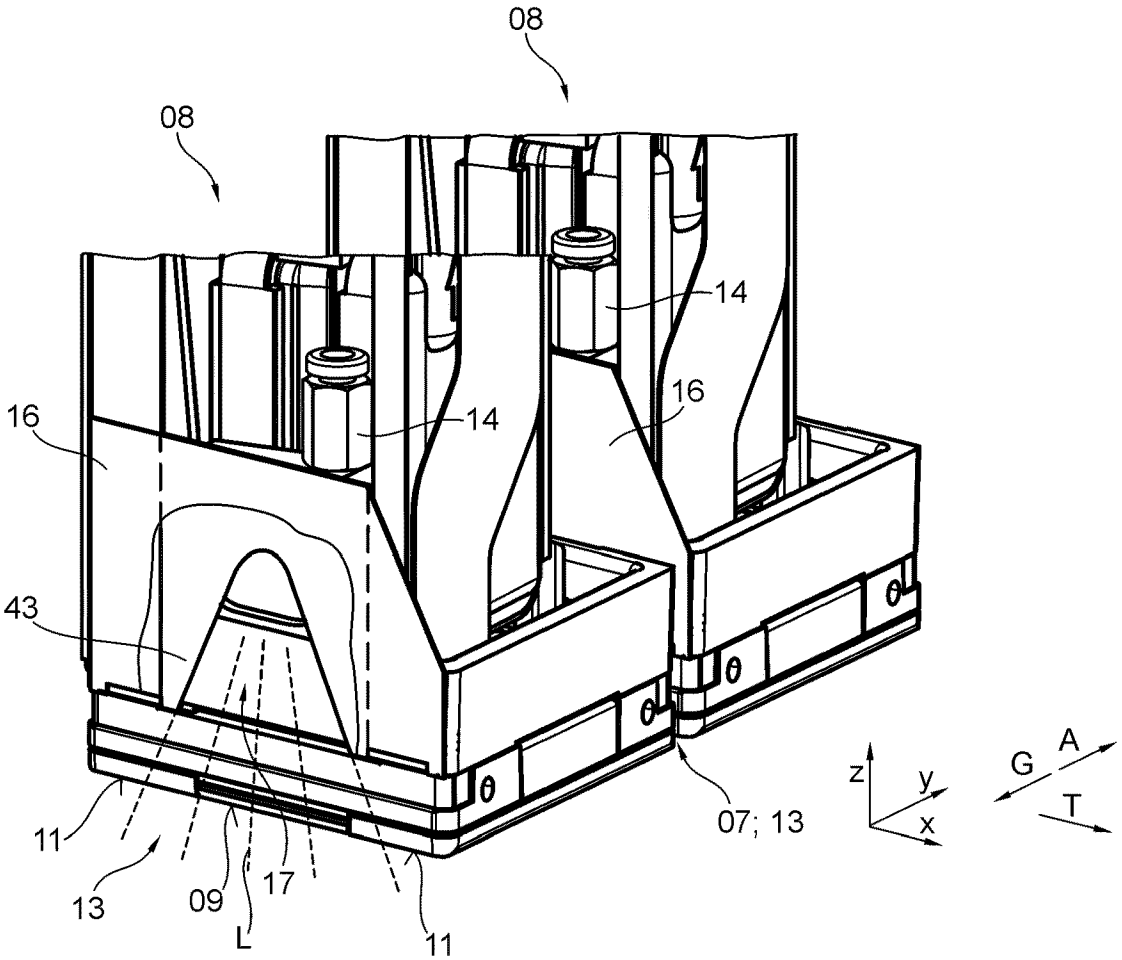
FIG. 3*a* shows a schematic perspective illustration of at least two print heads, which are arranged spaced apart from one another by a positioning gap, comprising at least one first feed device, which is assigned to the positioning gap, and a second feed device, the second feed device being illustrated in a sectional view.
Figure 3B:
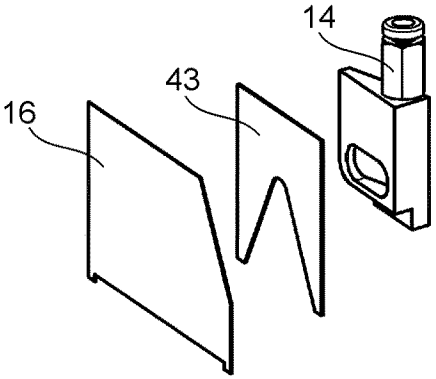
FIG. 3*b* shows a schematic breakdown of an exemplary feed device.
Figure 4A:
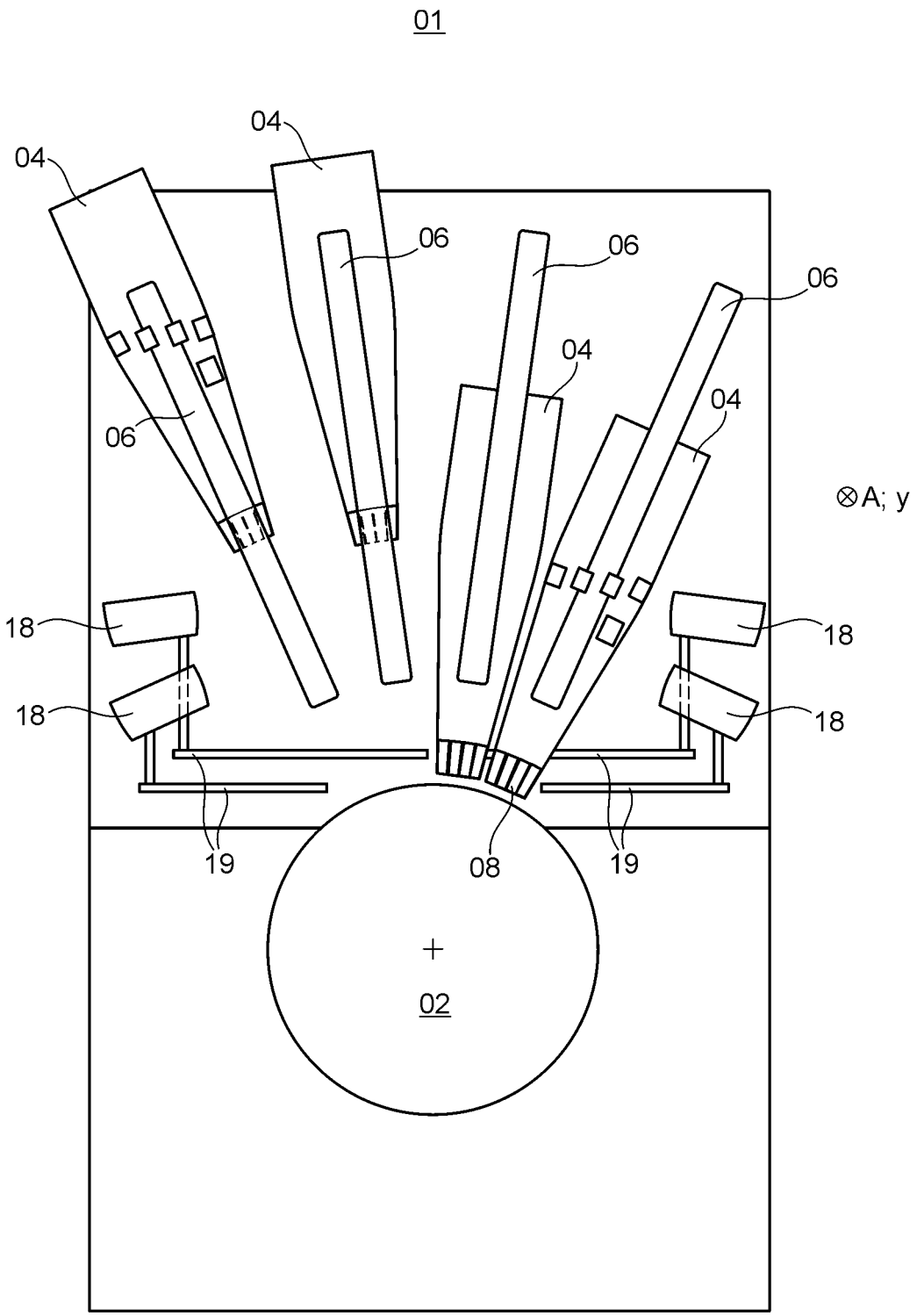
FIG. 4*a* shows a schematic illustration of a printing unit comprising multiple nozzle bars, at least one nozzle bar being arranged in a printing position and at least one nozzle bar is arranged in an idle position.
Figure 4B:
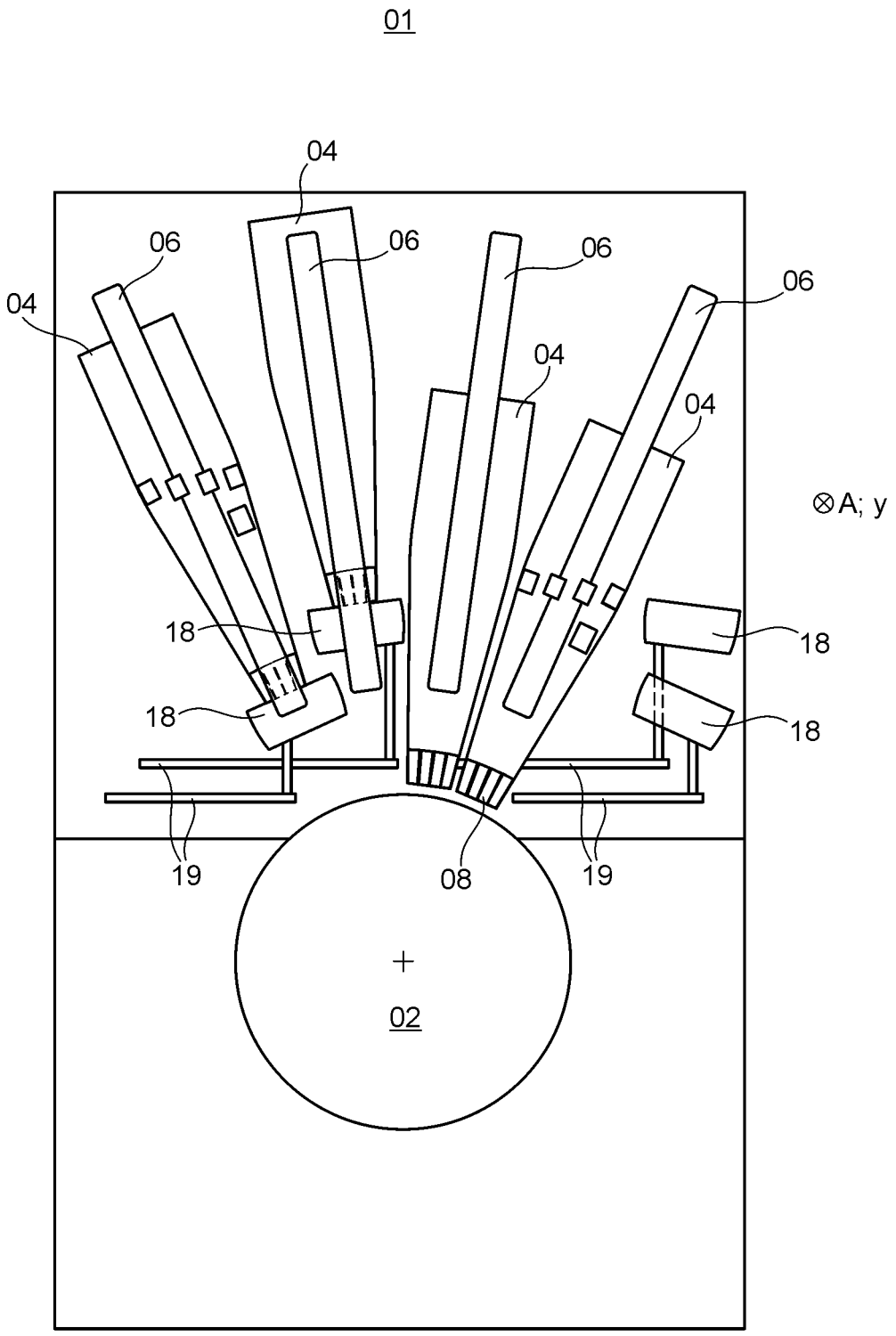
FIG. 4*b* shows a schematic illustration of a printing unit comprising multiple nozzle bars according to FIG. 4*a*, at least one nozzle bar being arranged in a first service position.
Figure 4C:
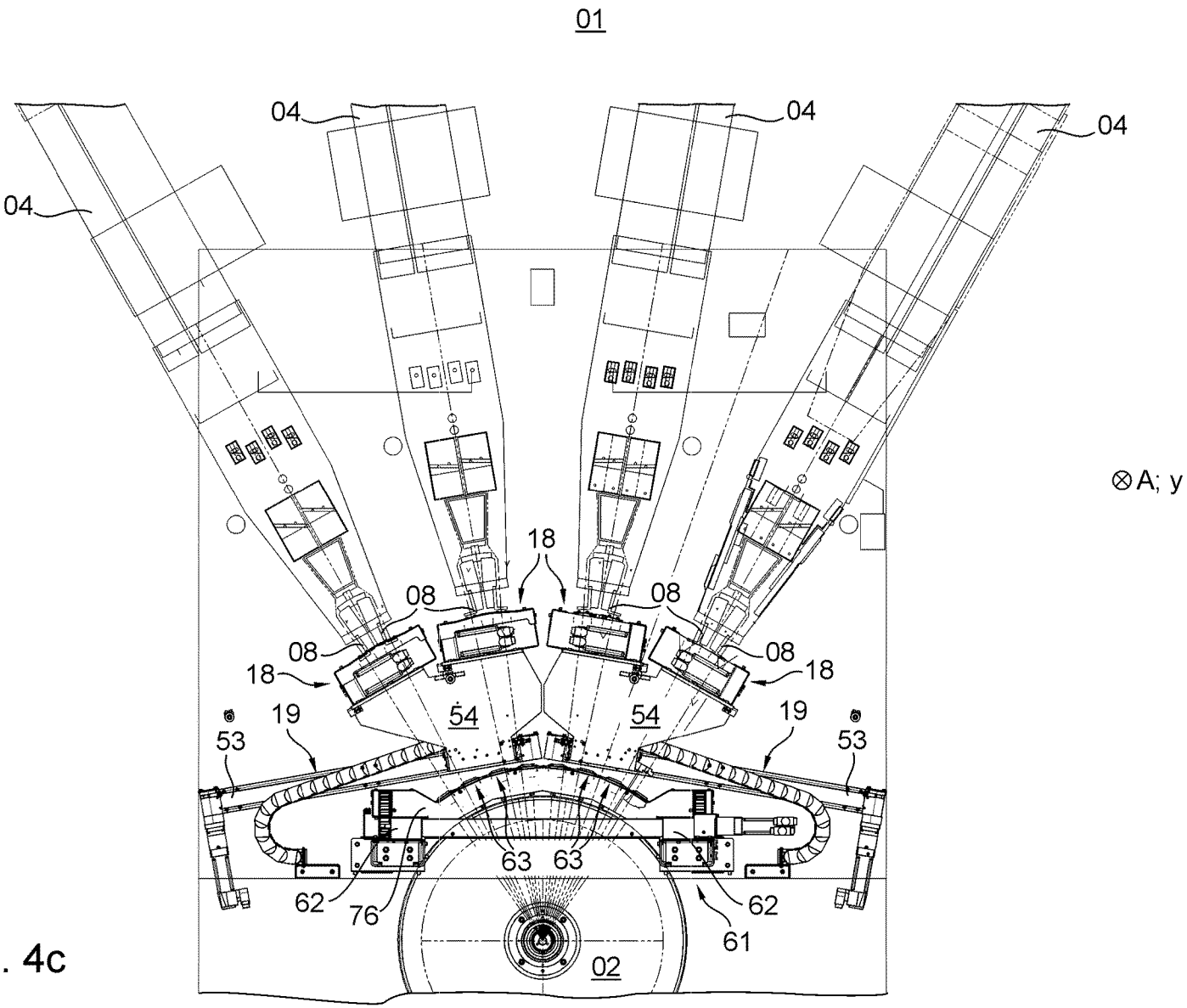
FIG. 4*c* shows an exemplary illustration of a printing unit comprising four nozzle bars arranged in the first service position and four cleaning devices arranged in a usage position.
Figure 4D:
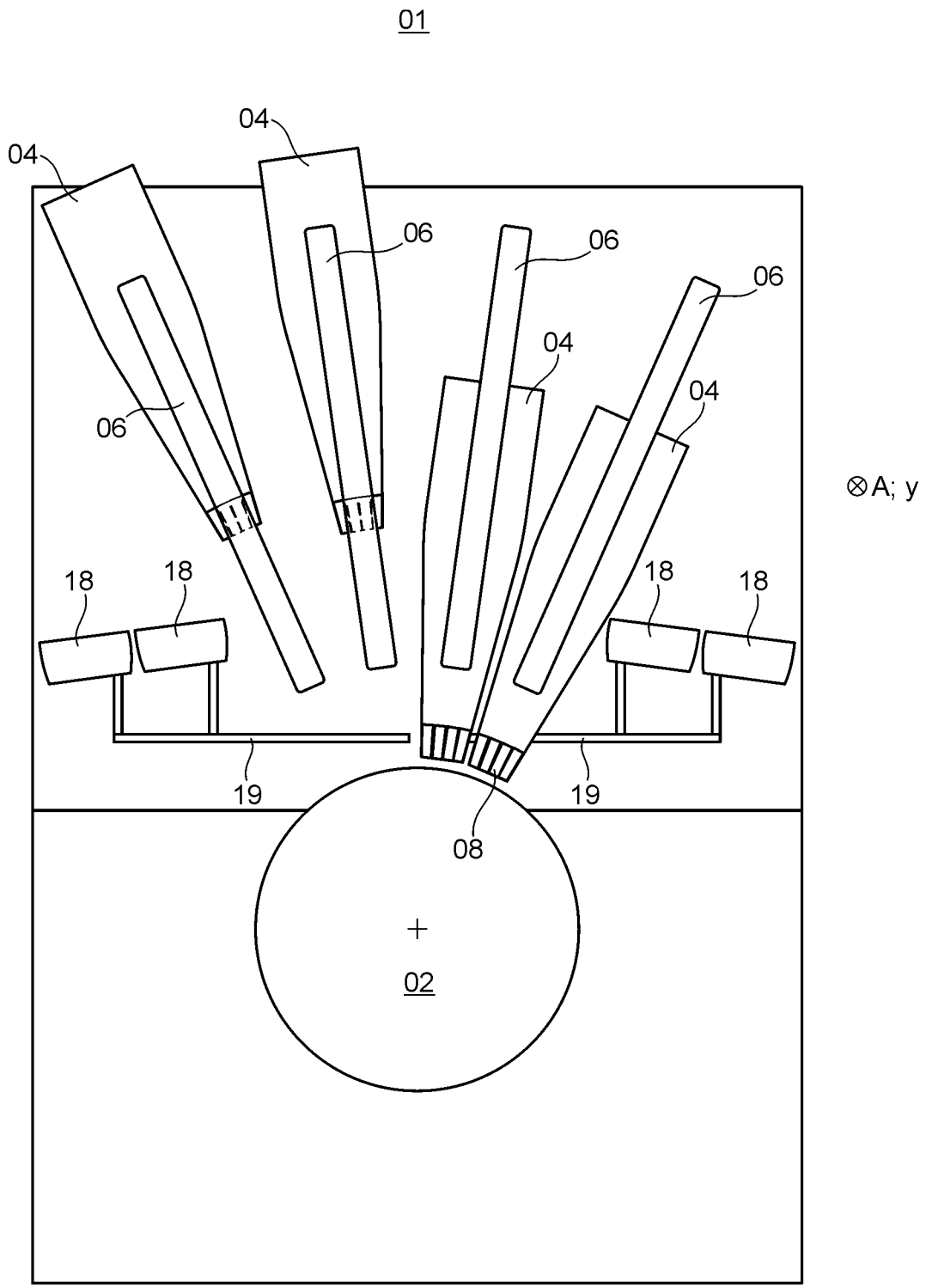
FIG. 4*d* shows a schematic illustration including two nozzle bars arranged in the printing position, and in each case two cleaning devices arranged on a shared guide system in a storage position.
Figure 4E:
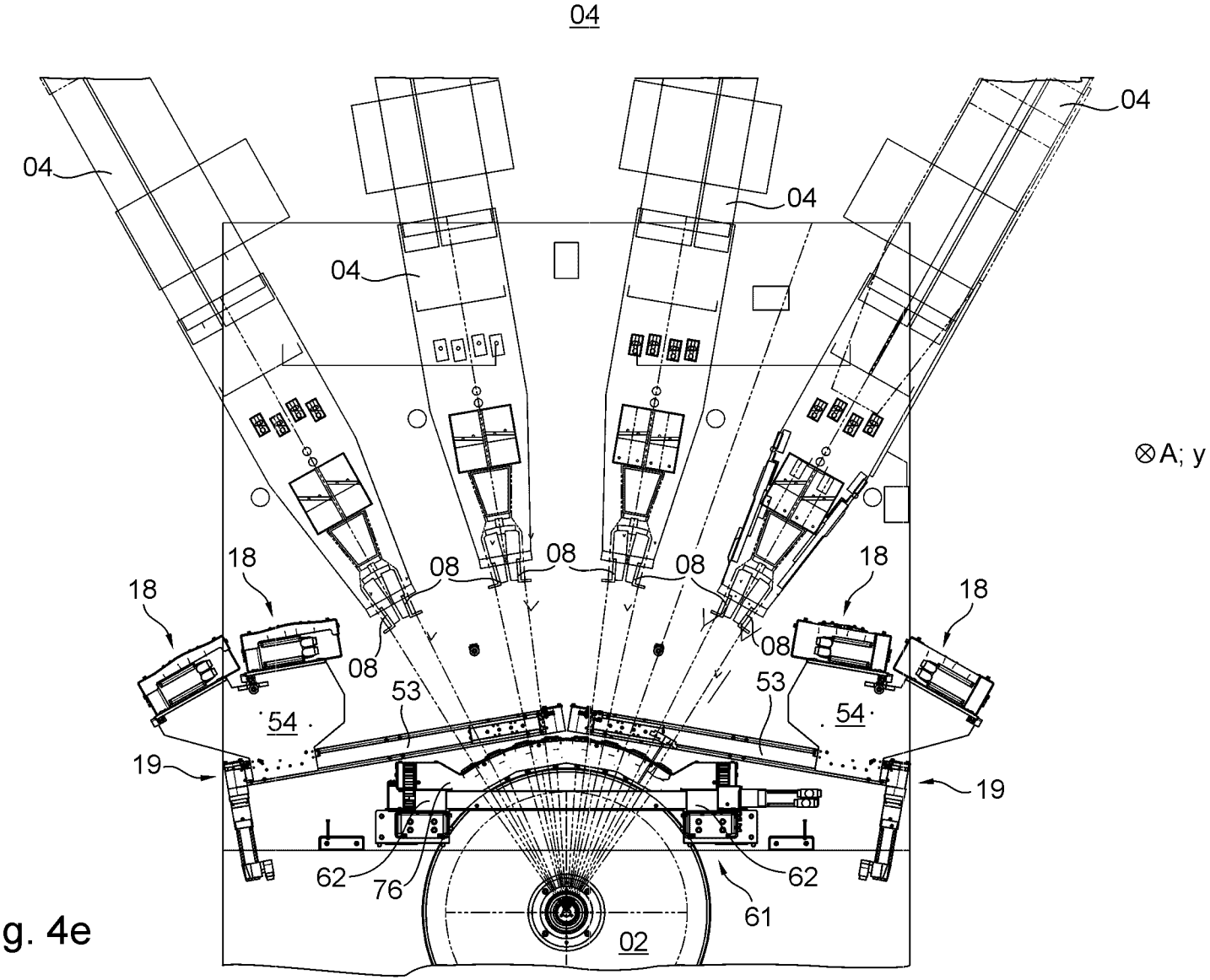
FIG. 4*e* shows an exemplary illustration of four nozzle bars arranged in the idle position and four cleaning devices and one cleaning system.
Figure 4F:
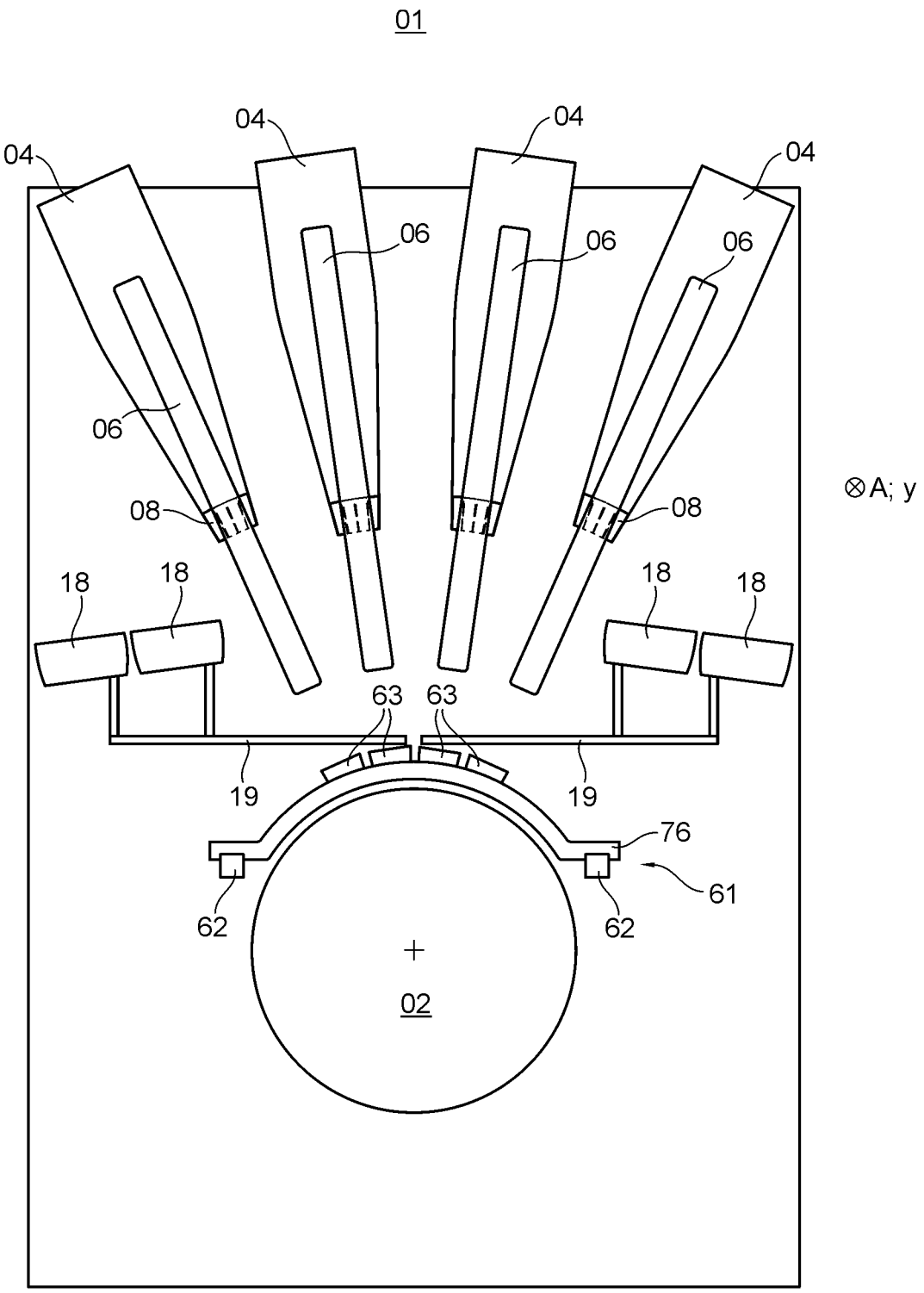
FIG. 4*f* shows a schematic illustration of four nozzle bars arranged in the idle position, and four cleaning devices arranged in the storage position, and one cleaning system comprising removal units arranged in an operating position.
Figure 4G:
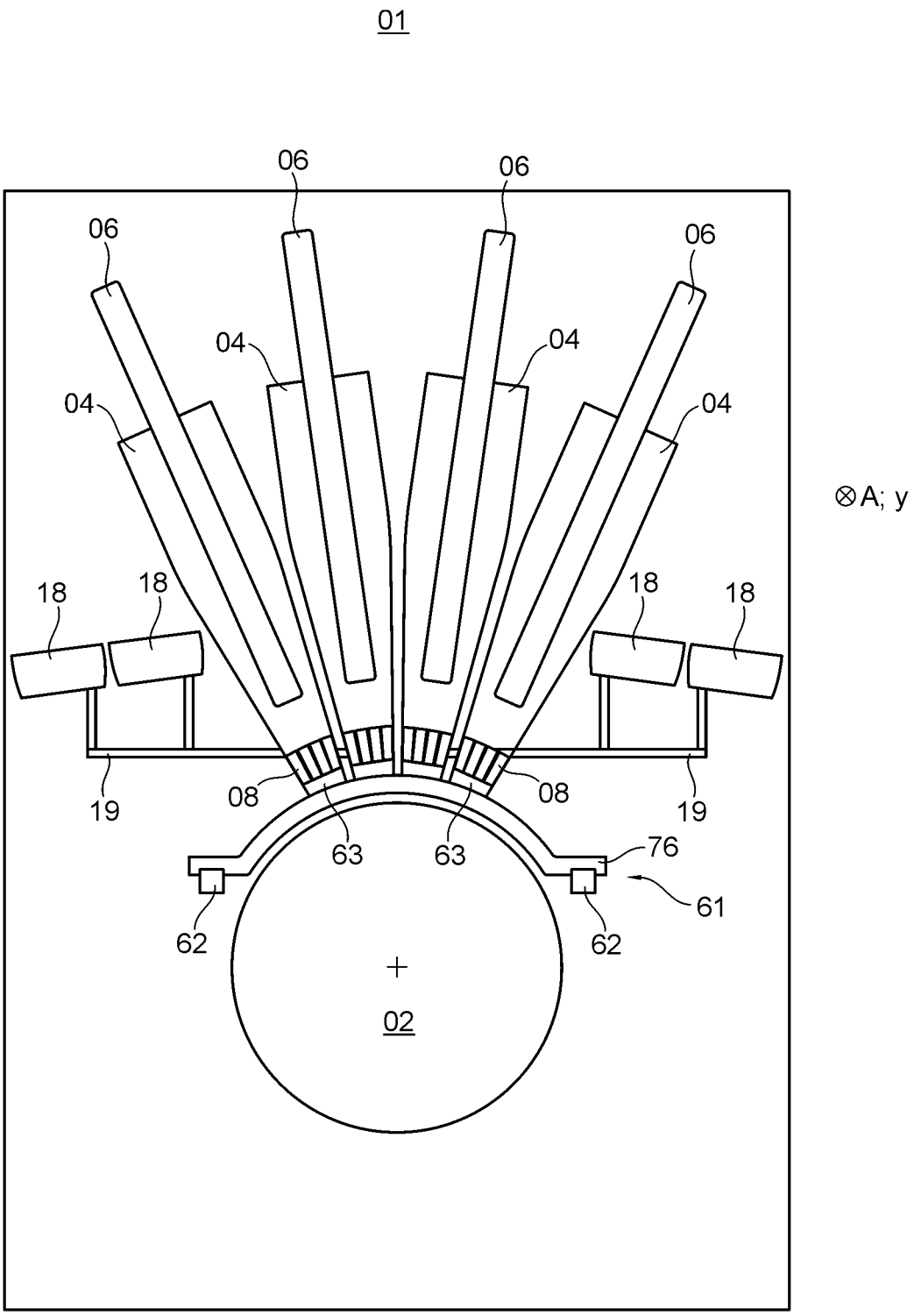
FIG. 4*g* shows a schematic illustration of four nozzle bars arranged in a second service position and four cleaning devices arranged in the storage position, and one cleaning system comprising removal units arranged in an operating position.
Figure 4H:
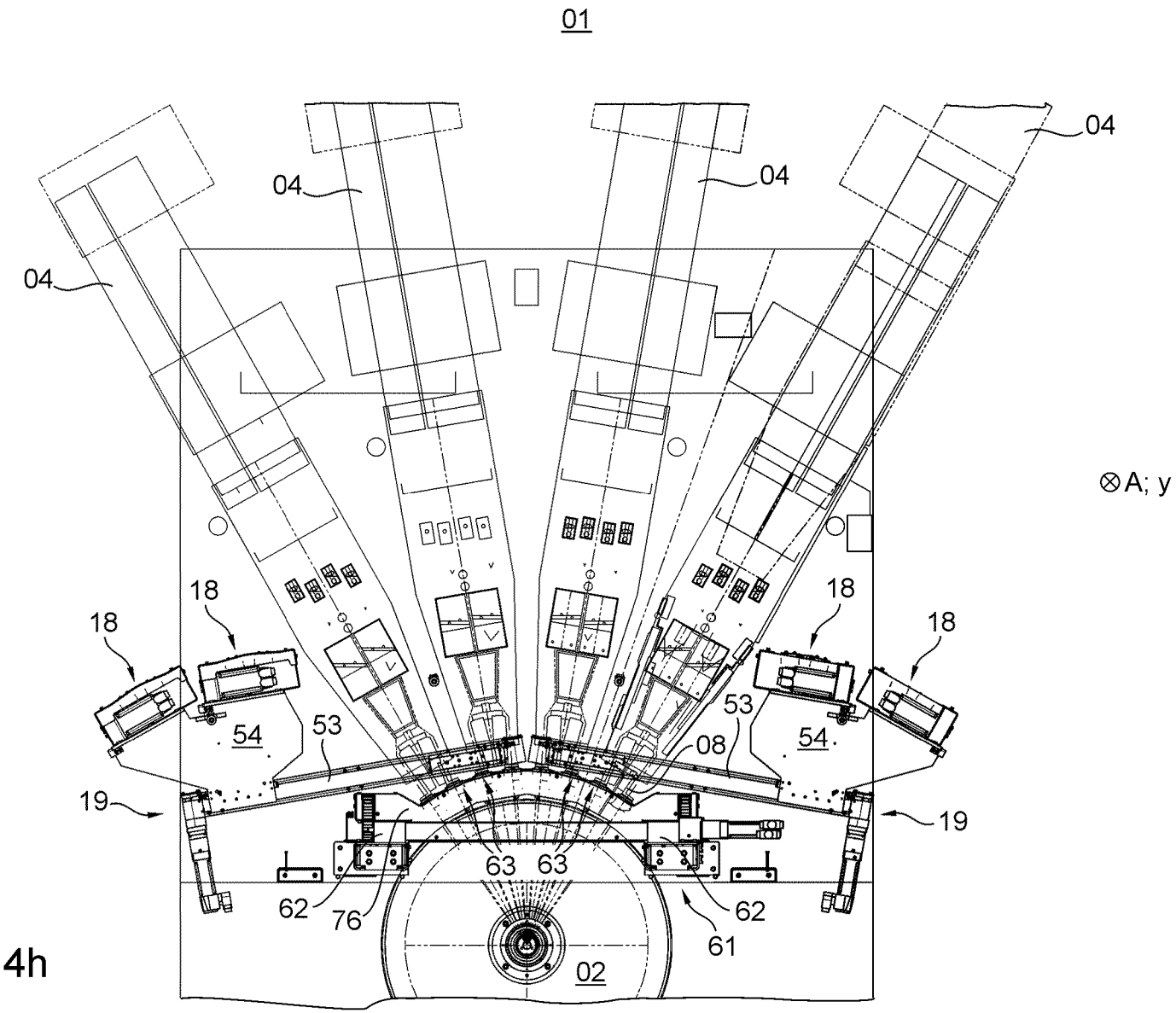
FIG. 4*h* shows an exemplary illustration of four nozzle bars arranged in a second service position, and four cleaning devices arranged in the storage position, and one cleaning system comprising removal units arranged in an operating position.

For example, a fluid, for example a gas and/or gas mixture, and/or a liquid, can be provided by the at least one source. For example, the at least one fluid, in particular compressed gas, flows through the cavity of the feed element 14 and preferably impinges on the delimiting element 16 through the recess 17 of the opening element 43. At the delimiting element 16, the fluid, for example the gas and/or the gas mixture and/or the liquid, is deflected in such a way, for example, that the fluid preferably exits the respective feed device 13 in the outlet direction L through the at least one outlet opening 17. The fluid, for example the gas and/or the gas mixture and/or the liquid, preferably has a pressure of at least 0.1 bar, in particular of at least 0.2 bar, and of no more than 0.7 bar, in particular of no more than 0.5 bar, when exiting the feed device 13. FIG. 3 indicates an exit of the fluid in the exit direction L by dotted lines by way of example.

The nozzle bar 04 comprises at least one positioning guide 06, which is preferably arranged so as to be movable, in particular linearly movable. The at least one nozzle bar 04 has the at least one printing position and at least one service position. The respective nozzle bar 04 is, in particular the respective print heads 08 of the nozzle bar 04 are, preferably selectively to be arranged and/or can be arranged and/or is arranged in the at least one printing position and/or at least one idle position and/or at least one service position by the respective positioning guide 06. The at least one nozzle bar 04 is selectively arranged in the printing position or in the at least one service position. The positioning guide 06 is preferably configured as a linear guide. For example, the at least one nozzle bar 04 in each case comprises at least one positioning guide 06 in the transverse direction A upstream and downstream from the nozzle bar 04. The nozzle bar 04 is preferably configured to move and/or to be movable, by way of a movement in a direction which has a greater or maximal component in the vertical direction or the z direction and a smaller or minimal component in the horizontal direction, from the printing position into the idle position or into the at least one service position, and/or from the idle position into the printing position or into the at least one service position, and/or from the at least one service position into the printing position or into the idle position. Preferably, the at least one nozzle bar 04 is, preferably at least two nozzle bars 04 of the printing unit 01, more preferably at least four nozzle bars 04 of the printing unit 01, are moved and/or configured to move, for example simultaneously, by way of the movement in a direction which has a greater or maximal component in the vertical direction or the z direction and a smaller or minimal component in the horizontal direction, from the printing position into the idle position or into the at least one service position, and/or from the idle position into the printing position or into the at least one service position, and/or from the at least one service position into the printing position or into the idle position. The at least one service position is, preferably all service positions are arranged in the vertical direction, preferably in the z direction, above the printing position. The at least one nozzle bar 04 is preferably moved from the printing position into the at least one service position, preferably into all service positions, by way of a movement in the vertical direction and/or in the z direction and/or in the upward direction. The at least one nozzle bar 04 is preferably moved from the printing position into the at least one service position, preferably into all service positions, by way of a movement in the vertical direction, preferably in the z direction, more preferably in the upward direction. The at least one nozzle bar 04, preferably the at least one nozzle bar 04 of the at least four nozzle bars 04, is arranged in the at least one service position, preferably in all service positions, in the vertical direction and/or in the z direction above the printing position. The at least one service position is, preferably all service positions are arranged above a plane of the transport path, preferably at the position of the transport path which has the shortest distance with respect to the at least one nozzle bar 04. Preferably, the at least one nozzle bar 04 is moved with a largest component of its movement direction in the z direction, preferably in the vertical direction. Preferably, the at least one service position has, preferably all service positions have, a distance of greater than zero with respect to the printing position, preferably in the z direction. The at least one nozzle bar 04, preferably the at least one nozzle bar 04 of the at least four nozzle bars 04, is selectively arranged in the printing position or in the at least one service position. Preferably, the at least one nozzle bar 04 is moved in a direction having a larger vertical component and a smaller horizontal component from the printing position into the at least one service position and/or from the at least one service position into the printing position.

The at least one nozzle bar 04, preferably the at least one nozzle bar 04 of the at least four nozzle bars 04, preferably has the at least one idle position. The idle position is preferably a position in which the at least one print head 08 can be removed from the printing press and/or the at least one printing unit 01 and/or the at least one nozzle bar 04 and/or inserted into the printing press and/or the at least one printing unit 01 and/or the at least one nozzle bar 04. Preferably, at least one print head 08 of the at least one nozzle bar 04 arranged in the idle position can be removed from the at least one printing unit 01. In particular, an operator preferably has more space available in the idle position to reach the at least one print head 08, while in the at least one service position preferably only sufficient space is available to be able to carry out internal, in particular automatic processes within the printing press, for example a cleaning operation of at least one exit surface 09 of at least one print head 08. Preferably, a distance between the at least one print head 08 of the nozzle bar 04 arranged in the at least one idle position and the transport path of printing substrate 03 is greater than in the printing position and in the at least one service position, preferably all service positions. The idle position is preferably arranged in the vertical direction, preferably in the z direction, above the printing position.

The at least one service position is preferably a position in which the at least one print head 08 of the relevant nozzle bar 04 can be and/or is serviced, for example cleaned and/or aligned, preferably without removing the corresponding print head 08 from the nozzle bar 04 and/or the printing unit 01 and/or the printing press. The respective service position of a nozzle bar 04, in particular of the relevant print heads 08, is preferably characterized in that different nozzle bars 04 arranged in their respective service positions have different distances with respect to one another than in their respective printing positions and/or in their respective idle positions. Preferably, the distance between the at least one print head 08, more preferably the respective exit surface 09 of a print head 08 arranged in a service position, and the intended transport path for at least one printing substrate 03 and/or the at least one printing substrate 03 and/or the printing substrate guide element 02 assigned to the respective nozzle bar 04 is greater than in the corresponding printing position. Preferably, the distance between the at least one print head 08 of the at least one nozzle bar 04 arranged in the at least one service position and the transport path of the printing substrate 03 is greater than in the printing position.

The at least one nozzle bar 04 of the at least four nozzle bars 04 has the at least one printing position and at least one service position. The at least one nozzle bar 04 has at least one service position. The at least one nozzle bar 04 has at least two, more preferably at least three, service positions. The at least one service position is configured as a first service position. At least one second service position is configured as the second service position. At least one third service position is preferably configured as the third service position. The at least two service positions, in particular the first service position and the second service position, are different positions of the at least one nozzle bar 04. A first service position of the at least one nozzle bar 04 is preferably configured as a cleaning position. A second service position of the at least one nozzle bar 04 is preferably configured as an intensive cleaning position. A third service position of the at least one nozzle bar 04 is preferably configured as a depot position. For example, the cleaning position is identical to the intensive cleaning position of the nozzle bar 04. In an exemplary, alternative embodiment, the cleaning position of the nozzle bar 04 differs from its intensive cleaning position.

In the first service position, this being the cleaning position, the at least one nozzle bar 04 enters into a functional connection with at least one cleaning device 18. The at least one nozzle bar 04 is arranged in the at least one first service position when contact with the at least one cleaning device 18 occurs. The first service position, this being the cleaning position, corresponds to a positioning of the nozzle bar 04 during a contactless cleaning operation of the at least one exit surface 09 of the at least one print head 08 of the relevant nozzle bar 04. The first service position corresponds to a positioning of the at least one nozzle bar 04 during a contactless cleaning operation of the at least one exit surface 09 of the at least one print head 08 of the at least one nozzle bar 04, preferably a cleaning operation by means of the at least one cleaning device 18. The first service position corresponds to a positioning of the at least one nozzle bar 04 during a contactless cleaning operation of the at least one exit surface 09 of the at least one print head 08, preferably of the at least two print heads 08, more preferably of the at least one row of print heads 08, of the at least one nozzle bar 04. The at least one nozzle bar 04 is positioned in the first service position during the contactless cleaning operation of the at least one print head 08, preferably of the at least one exit surface 09 of the at least one print head 08, of the at least one nozzle bar 04. The contact of the at least one print head 08 with the at least one cleaning device 18 preferably corresponds to an indirect contact. In addition or as an alternative, the contact of the at least one print head 08 with the at least one cleaning device 18 corresponds to a contactless cleaning operation of the at least one exit surface 09 of the at least one print head 08.

The at least one nozzle bar 04 enters into a functional connection with at least one cleaning system 61, preferably with at least one contact element 64 of the at least one cleaning system 61, in the second service position, this being the intensive cleaning position. The at least one nozzle bar 04 is arranged in the at least one second service position when contact with the at least one cleaning system 61 occurs. The second service position, this being the intensive cleaning position, preferably corresponds to a positioning of the nozzle bar 04 while at least one of the print heads 08 of this nozzle bar 04 is in direct contact with the at least one contact element 64 of the at least one cleaning system 61. The distance between the at least one print head 08 of the at least one nozzle bar 04 arranged in the second service position and the transport path of printing substrate 03 is preferably greater than in the printing position. The at least one nozzle bar 04 is positioned in the second service position when contact with the at least one cleaning system 61 occurs.

In the third service position, the at least one nozzle bar 04 preferably establishes contact with at least one sealing element 56 and/or with the at least one cleaning device 18, for example preferably when the cleaning device 18 comprises the at least one sealing element 56. The third service position, this being the depot position, preferably corresponds to a positioning of the at least one nozzle bar 04 in indirect contact with the at least one sealing element 56. In the third service position, the at least one sealing element 56 is preferably arranged in direct contact with the at least one nozzle bar 04. Preferably, the at least one sealing element 56 is configured to at least partially seal the at least one exit surface 09 of the at least one print head 08 of the nozzle bar 04, preferably the at least two exit surfaces 09 of at least two print heads 08 arranged next to one another in the y direction and/or transverse direction A, more preferably at least four exit surfaces 09 of at least four print heads 08 arranged next to one another in the y direction and/or transverse direction A, more preferably of all print heads 08 arranged next to one another in the y direction and/or transverse direction A, preferably with respect to external influences, preferably when the nozzle bar 04 is in the depot position.

Above and below, a functional connection preferably describes that a first element is at least indirectly or directly connected to a second element and/or is configured to operate together with the second element. For example, a functional connection shall also be understood to mean that the first element is configured to operate as a function of the configuration and/or the arrangement and/or a movement and/or an operation of the second element.

A distance between the at least one print head 08 of the at least one nozzle bar 04 arranged in the at least one service position, preferably in all service positions, and a transport path of printing substrate 03 is preferably greater than in the printing position. In the first service position, this being the cleaning position, the at least one nozzle bar 04 has a first distance with respect to the transport path. In the second service position, this being the intensive cleaning position, the at least one nozzle bar 04 has a second distance with respect to the transport path, which preferably differs from the first distance. The distance of the second service position of the nozzle bar 04, in particular of the at least one exit surface 09 of the at least one print head 08 of the nozzle bar 04, with respect to the transport path is smaller than in the first service position. In the third service position, this being the depot position, the at least one nozzle bar 04 preferably has a third distance with respect to the transport path, which preferably differs from the first distance. For example, the third distance, this being the distance of the nozzle bar 04 arranged in the depot position, with respect to the transport path is smaller than the first distance, this being the distance of the nozzle bar 04 arranged in the cleaning position. The third distance of the at least one nozzle bar 04 in the third service position with respect to the transport path of printing substrate 03 is preferably a distance that differs from the first distance of the at least one nozzle bar 04 in the first service position. The third distance is preferably smaller than the first distance. The third distance between the at least one print head 08 of the nozzle bar 04 arranged in the at least one third service position and the transport path of printing substrate 03 is preferably greater than in the printing position.

The cleaning direction G is preferably a horizontal direction G in which a cleaning unit 26 and/or at least one cleaning element 31 and/or at least one removal unit 63, in particular each for carrying out a cleaning step, are arranged to be movable and/or are configured to move. The cleaning device 18 preferably comprises the at least one cleaning unit 26 and the at least one cleaning element 31. The cleaning system 61 comprises the at least one removal unit 63. The cleaning direction G preferably has at least one component that is situated parallel to the transverse direction A and/or parallel to the y direction, and is preferably oriented opposite the y direction. The cleaning direction G more preferably is situated parallel to the transverse direction A and/or parallel to the y direction, and is preferably oriented opposite the y direction. The cleaning direction G is preferably oriented orthogonally to at least the transport direction T that is intended for transporting at least one printing substrate 03 and/or orthogonally to the x direction. The cleaning direction G is preferably the direction in which an element cleaning the at least one print head 08 passes this at least one print head 08. The cleaning direction G preferably corresponds to a direction of the longest side of the at least one nozzle bar 04.

Preferably, the at least one cleaning unit 26, and more preferably at least one cleaning element 31, is arranged so as to be movable and/or to move in and/or counter to the cleaning direction G. Preferably, the at least one cleaning unit 26, and more preferably the at least one cleaning element 31, is arranged so as to be movable at least in the cleaning direction G during a cleaning process of the at least one exit surface 09 of the at least one print head 08. Preferably in addition or as an alternative, the at least one removal unit 63 is arranged so as to be movable and/or to move in and/or counter to the cleaning direction G, in particular during a cleaning process of the at least one exit surface 09 of the at least one print head 08.

The at least one printing unit 01 comprises the at least one cleaning device 18. The at least one cleaning device 18 comprises at least one cleaning element 31 including at least one fluid input 38 configured as a fluid supply opening 38. In addition or as an alternative, the at least one cleaning device 18 is configured to at least temporarily make indirect contact with the at least one print head 08, at least by way of at least one cleaning fluid ejected by the at least one fluid supply opening 38. In addition or as an alternative, the at least one cleaning device 18 is configured to make indirect contact with the at least one print head 08, that is, is configured to clean the same in a contactless manner, and/or makes indirect contact therewith, at least by way of at least one cleaning fluid ejected through the at least one fluid supply opening 38. The at least one cleaning device 18 preferably makes indirect contact with the at least one print head 08, at least by way of at least one cleaning fluid ejected through the at least one fluid supply opening 38. The indirect contact of the at least one cleaning device 18 with the at least one print head 08 and/or with the at least one nozzle bar 04 thus describes that the at least one cleaning device 18, preferably the at least one cleaning element 31, at least for the duration of the cleaning operation, and preferably permanently, has a distance of greater than zero with respect to the at least one exit surface 09. The at least one cleaning device 18, preferably the at least one cleaning element 31, is configured to clean the at least one print head 08 of the at least one nozzle bar 04, preferably at least the at least one exit surface 09, in a contactless manner in indirect contact. The at least one cleaning device 18 is configured to clean the at least one print head 08, preferably the at least one exit surface 09 of the at least one print head 08, more preferably at least two exit surfaces 09 of at least two print heads 08, more preferably at least the exit surfaces 09 of all print heads 08 of a row, in a contactless manner. The printing unit 01 preferably comprises at least four cleaning devices 18. Preferably, a cleaning device 18 is in each case configured to clean and/or cleans a respective nozzle bar 04, preferably of the at least four nozzle bars 04.

The at least one cleaning device 18 comprises at least one guide system 19. The at least one guide system 19 comprises at least one guide element 53. The at least one cleaning device 18 is configured to move and/or to be movable and/or is moved along the at least one guide element 53, and preferably is in particular displaced in a rectilinear manner. The at least one cleaning device 18 is preferably arranged so as to be movable and/or to move, preferably in a linear manner, by way of the at least one guide system 19, preferably by means of at least one cleaning drive 21.

The at least one guide element 53 of the at least one guide system 19 is preferably configured as a bar and/or a rod and/or a rail and/or a linear guide. Preferably, at least one guide element 53 of the at least one guide system 19 is in each case arranged upstream, and at least one guide element 53 of the at least one guide system 19 is in each case arranged downstream, from the at least one nozzle bar 04, in the transverse direction A and/or in the y direction. For example, at least one guide element 53 of the at least one guide system 19 is in each case arranged at a housing of the at least one printing unit 01 upstream and downstream from the at least one nozzle bar 04, in the transverse direction A.

The at least one guide element 53 of the at least one guide system 19 preferably has its longitudinal direction along its longest extension. The longitudinal direction of the at least one guide element 53 is preferably arranged in the plane spanned by the x direction and the z direction. For example, the longitudinal direction of the at least one guide element 53 is arranged in a plane whose normal vector corresponds to the transverse direction A and/or the y direction. The longitudinal direction of the at least one guide element 53 preferably has at least one first component in the x direction, preferably a horizontal component, and at least one second component in the z direction, preferably a vertical component. The component of the longitudinal direction in the x direction is preferably greater than the component of the longitudinal direction in the z direction. Preferably, the longitudinal direction of the at least one guide element 53 of the at least one guide system 19 thus preferably has a larger horizontal component than its vertical component.

The at least one guide element 53 preferably has at least one guide path. The guide path is preferably configured for guiding the at least one cleaning device 18. The at least one cleaning device 18 is preferably moved along the guide path of the at least one guide element 53. The guide path along the at least one guide element 53 is preferably parallel to the longitudinal direction of the at least one guide element 53.

The guide path along the at least one guide element 53 is preferably arranged in a plane whose normal vector corresponds to the transverse direction A and/or the y direction. The guide path along the at least one guide element 53 within the plane preferably has a larger horizontal component than its vertical component. The at least one cleaning device 18 is preferably moved along the at least one guide element 53 along the guide path in a plane having a larger horizontal component than a vertical component.

The at least one guide system 19 preferably comprises at least one crossbar 54, which is preferably configured as an attachment 54. The crossbar 54 is preferably configured as a mechanical carrier. Preferably, the at least one cleaning device 18 is, preferably positively, connected to the at least one crossbar 54. The at least one cleaning device 18 and the at least one crossbar 54 are preferably configured to move and/or be movable jointly along the at least one guide element 53 of the at least one guide system 19, and in particular so as to be displaced in a linear or rectilinear manner. The at least one cleaning device 18 is preferably connected to the at least one guide element 53 of the at least one guide system 19 via the at least one crossbar 54 of the at least one guide system 19, the crossbar preferably configured as an attachment 54. The at least one cleaning device 18 is preferably in each case connected to the at least one guide element 53 via at least one first crossbar 54 in the transverse direction A and/or in the y direction, upstream from the at least one nozzle bar 04, and via at least one second crossbar 54 in the transverse direction A and/or in the y direction, downstream from the at least one nozzle bar 04. Preferably, at least one guide element 53 is arranged in the transverse direction A upstream from, and at least one guide element 53 is arranged in the transverse direction A downstream from, the at least one nozzle bar 04.

Preferably, the at least one cleaning device 18 has a distance with respect to the at least one guide element 53 of the at least one guide system 19 which is preferably constant and/or which is established and/or is being established by the at least one crossbar 54 of the at least one guide system 19. Preferably, the at least one first service position, this being the cleaning position, and/or the at least one third service position, which is the depot position, of the at least one nozzle bar 04 are established and/or matched to the constant distance by way of the preferably constant distance between the at least one cleaning device 18 and the at least one guide element 53.

The at least one printing unit 01 preferably comprises at least two, more preferably at least four, cleaning devices 18. At least two nozzle bars 04, preferably at least two nozzle bars 04 of the at least four nozzle bars 04, are preferably configured to make contact, and/or make contact, with at least one respective cleaning device 18, preferably with at least one respective cleaning device 18 of the at least two cleaning devices 18. A printing unit 01 preferably comprises at least one cleaning device 18 per nozzle bar 04. At least two cleaning devices 18 preferably comprise at least one shared guide system 19. In particular, at least two cleaning devices 18 are preferably connected to the at least one, preferably shared, guide system 19 and/or are configured to be movable and/or to move and/or are moved by the at least one preferably shared guide system 19. The at least two cleaning devices 18 preferably comprise at least one shared guide element 53, in particular a guide element 53 configured as a rail. For the at least two cleaning devices 18, the at least one shared guide system 19 preferably comprises the at least one shared guide element 53, preferably at least one shared guide element 53, in the transverse direction A upstream and/or at least one shared guide element 53 in the transverse direction A downstream from the at least one nozzle bar 04. The at least two cleaning devices 18 are preferably connected to the at least one crossbar 54 and/or the at least two cleaning devices 18 and the at least one crossbar 54 are configured to move and/or be movable jointly along the at least one guide element 53 of the at least one guide system 19, and in particular so as to be displaced in a linear manner. The at least two cleaning devices 18 are preferably jointly connected to the at least one guide system 19 and/or are configured to be movable and/or to move and/or are moved jointly by the at least one guide system 19 from the at least one usage position into the at least one storage position, or vice versa. The at least two cleaning devices 18 are preferably jointly connected to the at least one guide system 19 and/or the at least two cleaning devices 18 preferably simultaneously have the at least one storage position or the at least one usage position.

The at least two cleaning devices 18 preferably comprise at least two shared guide systems 19. At least one of the at least two guide systems 19 is preferably in each case arranged upstream from the at least one nozzle bar 04 in the transverse direction A and/or in the y direction, and/or at least one of the at least two guide systems 19 is preferably in each case arranged downstream from the at least one nozzle bar 04 in the transverse direction A and/or in the y direction.

The at least two cleaning devices 18 preferably have an angle of inclination with respect to the z direction which corresponds to an inclination with respect to the z direction of the nozzle bar 04 and/or of the at least one print head 08 of the nozzle bar 04. The inclination preferably in each case corresponds to the inclination of the assigned nozzle bar 04 and/or its print head 08. Preferably, the at least two cleaning devices 18, which comprise the at least one shared guide element 53, preferably have an angle of inclination with respect to the z direction which corresponds to an inclination with respect to the z direction of the nozzle bar 04 and/or of the at least one print head 08 of the nozzle bar 04. For example, the at least two cleaning devices 18, which comprise the at least one shared guide element 53, have differing angles of inclination with respect to the z direction. For example, the inclination of the at least two cleaning devices 18 with respect to one another has an angle of at least 1° (one degree), preferably of at least 3° (three degrees), more preferably of 4° (four degrees). The angle of inclination with respect to the z direction of the respective cleaning device 18 preferably corresponds to an inclination with respect to the z direction of the nozzle bar 04 and/or of the print heads 08, this cleaning device 18 being assigned to the nozzle bar 04 or the print heads 08.

The at least one cleaning device 18 has at least one storage position and at least one usage position. The at least one cleaning device 18 has the at least one storage position.

The at least one storage position of the at least one cleaning device 18 is a position in which the at least one cleaning device 18 is arranged outside the area between the at least one nozzle bar 04 and the transport path of the at least one printing substrate 03, for example established by the at least one printing substrate guide element 02 situated opposite the nozzle bar 04. The at least one storage position is arranged outside the area between the at least one nozzle bar 04 and the transport path of the at least one printing substrate 03. In particular, the storage position of the at least one cleaning device 18 corresponds to a safekeeping position when the printing press is in an operating mode in which the at least one cleaning device 18 is not employed.

In the at least one storage position, the at least one cleaning device 18 is arranged along the x direction upstream or downstream from the at least one nozzle bar 04. In its storage position, the at least one cleaning device 18 is preferably arranged and/or is being arranged in a circumferential direction of the at least one printing substrate guide element 02 that is situated opposite and/or assigned to the at least one nozzle bar 04, and/or along the transport path of printing substrate 03 upstream or downstream from the at least one nozzle bar 04. In the at least one storage position, the at least one cleaning device 18 is preferably arranged and/or is being arranged along the transport direction T of printing substrate 03 upstream or downstream from the at least one nozzle bar 04, wherein the transport direction T is determined and/or is being determined at the position of the transport path of printing substrate 03 beneath the at least one nozzle bar 04. In the at least one storage position, the at least one cleaning device 18 is preferably arranged and/or is being arranged along the transport direction T of printing substrate 03 upstream or downstream from an area between the at least one nozzle bar 04 and the transport path of printing substrate 03, wherein the transport direction T is determined and/or is being determined at the position of the transport path of printing substrate 03 beneath the at least one nozzle bar 04. The storage position preferably corresponds to a position along the at least one guide element 53 of the at least one guide system 19, in particular along its longitudinal direction, outside the area between the at least one nozzle bar 04 and the transport path of the printing substrate 03. The arrangement upstream or downstream from the at least one nozzle bar 04 preferably corresponds to an arrangement upstream or downstream from the area that is a spatial area and that is established by outside edges of the at least one nozzle bar 04 that preferably extend in the z direction, that is, preferably vertically, wherein the outside edges are projected up to the transport path. The outside edges preferably correspond to the outwardly directed sides of a housing of the at least one nozzle bar 04, which are preferably perpendicularly situated on the plane of the x direction with the y direction. In the storage position, the at least one cleaning device 18 is preferably arranged spaced apart from the outside edges of the at least one nozzle bar 04 at a distance of greater than zero in the x direction. Preferably, the at least one fluid supply opening 38 of the at least one cleaning element 31 of the at least one cleaning device 18 arranged in the storage position, preferably at least one centroid of a delimitation of the fluid supply opening 38, has a preferably first preferably relative distance and/or is arranged at the relative distance, preferably a distance in the x direction and/or in the transport direction T, with respect to the at least one opening of the at least one exit surface 09 of the at least one print head 08. Preferably, the preferably relative distance of the at least one fluid supply opening 38 of the at least one cleaning element 31 of the at least one cleaning device 18 arranged in the storage position, preferably of the centroid of the delimitation of the fluid supply opening 38, with respect to the at least one opening of the at least one exit surface 09 of the at least one print head 08 is at least twice, preferably at least two point five times, more preferably at least three times, more preferably at least five times, as large as an extension of the at least one cleaning device 18 in the transport direction T. Preferably, the transport direction T is determined at the position of the transport path having the shortest distances with respect to the at least one exit surface 09 of the at least one print head 08 of the at least one nozzle bar 04 to be cleaned by the at least one cleaning device 18. The relative distance in the storage position is preferably at least so large that contact between the at least one nozzle bar 04, when arranged in the printing position, and the at least one cleaning device 18 is avoided. The arrangement of the storage position preferably enables a compact configuration of the at least one printing unit 01. The at least one cleaning device 18 is preferably easy to handle. Preferably, the at least one cleaning device 18 is serviced and/or the at least one cleaning device 18 is removed in the storage position.

The at least one cleaning device 18 has the at least one usage position. The at least one usage position of the at least one cleaning device 18 is preferably a position in which the at least one cleaning device 18 is arranged within the area between the at least one nozzle bar 04 and the transport path of the at least one printing substrate 03, for example established by the at least one printing substrate guide element 02 situated opposite the nozzle bar 04. The at least one usage position is preferably arranged within the area between the at least one nozzle bar 04 and the transport path of the at least one printing substrate 03. In the at least one usage position, the at least one cleaning device 18 is preferably arranged within the area between the at least one nozzle bar 04 and the transport path of printing substrate 03.

In particular, the usage position of the at least one cleaning device 18 corresponds to a position when the printing press is in an operating mode in which the at least one cleaning device 18 is employed. The usage position of the at least one cleaning device 18 preferably corresponds to a position in which the cleaning device 18 is in direct or indirect contact with at least one print head 08, which is in particular to be cleaned, of the relevant nozzle bar 04, and/or preferably to a position in which the cleaning device 18 is arranged to clean the at least one print head 08 of the relevant nozzle bar 04. In the usage position, the at least one cleaning device 18 is preferably at least partially arranged in the area between the at least one nozzle bar 04 and the transport path, in particular between the shortest connection between the at least one nozzle bar 04 and the transport path, wherein the transport path, for example, is established by the at least one printing substrate guide element 02 assigned to the nozzle bar 04. Preferably, the at least one fluid supply opening 38 of the at least one cleaning element 31 of the at least one cleaning device 18 arranged in the usage position, preferably of the centroid of the delimitation of the fluid supply opening 38, has a preferably second preferably relative distance and/or is arranged at the relative distance, preferably a distance in the x direction and/or in the transport direction T, with respect to the at least one opening of the at least one exit surface 09 of the at least one print head 08. Preferably, the preferably relative distance of the at least one fluid supply opening 38 of the at least one cleaning element 31 of the at least one cleaning device 18, preferably of the centroid of the delimitation of the fluid supply opening 38, with respect to the at least one opening of the at least one exit surface 09 of the at least one print head 08 is greater in the storage position than in the usage position. Preferably, the preferably relative distance of the at least one fluid supply opening 38 of the at least one cleaning element 31 of the at least one cleaning device 18 arranged in the usage position, preferably of the centroid of the delimitation of the fluid supply opening 38, with respect to the at least one opening of the at least one exit surface 09 of the at least one print head 08 is no more than one time, preferably no more than zero point five times, as large as the extension of the at least one cleaning device 18 in the transport direction T. Preferably, the transport direction T is determined at the position of the transport path having the shortest distance with respect to the at least one exit surface 09 of the at least one print head 08 of the at least one nozzle bar 04 to be cleaned by the at least one cleaning device 18.

In the at least one usage position, the at least one cleaning device 18 is preferably arranged within the area between the at least one nozzle bar 04 and the transport path of the at least one printing substrate 03. In addition or as an alternative, in the at least one storage position, the at least one cleaning device 18 is arranged along the x direction upstream or downstream from the at least one nozzle bar 04.

Preferably, the configuration of the storage position and/or the configuration of the usage position increase the compact design of the printing press. Preferably, lateral displacement, for example in the y direction, of the at least one nozzle bar out of the printing position into the at least one service position is superfluous.

Above and below, the area between the at least one nozzle bar 04 and the transport path of the printing substrate 03 preferably describes the spatial area that has the shortest distance between the nozzle bar 04, in particular the at least one print head 08 of the nozzle bar 04, and the transport path. Above and below, the area between the at least one nozzle bar 04 and the transport path of printing substrate 03 is preferably the spatial area that has the shortest distance between the nozzle bar 04, in particular the at least one print head 08 of the nozzle bar 04, more preferably the at least one exit surface 09 of the at least one print head 08 of the nozzle bar 04, and the transport path. The shortest distance of the area between the at least one nozzle bar 04 and the transport path of the printing substrate 03 is preferably directed in the z direction, preferably vertically. The spatial area, that is, preferably the area between the at least one nozzle bar 04 and the transport path of printing substrate 03, is preferably delimited by outside edges of the at least one nozzle bar 04 which preferably extend in the z direction, that is, preferably vertically, wherein the outside edges are projected up to the transport path. The outside edges preferably correspond to the outwardly directed sides of a housing of the at least one nozzle bar 04, which are preferably perpendicularly situated on the plane of the x direction with the y direction. Preferably, the at least one nozzle bar 04 is delimited in the transport direction T of printing substrate 03, preferably in the leading and trailing directions, by a respective delimiting plane, preferably by a respective delimiting plane of at least two delimiting planes, wherein the transport direction T is preferably determined at the point of the transport path having the shortest distance with respect to the at least one exit surface 09 of the at least one print head 08 of the at least one nozzle bar 04. The at least one delimiting plane is, preferably at least two delimiting planes are, preferably situated perpendicularly on a plane, wherein the at least one exit surface 09 is arranged in the plane. The at least two delimiting planes are preferably situated perpendicularly on the plane that includes the at least one exit surface 09, preferably the at least one exit surface 09 of the at least one print head 08 of the at least one nozzle bar 04 of the at least four nozzle bars 04. A delimiting plane of the at least two delimiting planes preferably delimits the at least one nozzle bar 04 in the transport direction T in a leading direction, and a delimiting plane of the at least two delimiting planes preferably delimits the at least one nozzle bar 04 in the transport direction T in a trailing direction. The area between the at least one nozzle bar 04 and the transport path of printing substrate 03 preferably describes a spatial area within the at least two delimiting planes. Preferably, the at least one cleaning device 18 or the at least one cleaning system 61, within the area between the at least one nozzle bar 04 and the transport path of printing substrate 03, is configured to enter into a functional connection with the at least one nozzle bar 04, for example configured so as to clean the same. An element that is arranged within the area between the at least one nozzle bar 04 and the transport path of printing substrate 03 preferably enters into a functional connection with the at least one nozzle bar 04.

For example, a cleaning device 18, which is positioned in the usage position by way of the at least one guide system 19, is assigned to the at least one print head 08 of a nozzle bar 04 that is arranged in the first service position, this being the cleaning position. Preferably, the at least one cleaning device 18 is configured to be movable and/or to move, in particular as a whole, at least orthogonally to the transverse direction A, preferably by way of the at least one guide system 19. Preferably, in the at least one first service position of the at least one nozzle bar 04, at least one cleaning device 18 that is arranged in the usage position is assigned to and/or can be assigned to and/or is situated opposite at least one respective exit surface 09 of at least one print head 08, in particular a respective exit surface 09 of at least two, preferably at least three, and more preferably of at least four, print heads 08.

The at least one cleaning device 18 is configured to be transferrable and/or to move from the storage position into the usage position, or vice versa, by the at least one guide system 19 along the at least one guide element 53. The at least one cleaning device 18 is preferably configured to be displaced, preferably in a rectilinear or linear manner, along the at least one guide element 53. The at least one cleaning device 18 is configured to move and/or be movable and/or is moved along the at least one guide element 53 of the at least one guide system 19 from the at least one storage position into the at least one usage position, or vice versa. The at least one storage position and the at least one usage position are arranged along the at least one guide element 53. The at least one storage position and the at least one usage position are preferably spaced apart from one another at a distance of greater than zero.

In the first or the third service position, this being the cleaning position or the depot position, of the at least one nozzle bar 04, the cleaning device 18 that is assigned to and/or arranged opposite the corresponding nozzle bar 04 is preferably configured as at least one locking element, for example in the form of a maintenance stop. In its first or third service position, the nozzle bar 04 comprising the at least one print head 08 is preferably pulled and/or pressed against the at least one cleaning device 18, preferably as a result of the application of a force and/or, for example, by gravity. In this way, the first or third service position of the at least one nozzle bar 04 is preferably unambiguously defined.

The at least one nozzle bar 04 is preferably arranged in the first service position, this being the cleaning position, when the at least one cleaning device 18 is arranged in the at least one usage position, and when at least one cleaning element 31 is arranged in an operating position. The at least one nozzle bar 04 is preferably arranged in the third service position, this being the depot position, when the at least one cleaning device 18 is arranged in the at least one usage position, and when the at least one cleaning element 31 is arranged in a supply position. Preferably as an alternative, the at least one nozzle bar 04 is arranged in the idle position when the at least one cleaning device 18 is arranged in the at least one usage position, and when the at least one cleaning element 31 is arranged in the supply position.

The at least one cleaning device 18 comprises at least one cleaning unit 26, in particular the at least one cleaning element 31. The at least one cleaning device 18 preferably comprises at least one crossbar 22, which is preferably configured as a collecting trough 22. The crossbar 22 is preferably a mechanical carrier.

The at least one collecting trough 22 preferably has its longitudinal direction along its longest extension. The longitudinal direction of the at least one collecting trough 22 is preferably oriented parallel to the at least one nozzle bar 04. The collecting trough 22 preferably has its longest extension in the y direction. The at least one collecting trough 22 preferably extends across the entire extension of the at least one nozzle bar 04 in the transverse direction A. The at least one collecting trough 22 is preferably connected to the at least one crossbar 54 of the at least one guide system 19, and/or attached thereto, in the transverse direction A upstream and downstream from the at least one nozzle bar 04. The at least one collecting trough 22 is preferably configured as collection container for liquid or dirt. The at least one collecting trough 22 preferably encompasses at least one U-profile.

The at least one cleaning unit 26 and preferably the at least one cleaning element 31 are configured to move and/or be movable along the longitudinal direction of the at least one collecting trough 22, preferably along a cleaning guide 44. Preferably, the at least one cleaning unit 26 and preferably the at least one cleaning element 31 are configured to move and/or be movable in or counter to the transverse direction A and/or the y direction.

For example, in particular when the at least one nozzle bar 04 comprises at least two rows of print heads 08 that are preferably arranged next to one another in the y direction, at least two cleaning elements 31, preferably exactly as many cleaning elements 31 as there are rows of print heads 08, are assigned to the at least one collecting trough 22 and/or arranged at or in the at least one collecting trough 22.

The at least one cleaning element 31 preferably has the at least one supply position. The at least one supply position of the at least one cleaning element 31 is preferably a position of the at least one cleaning element 31 when it is not functionally connected to the at least one nozzle bar 04. The at least one supply position of the at least one cleaning element 31 preferably corresponds to a safekeeping position when the printing press is in an operating mode in which the at least one cleaning element 31 is not employed.

In the at least one supply position, the at least one cleaning element 31 is preferably arranged and/or is being arranged outside the area between the at least one nozzle bar 04 and the transport path of the printing substrate 03, for example established by the at least one printing substrate guide element 02 that is situated opposite the nozzle bar 04. In the at least one supply position, the at least one cleaning element 31 is preferably arranged outside the area between the at least one nozzle bar 04 and the transport path of the printing substrate 03, preferably along the y direction and/or along the transverse direction A and/or along the longest edge of the at least one nozzle bar 04. In the at least one supply position, the at least one cleaning element 31 is preferably arranged and/or is being arranged outside the area between the at least one nozzle bar 04 and the transport path of the printing substrate 03, preferably along the y direction and/or along the transverse direction A and/or along the longest side of the at least one nozzle bar 04. The supply position of the at least one cleaning element 31 preferably corresponds to a position along the at least one collecting trough 22, in particular along its longitudinal direction, outside the area between the at least one nozzle bar 04 and the transport path of the printing substrate 03. Preferably, the at least one fluid supply opening 38 of the at least one cleaning element 31 that is arranged in the supply position, preferably of the at least one cleaning device 18 arranged in the usage position, more preferably of the centroid of the delimitation of the fluid supply opening 38, has a preferably third preferably relative distance and/or is arranged at the relative distance, preferably a distance in the y direction and/or in the transverse direction A, with respect to the at least one opening of the at least one exit surface 09 of the at least one print head 08. Preferably, the preferably relative distance of the at least one fluid supply opening 38 of the at least one cleaning element 31 arranged in the supply position, preferably of the centroid of the delimitation of the fluid supply opening 38, with respect to the at least one opening of the at least one exit surface 09 of the at least one print head 08 is at least twice, preferably at least two point five times, more preferably at least three times, more preferably at least five times, as large as an extension in the transverse direction A of the at least one exit surface 09 of the at least one print head 08 of the at least one nozzle bar 04 to be cleaned by the at least one cleaning device 18. Preferably, the relative distance with respect to a first print head 08 of the at least one row of print heads 08 of the at least one nozzle bar 04 is determined, the print head 08 being arranged closest to the supply position.

The at least one cleaning element 31 is preferably configured to be movable and/or to move, along the y direction and/or along the transverse direction A, out of the area between the at least one nozzle bar 04 and the transport path of the printing substrate 03, so as to reach the at least one supply position. The at least one cleaning element 31 is preferably in the idle state in the at least one supply position.

The at least one cleaning element 31 has at least one operating position. The at least one cleaning device 18 is preferably arranged in its usage position when the at least one cleaning element 31 is arranged in its operating position.

In at least one cleaning operating mode of the printing press, in particular when the at least one cleaning element 31 is configured to clean the at least one nozzle bar 04, the at least one cleaning element 31 is arranged in the at least one operating position. The at least one operating position of the at least one cleaning element 31 is a position within the area between the at least one nozzle bar 04 and the transport path of the printing substrate 03, for example established by the at least one printing substrate guide element 02 that is situated opposite the nozzle bar 04. The operating position preferably corresponds to a position along the at least one collecting trough 22, in particular along its longitudinal direction, within the area between the at least one nozzle bar 04 and the transport path of the printing substrate 03. The at least one print head 08, preferably the at least one exit surface 09 of the at least one print head 08, of the at least one nozzle bar 04, preferably of the at least one nozzle bar 04 of the at least four nozzle bars 04, is cleaned in a contactless manner by the at least one cleaning device 18. The at least one print head 08, preferably the at least one exit surface 09 of the at least one print head 08, of the at least one nozzle bar 04, preferably of the at least one nozzle bar 04 of the at least four nozzle bars 04, is cleaned in a contactless manner by the at least one cleaning device 18 comprising the at least one cleaning element 31, which is arranged in the operating position, including the at least one fluid supply opening 38. In the operating position, the at least one cleaning element 31 is arranged within the area between the at least one nozzle bar 04 and the transport path of printing substrate 03. Preferably, the at least one fluid supply opening 38 of the at least one cleaning element 31 that is arranged in the operating position, preferably of the at least one cleaning device 18 arranged in the usage position, more preferably of the centroid of the delimitation of the fluid supply opening 38, has a preferably fourth preferably relative distance and/or is arranged at the relative distance, preferably a distance in the y direction and/or in the transverse direction A, with respect to the at least one opening of the at least one exit surface 09 of the at least one print head 08. Preferably, the preferably relative distance of the at least one fluid supply opening 38 of the at least one cleaning element 31 arranged in the operating position, preferably of the centroid of the delimitation of the fluid supply opening 38, with respect to the at least one opening of the at least one exit surface 09 of the at least one print head 08 is no more than one time, preferably no more than zero point five times, as large as an extension in the transverse direction A of the at least one exit surface 09 of the at least one print head 08 of the at least one nozzle bar 04 to be cleaned by the at least one cleaning device 18. The relative distance is preferably less in the operating position than in the supply position.

The at least one cleaning element 31 is preferably configured to be movable and/or to move, along the y direction and/or along the transverse direction A, into the area between the at least one nozzle bar 04 and the transport path of the printing substrate 03, so as to reach the at least one operating position. The at least one cleaning element 31 is preferably in movement with respect to the cleaning device G in the at least one operating position.

The at least one cleaning element 31 is preferably arranged in the at least one operating position when it is functionally connected to the at least one nozzle bar 04. The at least one cleaning device 18 preferably at least temporarily enters into a functional connection with the at least one nozzle bar 04, preferably when the at least one nozzle bar 04 is arranged in the first service position, this being the cleaning position, and the at least one cleaning element 31 is arranged in the operating position. The at least one cleaning device 18, in particular at least two, preferably all, cleaning elements 31 of the cleaning device 18 that are arranged in the operating position, preferably enter into a functional connection with at least two, and preferably all, nozzle bars 04, the nozzle bars 04 preferably being arranged in the first service position at the same time. Preferably, further nozzle bars 04 of the printing unit 01 that are not to enter into a functional connection with the at least one cleaning device 18, while preferably at least one nozzle bar 04 is functionally connected to the at least one cleaning element 31 of the at least one cleaning device 18, are preferably arranged in the idle position or the depot position at this time.

The at least one cleaning device 18 has the at least one storage position and the at least one usage position. The at least one cleaning device 18 is moved by the at least one guide system 19 from the at least one storage position into the at least one usage position, or vice versa. The at least one cleaning device 18 is, preferably the at least two cleaning devices 18 are configured to move and/or be movable along the at least one guide element 53 from the at least one storage position, in particular the storage position that is arranged outside the area between the at least one nozzle bar 04 and the transport path of the at least one printing substrate 03, into the at least one usage position, in particular a usage position that is arranged within the area between the at least one nozzle bar 04 and the transport path of at least one printing substrate 03, or vice versa. The at least one cleaning device 18 is moved, preferably linearly displaced, along the at least one guide element 53 of the at least one guide system 19 from the at least one storage position into the at least one usage position, or vice versa, preferably along a direction along the shortest side of the at least one nozzle bar 04. The at least one cleaning device 18 preferably comprises at least one drive. The at least one drive of the at least one cleaning device 18 is preferably configured to drive the movement of the at least one cleaning device 18 from the storage position into the usage position, or vice versa.

The at least one cleaning element 31 preferably has the at least one supply position and the at least one operating position. The at least one cleaning element 31 is preferably moved from the at least one supply position into the at least one operating position, or vice versa. In its at least one operating position, the at least one cleaning element 31 is preferably moved in or counter to the cleaning direction G in the area between the at least one nozzle bar 04 and the transport path of the at least one printing substrate 03.

The at least one cleaning device 18 cleans the at least one print head 08. The at least one cleaning device 18 preferably at least temporarily cleans the at least one print head 08. In the first service position, the at least one print head 08 is cleaned by the at least one cleaning device 18, in particular by the at least one cleaning element 31.

The at least one printing unit 01 of the printing press comprises at least one cleaning system 61. The at least one cleaning system 61 comprises at least one removal unit 63. The at least one removal unit 63 comprises at least one contact element 64. Preferably, at least one removal unit 63 is in each case assigned to a nozzle bar 04 of the at least one printing unit 01 and/or at least temporarily enters into a functional connection with at least one nozzle bar 04. The at least one cleaning system 61 is configured to at least temporarily make direct contact with the at least one print head 08, at least by way of the at least one contact element 64. The at least one cleaning system 61 is configured to make direct contact and/or makes direct contact with the at least one print head 08, at least by way of the at least one contact element 64. More preferably, the at least one cleaning system 61 comprises at least two removal units 63. Preferably, a respective removal unit 63 in each case is configured to make contact in each case with at least one row of print heads 08 and/or all removal units 63 are preferably in each case configured to simultaneously make contact with a row of print heads 08. Preferably, a respective removal unit 63 in each case makes contact with at least one row of print heads 08 and/or all removal units 63 preferably in each case simultaneously make contact with a row of print heads 08. The at least one cleaning system 61 preferably makes direct contact with the at least one print head 08, at least by way of the at least one contact element 64. The at least one printing unit 01 preferably comprises the at least one cleaning system 61, comprising at least two removal units 63. Preferably, at least two nozzle bars 04, preferably at least two nozzle bars 04 of the at least four nozzle bars 04, are configured to make contact, and/or make contact, with at least one respective removal unit 63.

The at least one cleaning system 61 comprises at least one guide element 62. The at least one cleaning system 61 preferably comprises at least two guide elements 62, more preferably exactly two guide elements 62. The at least one removal unit 63 is configured to move and/or be movable along the at least one guide element 62, along the longest edge of the at least one nozzle bar 04 and/or along the y direction. The at least one removal unit 63 is configured to move and/or be movable and/or is moved along the at least one guide element 62, along the longest side of the at least one nozzle bar 04 and/or along the y direction. The at least one removal unit 63 is preferably arranged along the at least one guide element 62, along a longest side of the at least one nozzle bar 04 and/or along the y direction, in at least one supply position or in at least one operating position. The supply position and the operating position are preferably spaced apart from one another at a distance of greater than zero. The at least one guide element 62 is preferably configured as a bar and/or a rod and/or a rail and/or a linear guide. A longest extension of the at least one guide element 62, preferably its longitudinal direction, preferably extends in the y direction and/or in the transverse direction A, that is, parallel to a longest extension of the at least one nozzle bar 04. The at least one guide element 62 preferably enables rapid and secure guidance of the at least one removal unit 63. The risk of at least one removal unit 63 tilting and, for example, thereby damaging the at least one exit surface, is preferably minimized.

Preferably, in the x direction, that is, preferably along the transport path of the printing substrate 03, at least one of the respective guide elements 62 is arranged upstream, and at least one of the respective guide elements 62 is arranged downstream, from the at least one nozzle bar 04. Preferably, in the x direction, that is, preferably along the transport path of the printing substrate 03, at least one of respective guide element 62, preferably exactly one respective guide element 62, is arranged upstream from a first nozzle bar 04 of the printing unit 01, and downstream from a last nozzle bar 04 of the printing unit 01. For example, when the at least one printing substrate guide element 02 situated opposite the at least one nozzle bar 04 is configured as a cylinder or roller, at least one of the respective guide elements 62 is arranged along the circumference of the at least one printing substrate guide element 02 upstream from the at least one nozzle bar 04, and at least one of the respective guide elements 62 is arranged along the circumference of the at least one printing substrate guide element 02 downstream from the at least one nozzle bar 04.

The at least one removal unit 63 is preferably configured to be displaced and/or be displaceable, preferably in a linear manner, along the at least one guide element 62 of the at least one cleaning system 61. The at least one removal unit 63 is preferably configured to move and/or be movable and/or is moved along the at least one guide element 62 in or counter to at least one direction, in particular the cleaning direction G and/or the transverse direction A and/or the y direction. The at least one removal unit 63 is preferably configured to move and/or be movable and/or is moved along the at least one guide element 62 from the at least one supply position into the at least one operating position, or vice versa.

The at least one guide element 62 is preferably configured to guide and/or move the at least one removal unit 63 in or counter to the cleaning direction G. Preferably, when the at least one removal unit 63 is arranged on at least one carrier 76 or connected to the at least one carrier 76, the at least one guide element 62 is configured to guide and/or move the at least one carrier 76 in or counter to the cleaning direction G.

Preferably, the at least one removal unit 63, more preferably the at least one contact element 64, has the at least one supply position. The at least one supply position of the at least one removal unit 63 is preferably a position of the at least one removal unit 63 when it is not functionally connected to the at least one nozzle bar 04. The at least one supply position of the at least one removal unit 63 preferably corresponds to a safekeeping position of the at least one removal unit 63 when the printing press is in an operating mode in which the at least one removal unit 63 is not employed.

In the at least one supply position, the at least one removal unit 63 is preferably arranged and/or is being arranged outside an area between the at least one nozzle bar 04 and the transport path of the printing substrate 03, for example established by the at least one printing substrate guide element 02 that is situated opposite the nozzle bar 04.

In a preferred embodiment, for example shown in FIG. 10 to FIG. 12*a*, in the at least one supply position, the at least one removal unit 63 is preferably arranged and/or is being arranged outside the area between the at least one nozzle bar 04 and the transport path of the printing substrate 03, preferably along the y direction and/or along the transverse direction A, preferably along the longest side of the at least one nozzle bar 04. The at least one removal unit 63 is preferably arranged in the at least one supply position along a longest edge of the at least one nozzle bar 04 and/or along the y direction, outside the area between the at least one nozzle bar 04 and the transport path of the printing substrate 03. In the at least one supply position, the at least one removal unit 63 is preferably arranged and/or is being arranged along the longest side of the at least one nozzle bar 04 and/or along the y direction, outside the area between the at least one nozzle bar 04 and the transport path of the printing substrate 03. The supply position preferably corresponds to a position along the at least one guide element 62, in particular along its longitudinal direction, outside the area between the at least one nozzle bar 04 and the transport path of the printing substrate 03. The at least one removal unit 63 is preferably configured to be movable and/or to move, along the y direction and/or along the transverse direction A, out of the area between the at least one nozzle bar 04 and the transport path of the printing substrate 03, so as to reach the at least one supply position.

Preferably, the at least one contact element 64 of the at least one removal unit 63 that is arranged in the supply position, more preferably at least one contact zone, has a preferably fifth preferably relative distance and/or is arranged at the relative distance, preferably a distance in the y direction and/or in the transverse direction A, with respect to the at least one opening of the at least one exit surface 09 of the at least one print head 08. Preferably, the preferably relative distance of the at least one contact element 64 of the at least one removal unit 63 arranged in the supply position, more preferably of the at least one contact zone, with respect to the at least one opening of the at least one exit surface 09 of the at least one print head 08 is at least twice, preferably at least two point five times, more preferably at least three times, more preferably at least five times, as large as an extension in the transverse direction A of the at least one exit surface 09 of the at least one print head 08 of the at least one nozzle bar 04 to be cleaned by the at least one removal unit 63. Preferably, the relative distance with respect to a first print head 08 of the at least one row of print heads 08 of the at least one nozzle bar 04 is determined, the print head 08 being arranged closest to the supply position.

For example, in an alternative embodiment, for example shown in FIG. 15 to FIG. 17*c*, the supply position of the at least one removal unit 63 is preferably arranged upstream or downstream from the at least one nozzle bar 04 of the printing unit 01, in the x direction, that is, preferably along the transport path of the printing substrate 03. The at least one cleaning system 61 for this purpose preferably comprises at least one pivot element 81, preferably at least two pivot elements 81, forming a pivot axis of the at least one removal unit 63 and/or of the at least one guide element 62. The at least one removal unit 63 and/or the at least one guide element 62 are preferably configured to pivot about the at least one pivot element 81. The at least one removal unit 63 is preferably transferred from the supply position into the operating position by pivoting about the at least one pivot element 81.

The at least one removal unit 63 is preferably in the idle state in the at least one supply position. Preferably, in particular when the at least one removal unit 63 is arranged on the at least one carrier 76 and/or connected to the at least one carrier 76, the at least one carrier 76 has the at least one supply position and/or is arranged and/or can be arranged at least temporarily in the at least one supply position.

The at least one removal unit 63, more preferably the at least one contact element 64, has the at least one operating position. For example, the at least one removal unit 63 is arranged in the at least one operating position in FIG. 12*b*. Preferably, the at least one removal unit 63, more preferably the at least one contact element 64, has the at least one supply position and the at least one operating position.

Preferably, in particular when the at least one removal unit 63 is arranged on the at least one carrier 76 and/or connected to the at least one carrier 76, the at least one carrier 76 has the at least one operating position and/or is arranged and/or can be arranged, at least temporarily, in the at least one operating position. Preferably, at least two removal units 63 are arranged jointly on the at least one carrier 76. The at least one carrier 76 in particular then preferably has the at least one supply position and the at least one operating position.

In at least one cleaning operating mode of the printing press, in particular when the at least one removal unit 63 is configured to clean the at least one nozzle bar 04, the at least one removal unit 63 is preferably arranged in the at least one operating position. The at least one operating position of the at least one removal unit 63 is a position within the area between the at least one nozzle bar 04 and the transport path of the printing substrate 03, for example established by the at least one printing substrate guide element 02 that is situated opposite the nozzle bar 04. The operating position corresponds to a position along the at least one guide element 62, in particular along its longitudinal direction, within the area between the at least one nozzle bar 04 and the transport path of the printing substrate 03. Preferably, in the at least one operating position, the at least one removal unit 63 is at least temporarily in motion with respect to the cleaning direction G. Preferably, the at least one contact element 64 of the at least one removal unit 63 that is arranged in the operating position, more preferably the at least one contact zone, has a preferably sixth preferably relative distance and/or is arranged at the relative distance, preferably a distance in the y direction and/or in the transverse direction A, with respect to the at least one opening of the at least one exit surface 09 of the at least one print head 08. Preferably, the preferably relative distance of the at least one contact element 64 of the at least one removal unit 63 arranged in the operating position, more preferably of the at least one contact zone, with respect to the at least one opening of the at least one exit surface 09 of the at least one print head 08 is no more than one time, preferably no more than zero point five times, as large as an extension in the transverse direction A of the at least one exit surface 09 of the at least one print head 08 of the at least one nozzle bar 04 to be cleaned by the at least one removal unit 63. The relative distance is preferably less in the operating position than in the supply position.

In the preferred embodiment, for example shown in FIG. 10 to FIG. 12*b*, the at least one removal unit 63 is preferably configured to be movable and/or to move into the area between the at least one nozzle bar 04 and the transport path of the printing substrate 03, preferably along the y direction and/or along the transverse direction A, preferably along the longest side of the at least one nozzle bar 04, so as to reach the at least one operating position.

In the alternative embodiment, for example shown in FIG. 15 to FIG. 17*c*, the at least one removal unit 63 is preferably configured to pivot about the at least one pivot element 81 from the supply position, that is, an area outside the area between the at least one nozzle bar 04 and the transport path of the printing substrate 03, into the area between the at least one nozzle bar 04 and the transport path of the printing substrate 03 so as to reach the at least one operating position.

The at least one removal unit 63 is arranged in the at least one operating position when it is functionally connected to the at least one nozzle bar 04. The at least one cleaning system 61 enters at least temporarily into a functional connection with the at least one nozzle bar 04 when the at least one nozzle bar 04 is arranged in the second service position, this being the intensive cleaning position, and the at least one removal unit 63 is arranged in the operating position. The at least one cleaning system 61, in particular at least two removal units 63 of the cleaning system 61 that are arranged in the operating position, preferably enter into a functional connection with at least two, preferably all, nozzle bars 04, the nozzle bars 04 preferably being arranged in the second service position at the same time. Preferably, further nozzle bars 04 of the printing unit 01 that are not to enter into a functional connection with the at least one cleaning system 61, while preferably at least one nozzle bar 04 is functionally connected to the at least one cleaning system 61, are preferably arranged in the idle position at this time.

The at least one cleaning system 61 is configured to clean at least one print head 08 of the at least one nozzle bar 04 that is arranged in the second service position by way of at least temporary direct contact. The at least one print head 08, preferably its at least one exit surface 09 and/or its at least one bearing surface 11 and/or the at least one positioning gap 07, of the at least one nozzle bar 04 arranged in the second service position, this being the intensive cleaning position, are at least temporarily in direct contact with at least one component of the cleaning system 61 that is arranged in the operating position, in particular with the at least one contact element 64 of the at least one removal unit 63 that is arranged in the operating position.

The at least one removal unit 63 preferably has the at least one supply position and the at least one operating position. The at least one removal unit 63 is configured to be displaced and/or be displaceable along the at least one guide element 62 of the at least one cleaning system 61. The at least one removal unit 63 is preferably configured to move and/or be movable and/or is moved along the at least one guide element 62 in or counter to the at least one cleaning direction G, preferably in or counter to the y direction and/or preferably in or counter to the transverse direction A. The at least one cleaning system 61 preferably comprises at least one drive. The at least one drive of the at least one cleaning system 61 is preferably configured to drive the movement of the at least one removal unit 63, in particular along the at least one guide element 62.

The at least one removal unit 63 is preferably moved from the at least one supply position into the at least one operating position, or vice versa. Preferably, the at least one removal unit 63 is preferably configured to be displaced and/or be displaceable along the at least one guide element 62, preferably in the cleaning direction G and/or y direction, of the at least one cleaning system 61, while the at least one nozzle bar 04 is arranged in the at least one service position. The at least one removal unit 63 is preferably configured to move and/or be movable along the at least one guide element 62 from the at least one supply position that is arranged outside the area between the at least one nozzle bar 04 and the transport path of the printing substrate 03, into the at least one operating position that is arranged within the area between the at least one nozzle bar 04 and the transport path of printing substrate 03, or vice versa. In particular, the at least one nozzle bar 04 is at idle in the process.

The at least one cleaning system 61 at least temporarily cleans the at least one print head 08. In the second service position, the at least one print head 08 is cleaned by the at least one cleaning system 61, in particular by the at least one removal unit 63. In the at least one operating position, the at least one removal unit 63 is preferably configured to move and/or be movable in or counter to at least one cleaning direction G, preferably in or counter to the y direction, preferably along the at least one guide element 62, for example driven by the at least one drive of the cleaning system 61. In a cleaning step in the at least one operating position, the at least one removal unit 63 is preferably moved in or counter to the cleaning direction G, preferably in or counter to the y direction, preferably along the at least one guide element 62. The at least one print head 08 of the at least one nozzle bar 04, preferably of the at least one nozzle bar 04 of the at least four nozzle bars 04, is cleaned by the at least one cleaning system 61 comprising the at least one removal unit 63, which is arranged in the at least one operating position, comprising the at least one contact element 64 configured as a wiping cloth 64. In the at least one operating position, the at least one removal unit 63 is arranged within the area between the at least one nozzle bar 04 and the transport path of printing substrate 03.

More preferably, the at least one nozzle bar 04 comprises the at least two print heads 08. The at least two print heads 08 are preferably arranged in at least two different rows. The at least one cleaning system 61 preferably cleans the at least two rows of the print heads 08 of the at least one nozzle bar 04 simultaneously.

The at least one printing unit 01 comprises the at least one cleaning device 18. The at least one cleaning device 18 is configured to clean the at least one exit surface 09 and/or the at least one bearing surface 11 of the at least one print head 08 of the at least one nozzle bar 04. Preferably in addition or as an alternative, the at least one cleaning device 18 cleans the at least one positioning gap 07. Preferably, at least one respective cleaning device 18 is assigned to each nozzle bar 04 of a printing unit 01.

Figure 5A:
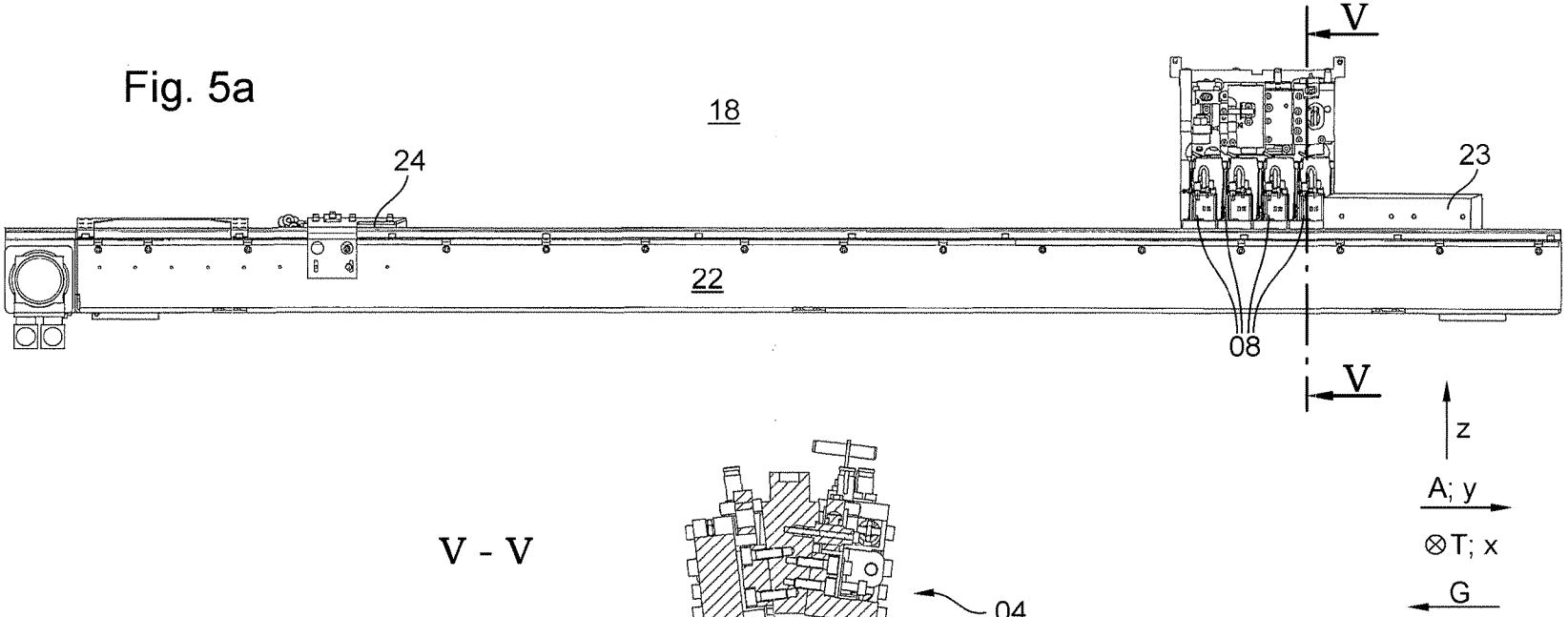
FIG. 5*a* shows a view of at least four print heads within a row of one nozzle bar and a cleaning device, at least one cleaning element being arranged opposite at least one print head and being in direct or indirect contact therewith, for the sake of clarity only four print heads being shown.
Figure 5B:
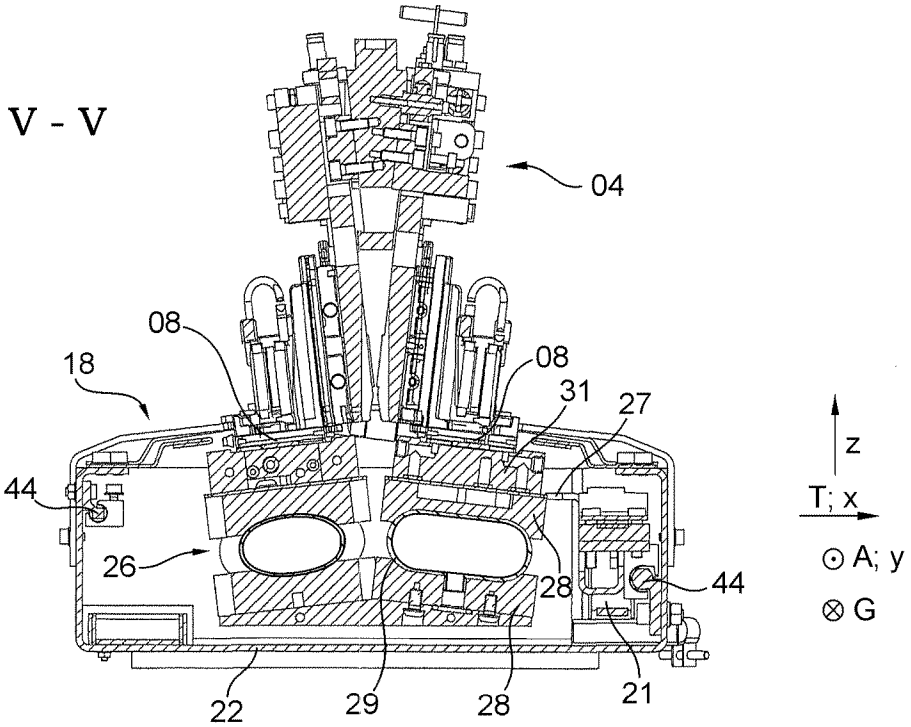
FIG. 5*b* shows a sectional illustration of the print heads of the nozzle bar and of the cleaning device according to a section along line V-V in FIG. 5*a;*
Figure 6A:
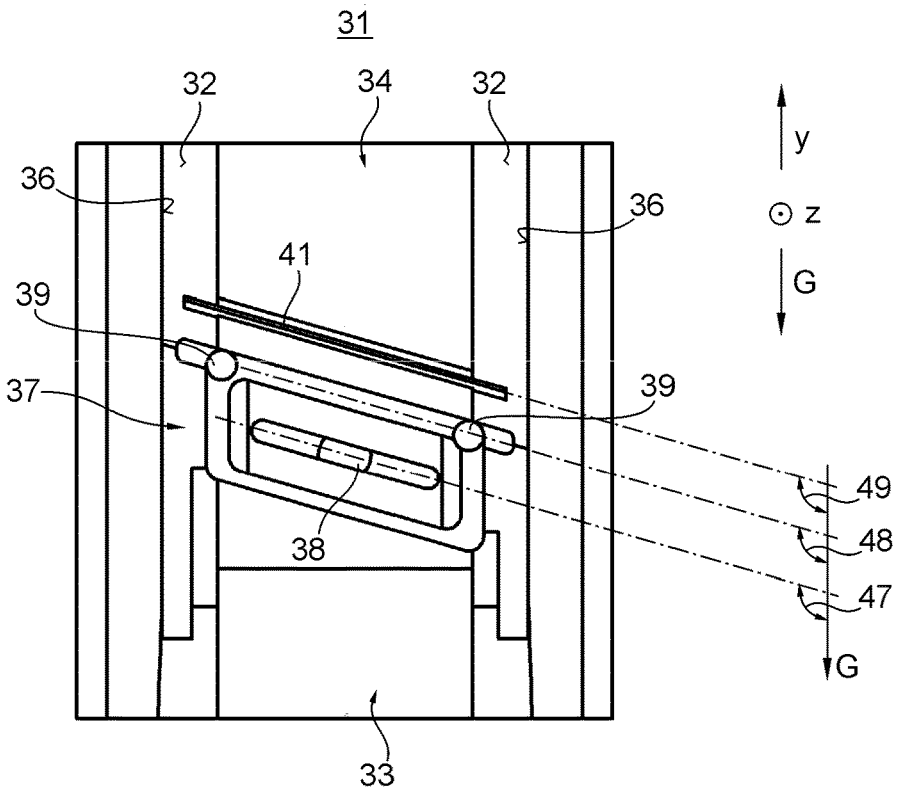
FIG. 6*a* shows an illustration of a cleaning element.
Figure 6B:
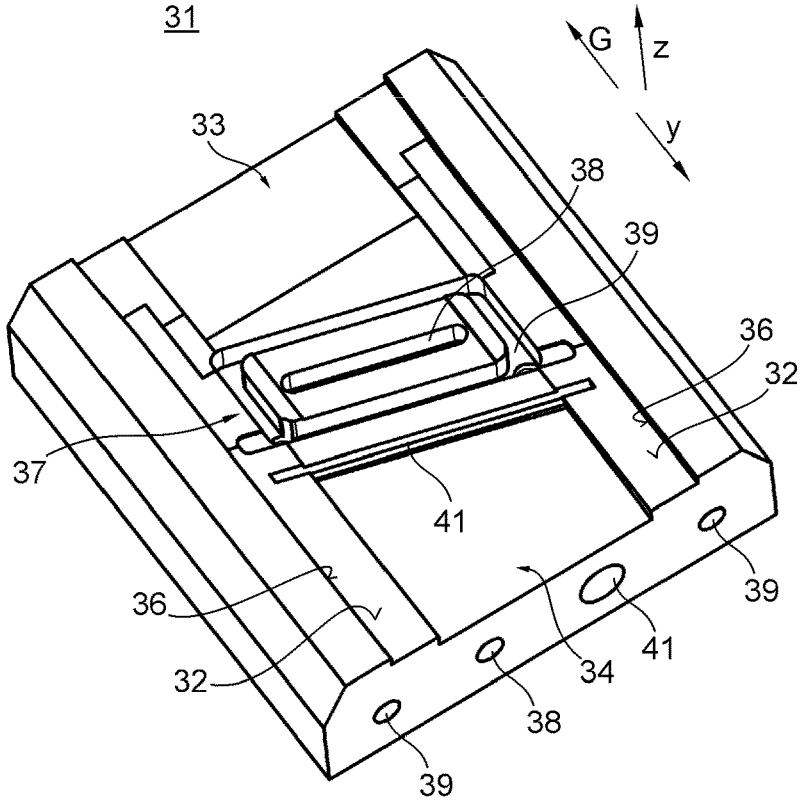
FIG. 6*b* shows an illustration of the cleaning element according to FIG. 6*a* in a perspective view.
Figure 6C:
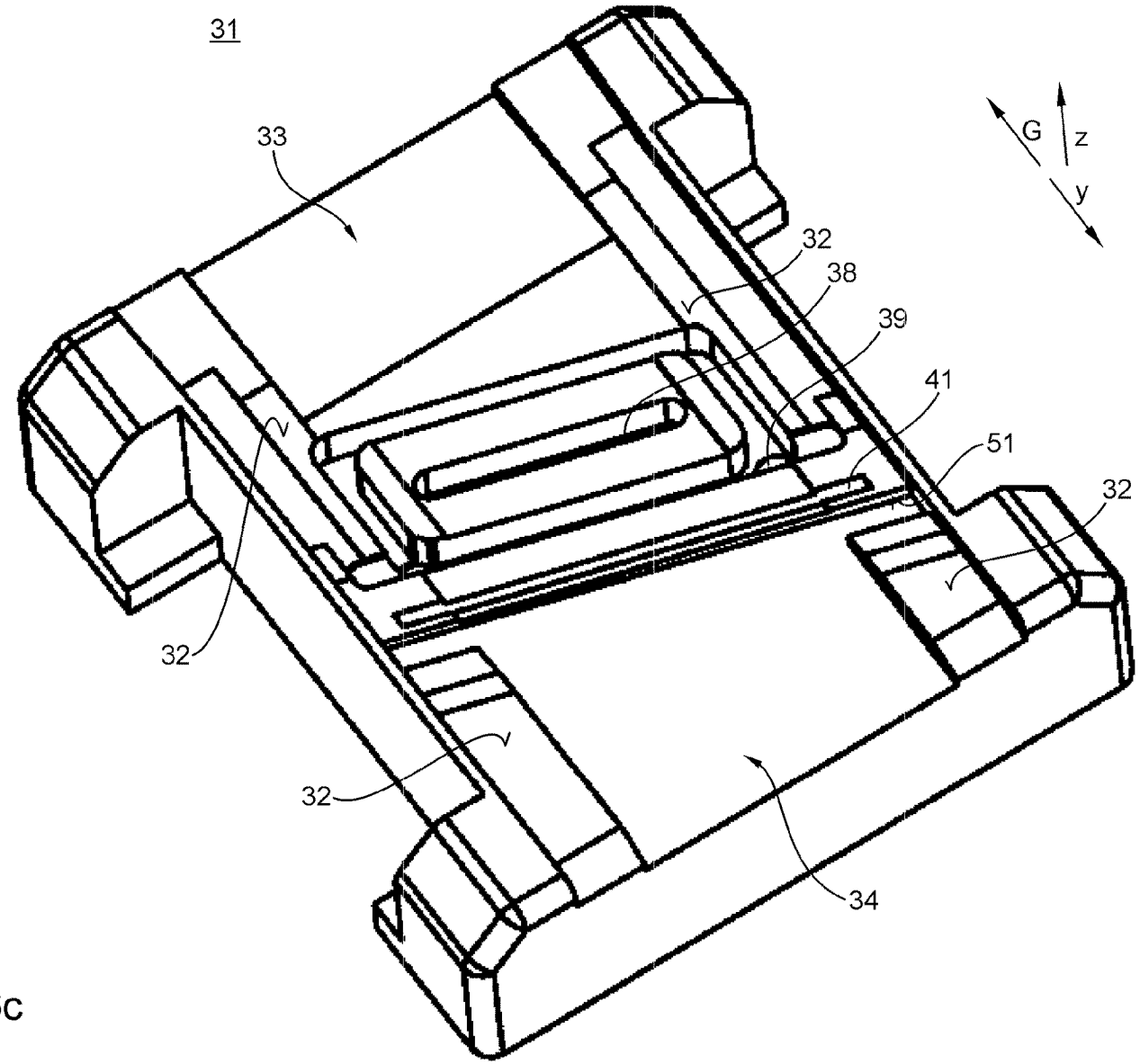
FIG. 6*c* shows an illustration of an alternative cleaning element in a perspective view.
Figure 7A:
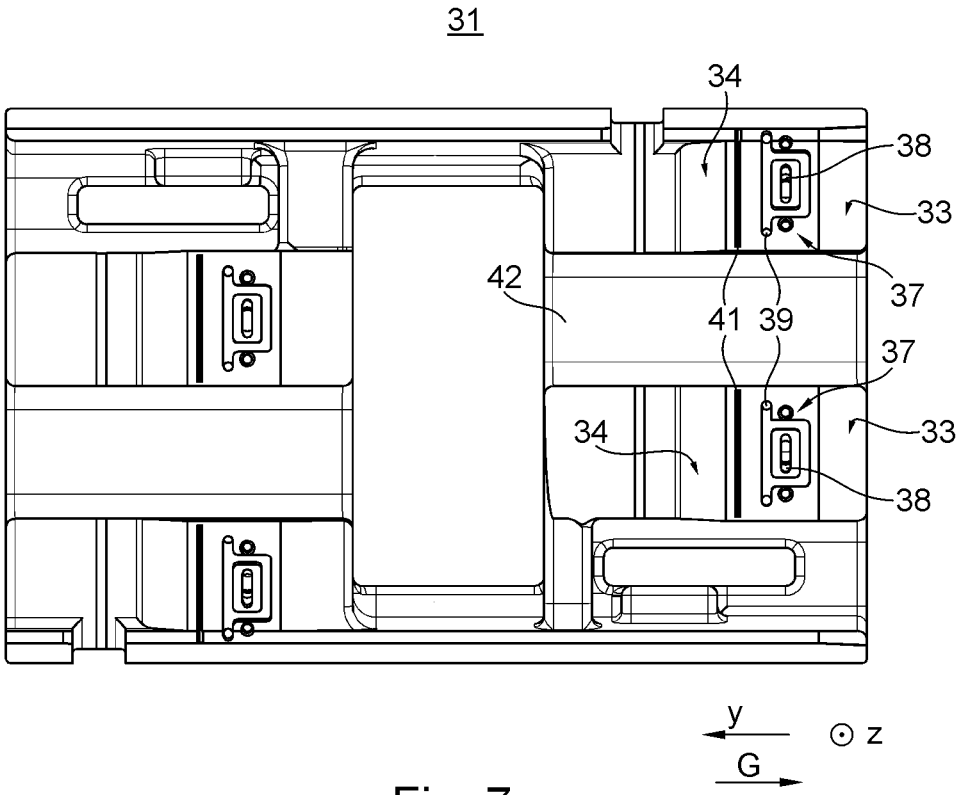
FIG. 7*a* shows an illustration of a further alternative embodiment of a cleaning element.
Figure 7B:
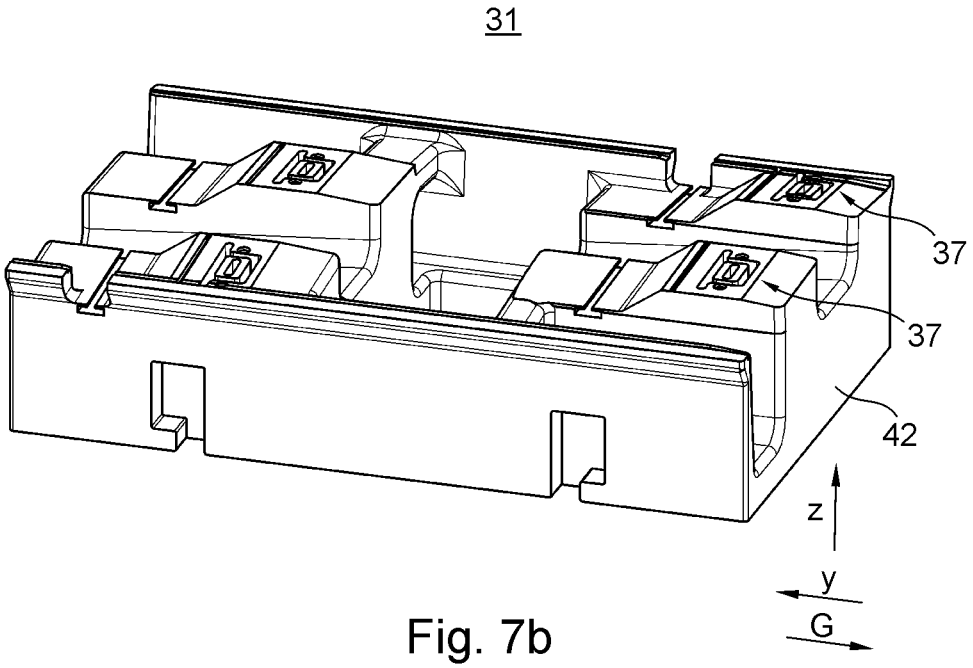
FIG. 7*b* shows an illustration of the further alternative embodiment of a cleaning element according to FIG. 7*a* in a perspective view.
Figure 7C:
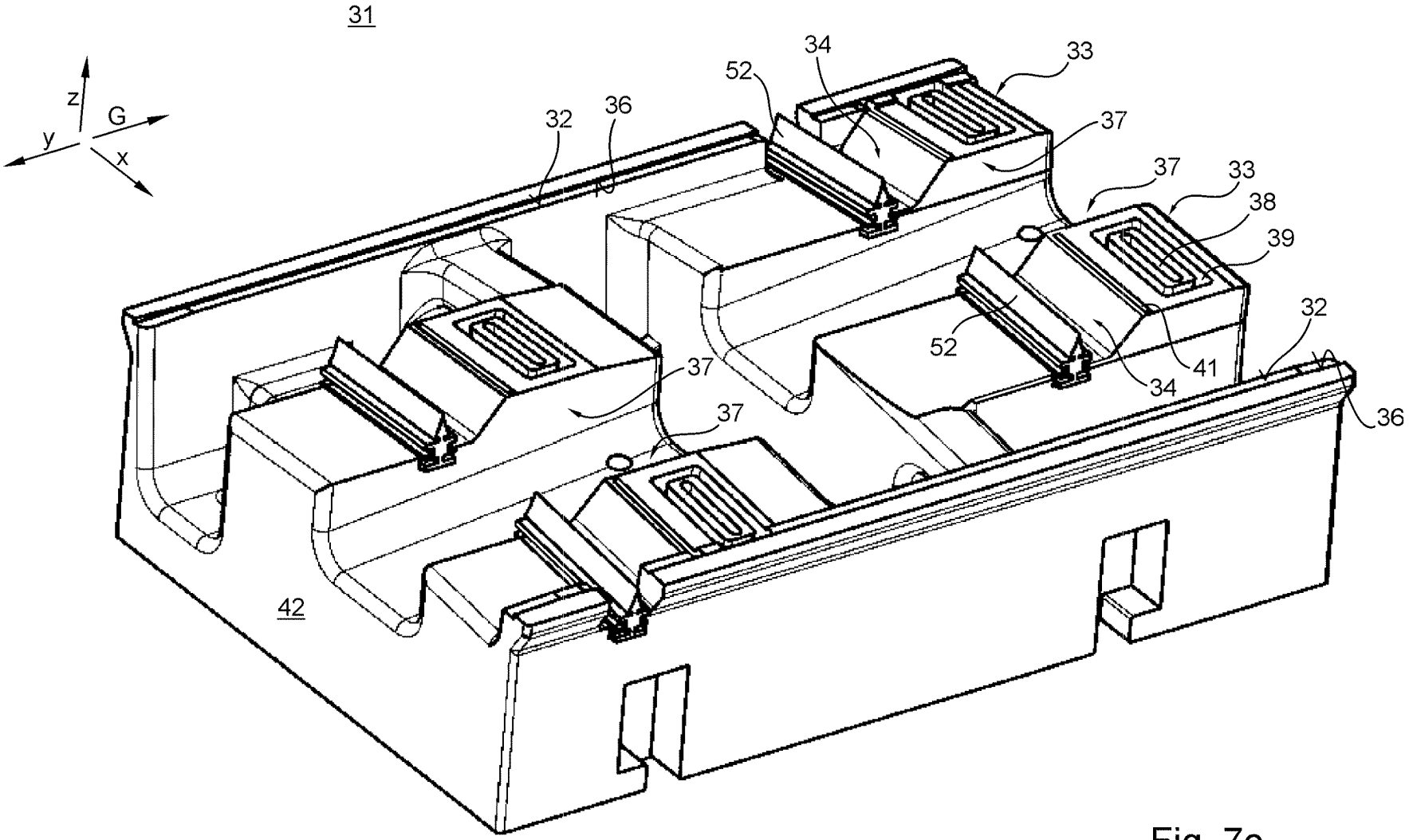
FIG. 7*c* shows an illustration of the further alternative embodiment of a cleaning element according to FIG. 7*a* and/or FIG. 7*b*, comprising at least one additional wiper.
Figure 7D:
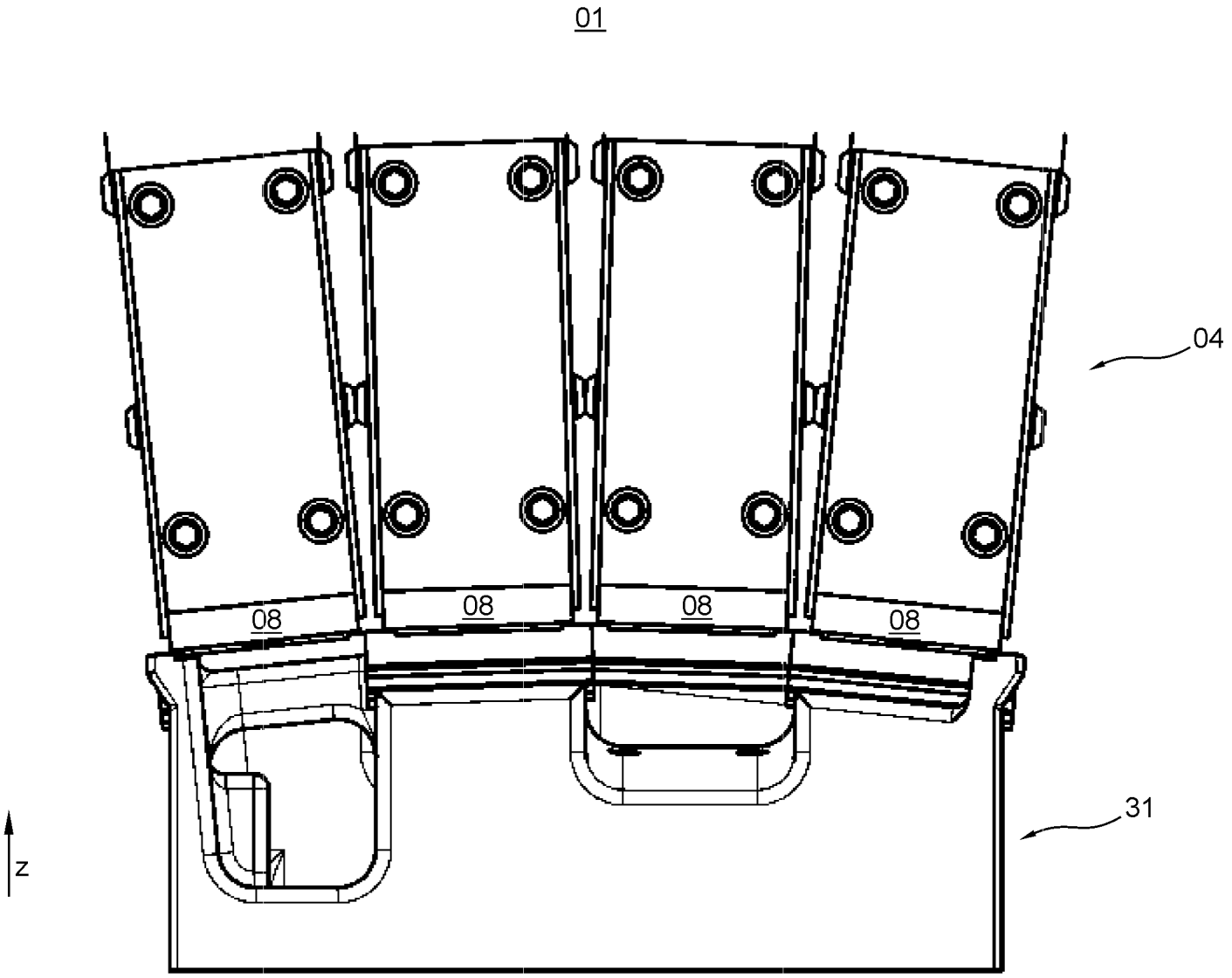
FIG. 7*d* shows an arrangement of a cleaning element including four cleaning areas at a nozzle bar including four rows of print heads.
Figure 8A:
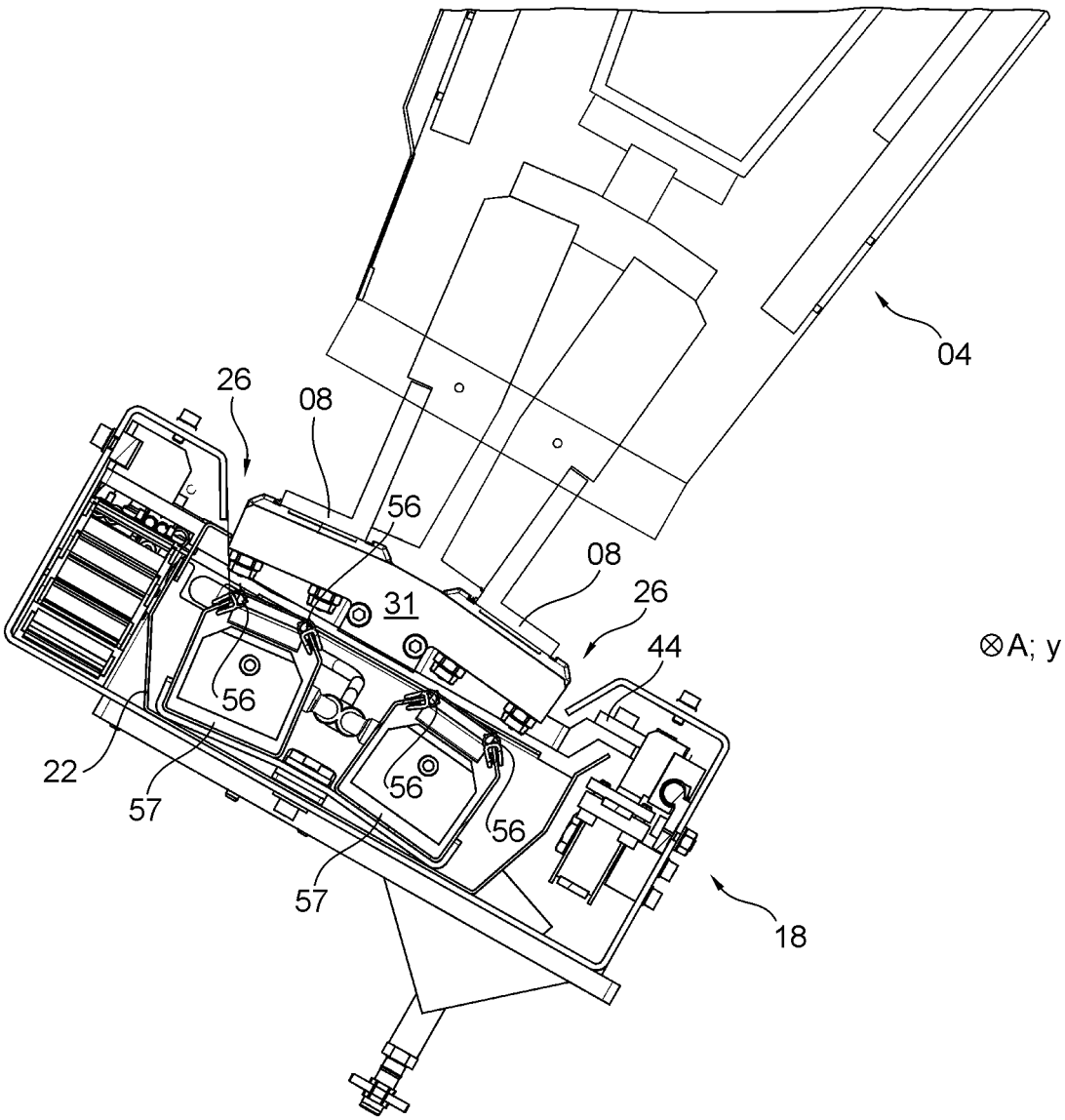
FIG. 8*a* shows an exemplary illustration of a nozzle bar including two rows of print heads in contact with at least one cleaning element of the at least one cleaning device.
Figure 8B:
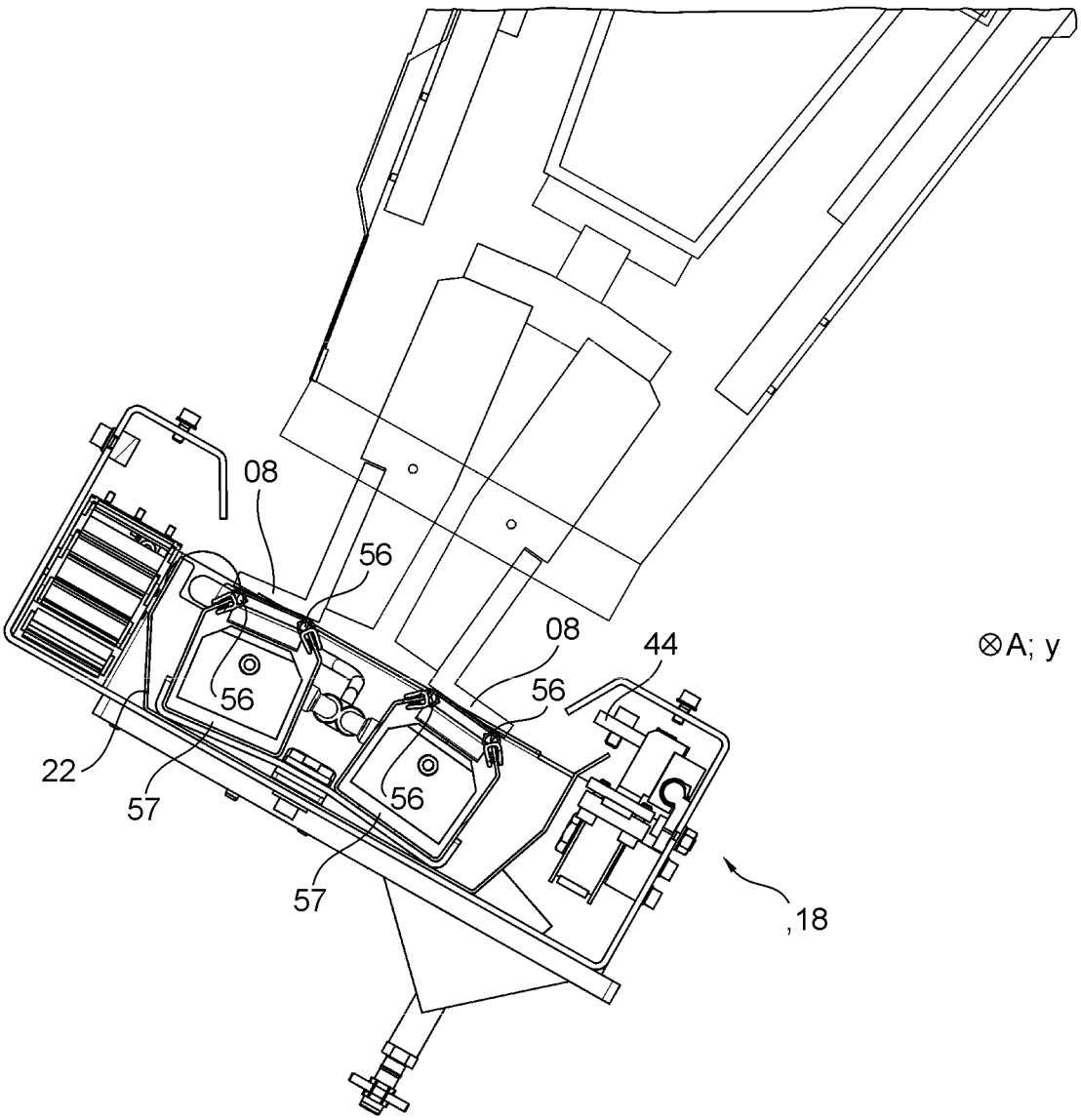
FIG. 8*b* shows an exemplary illustration of a nozzle bar including two rows of print heads in contact in each case with at least one sealing element.
Figure 9:
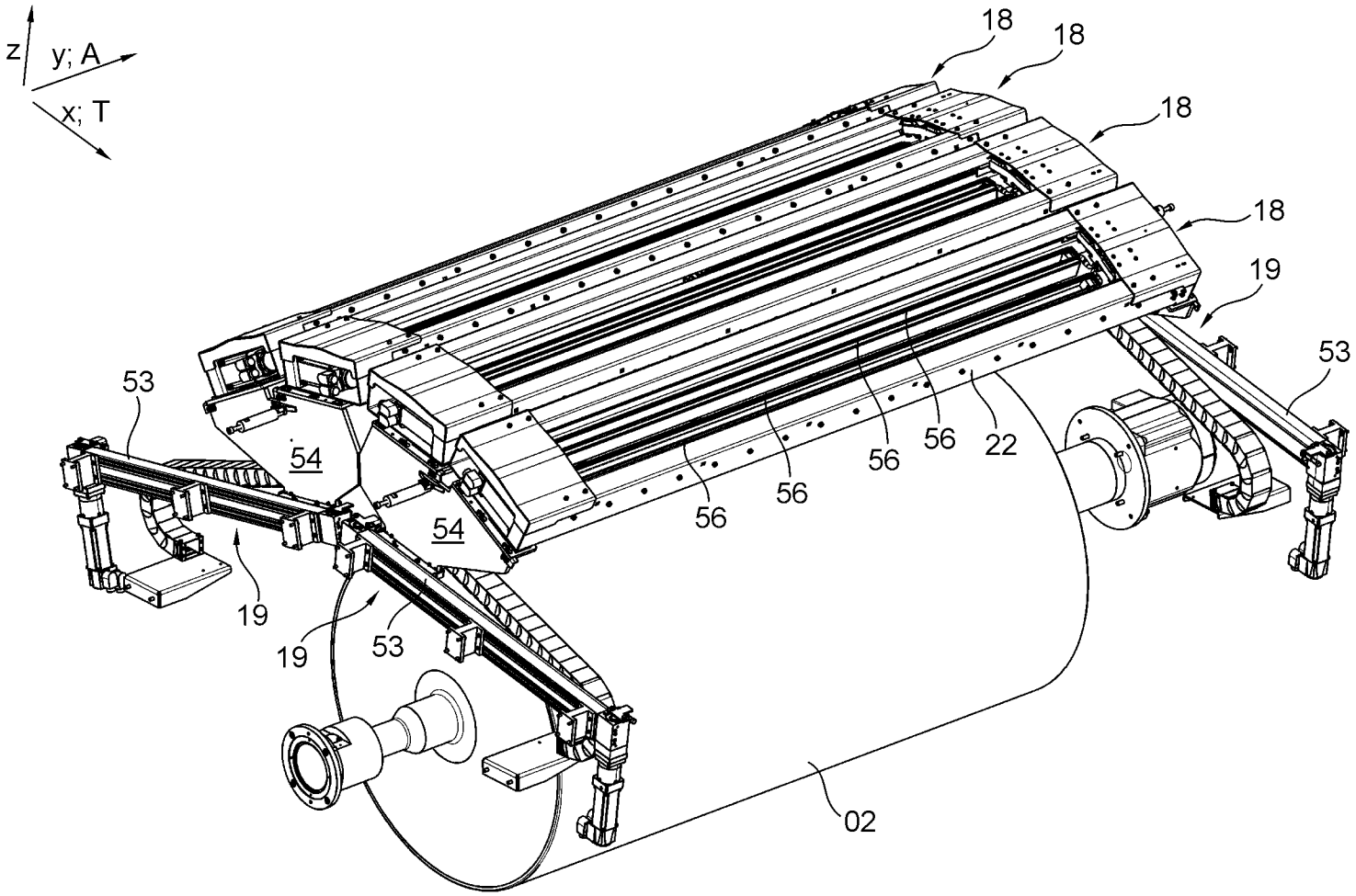
FIG. 9 shows a first embodiment of a printing unit comprising a cylindrical printing substrate guide element, two cleaning devices in each case comprising a shared guide system.
Figure 10:
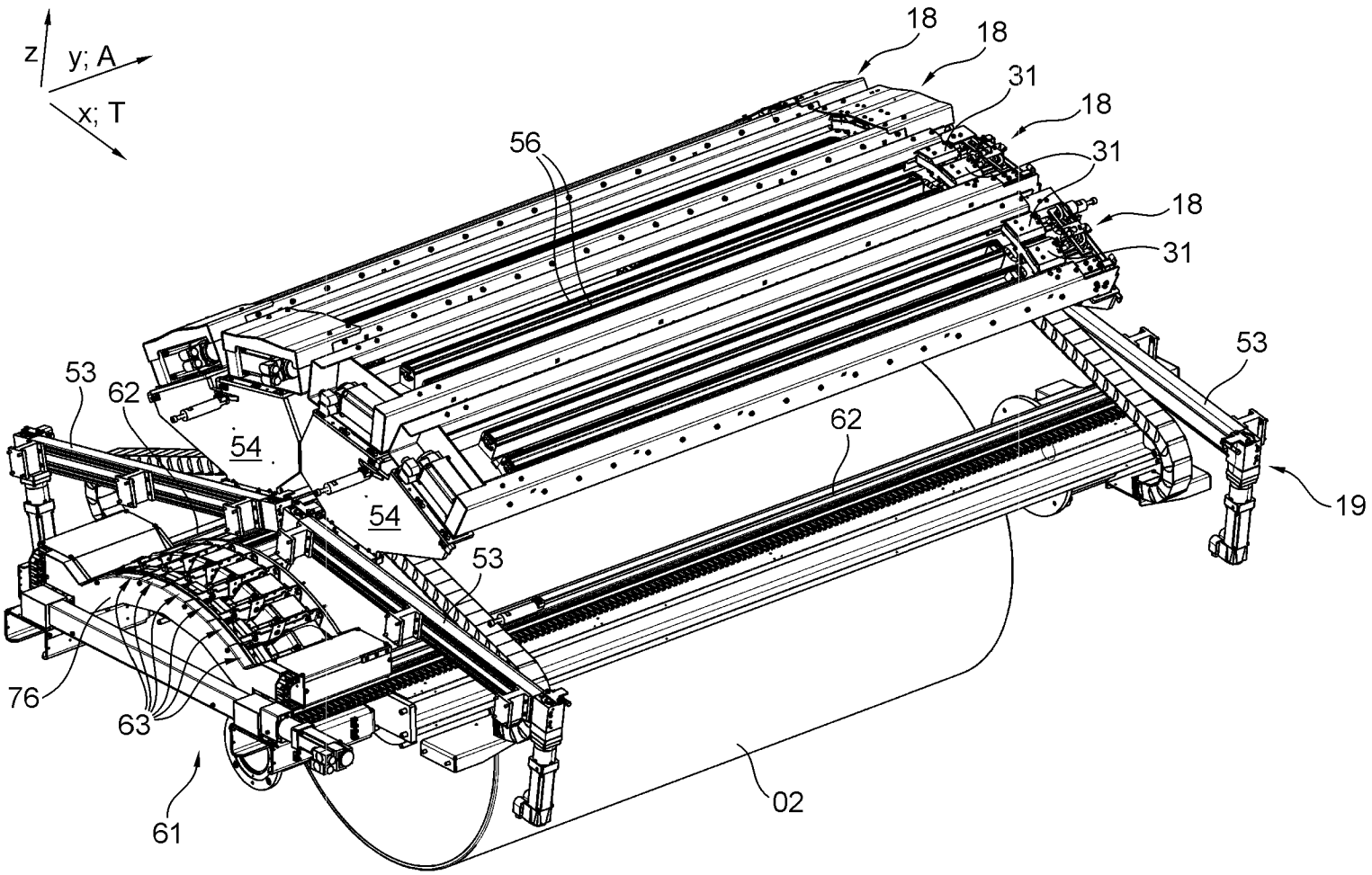
FIG. 10 shows another exemplary embodiment of a printing unit comprising a cylindrical printing substrate guide element, two cleaning devices in each case comprising a shared guide system, and the printing unit, in addition to the cleaning device, comprising a cleaning system comprising at least two removal units.
Figure 11:
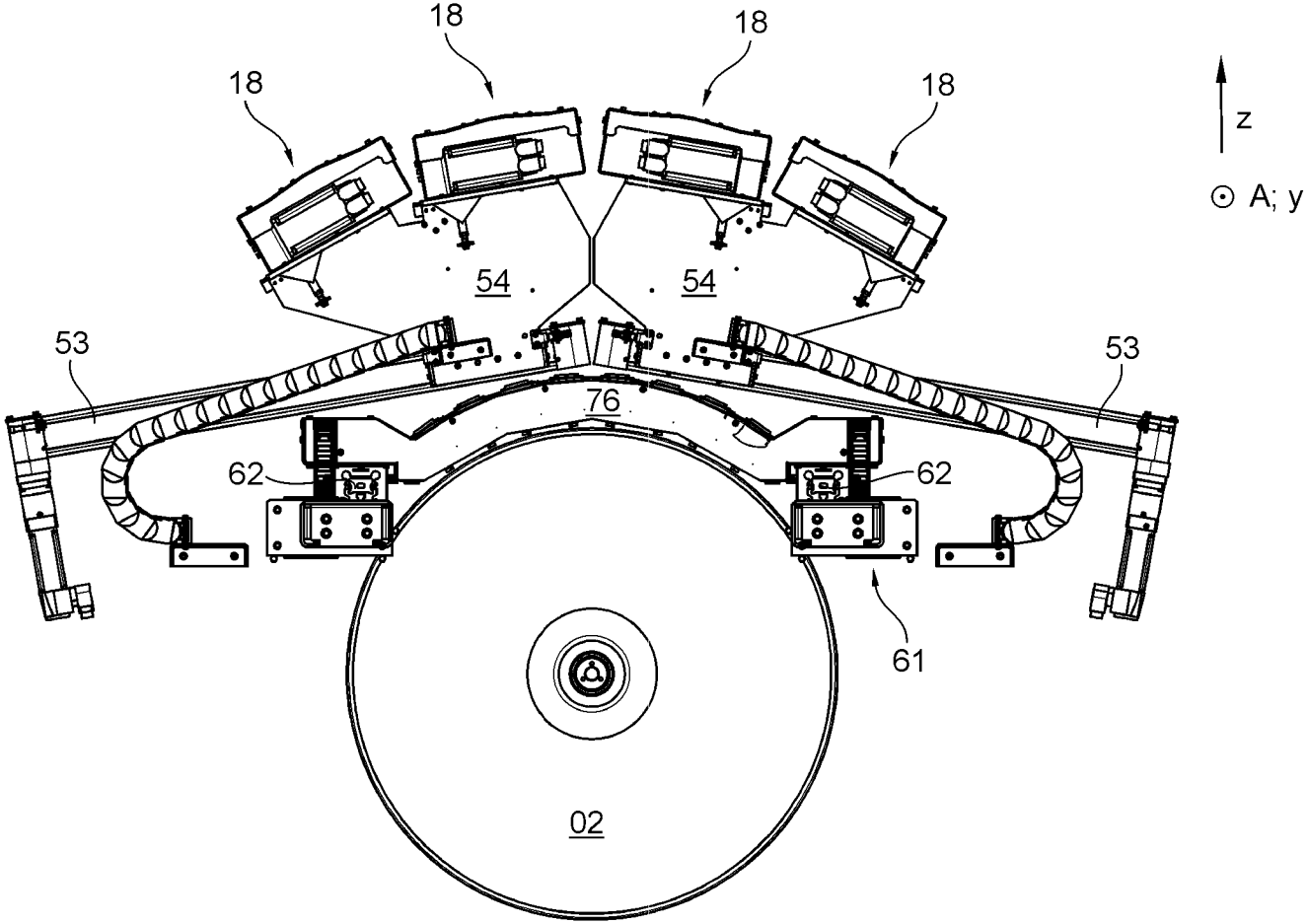
FIG. 11 shows the further exemplary embodiment of a printing unit comprising a cylindrical printing substrate guide element from FIG. 10 in a side view.
Figure 12A:
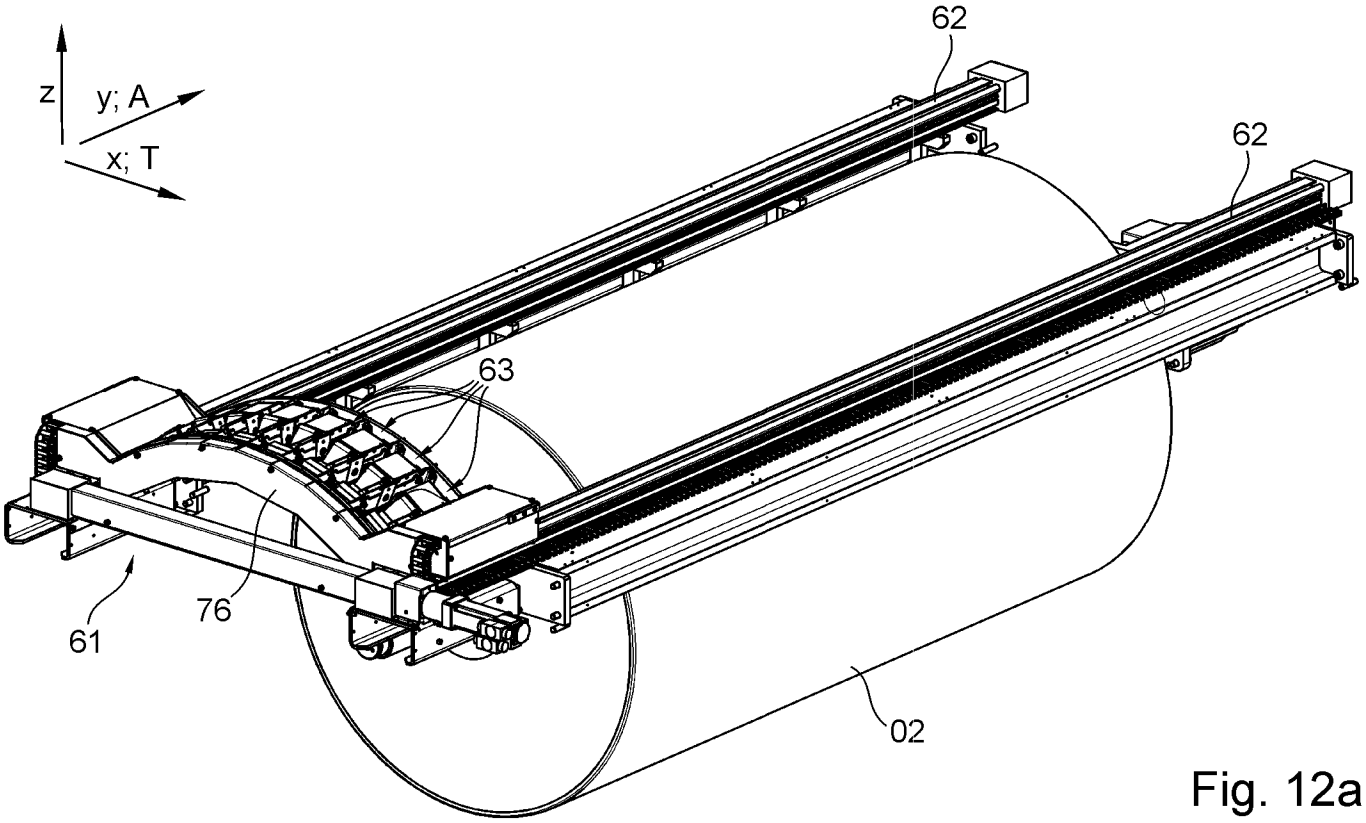
FIG. 12*a* shows an exemplary illustration of a cleaning system comprising removal units, arranged in the supply position, in the case of a printing unit comprising a cylindrical printing substrate guide element.
Figure 12B:
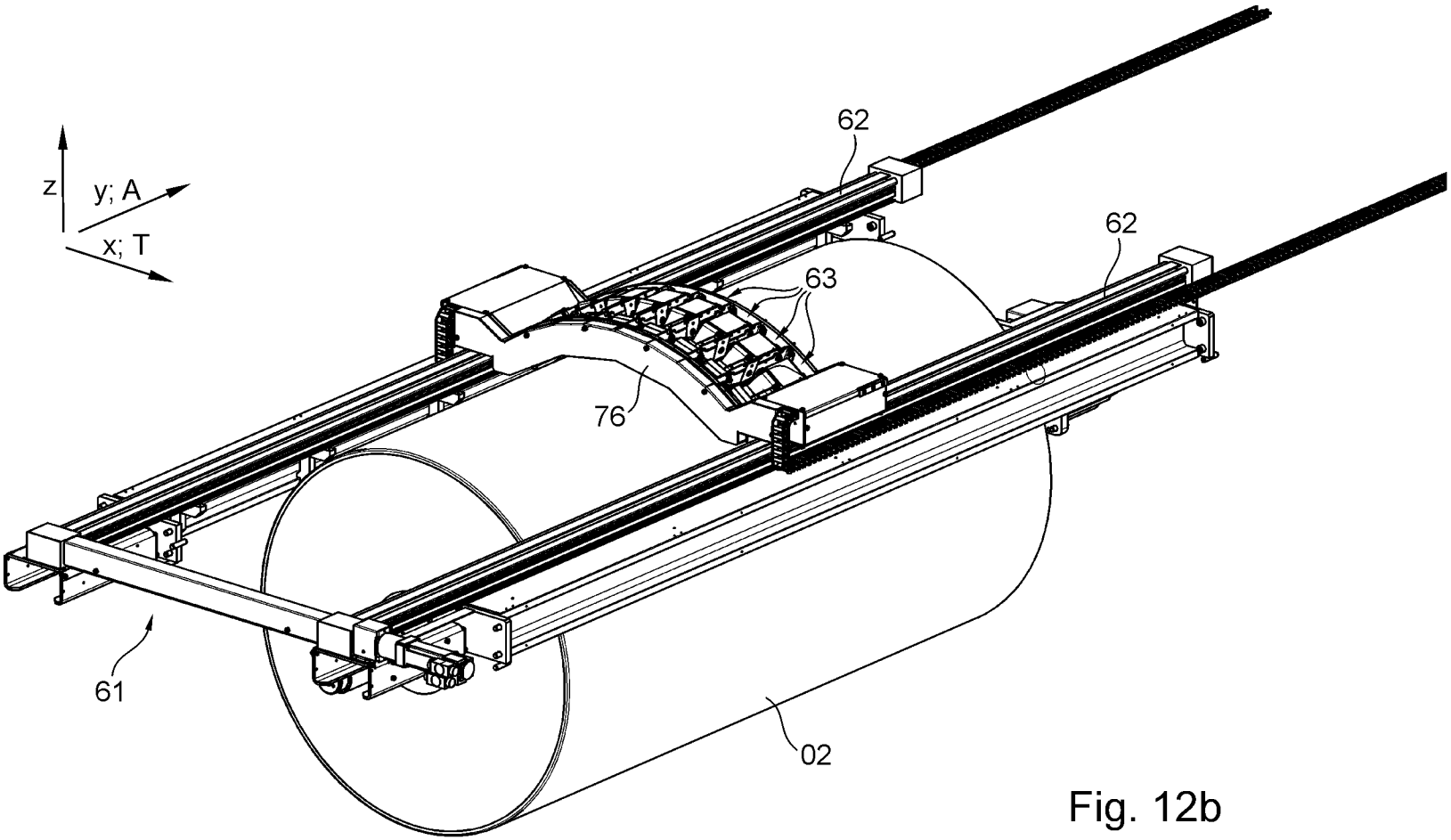
FIG. 12*b* shows an exemplary illustration of the cleaning system from FIG. 12*a*, comprising removal units arranged in the at least one operating position.
Figure 13A:
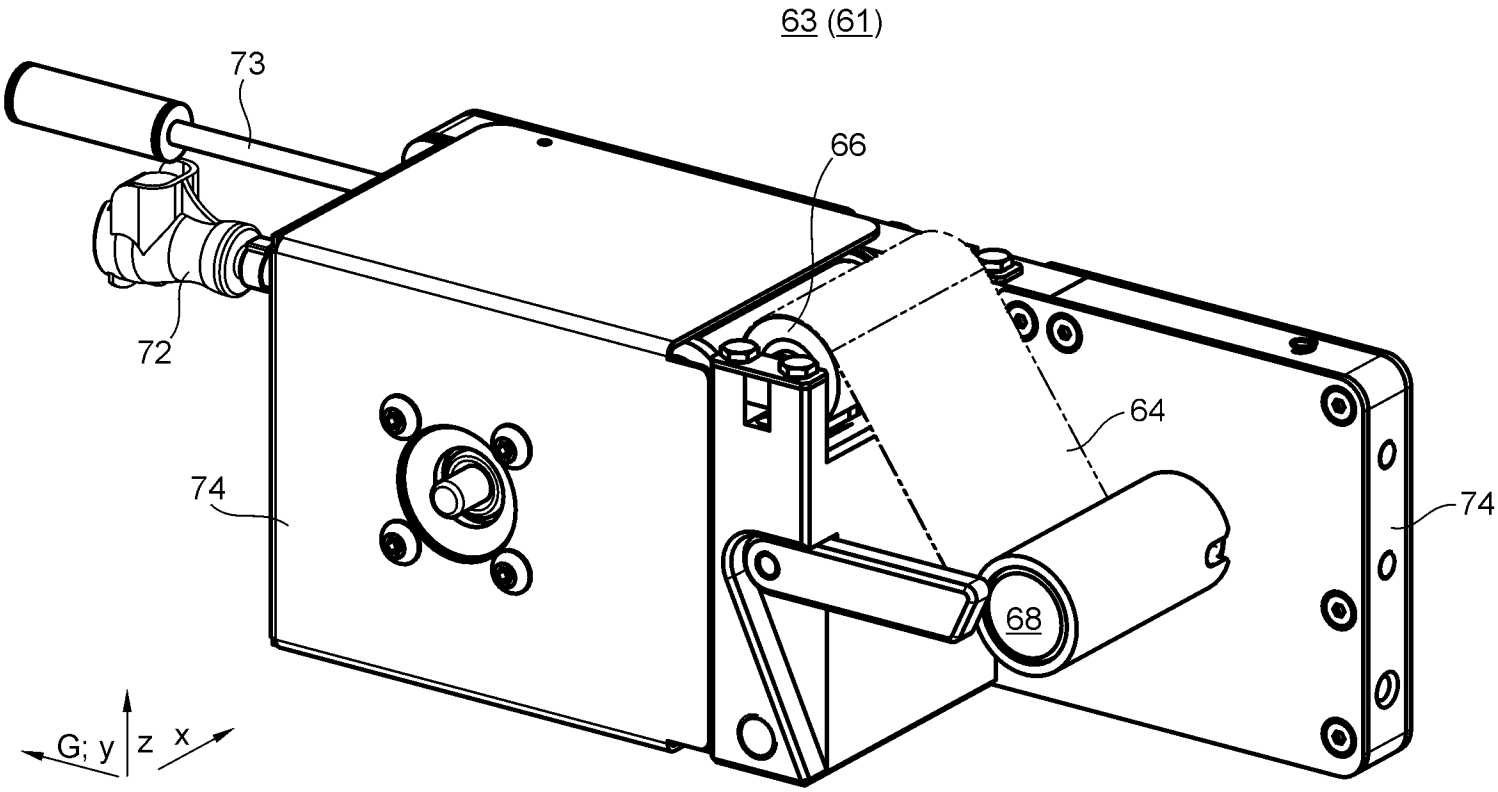
FIG. 13*a* shows an exemplary removal unit in a three-dimensional illustration, comprising a reservoir of contact element arranged in a housing.
Figure 13B:
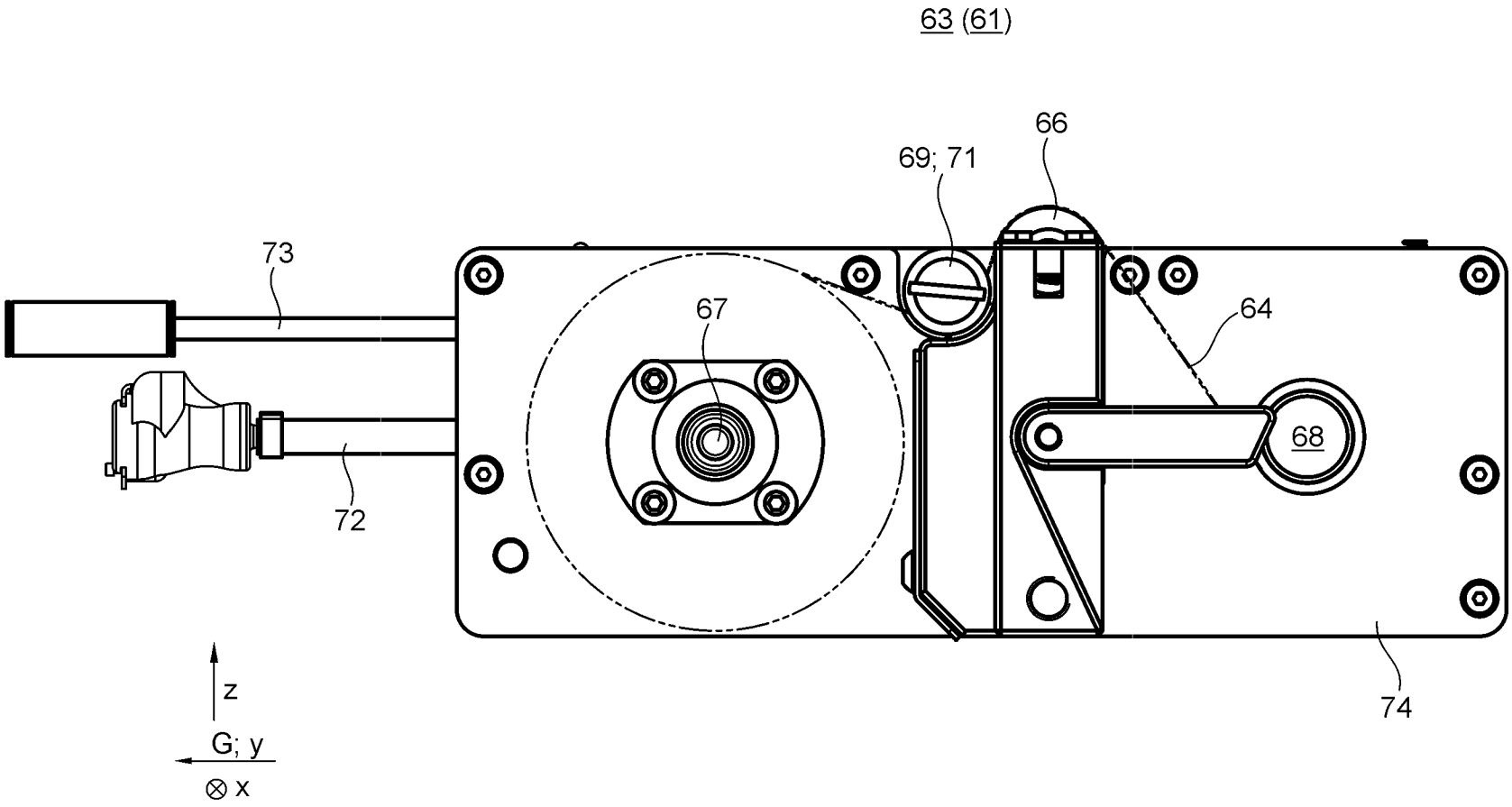
FIG. 13*b* shows an exemplary removal unit from FIG. 13*a* in a lateral sectional view.
Figure 13C:
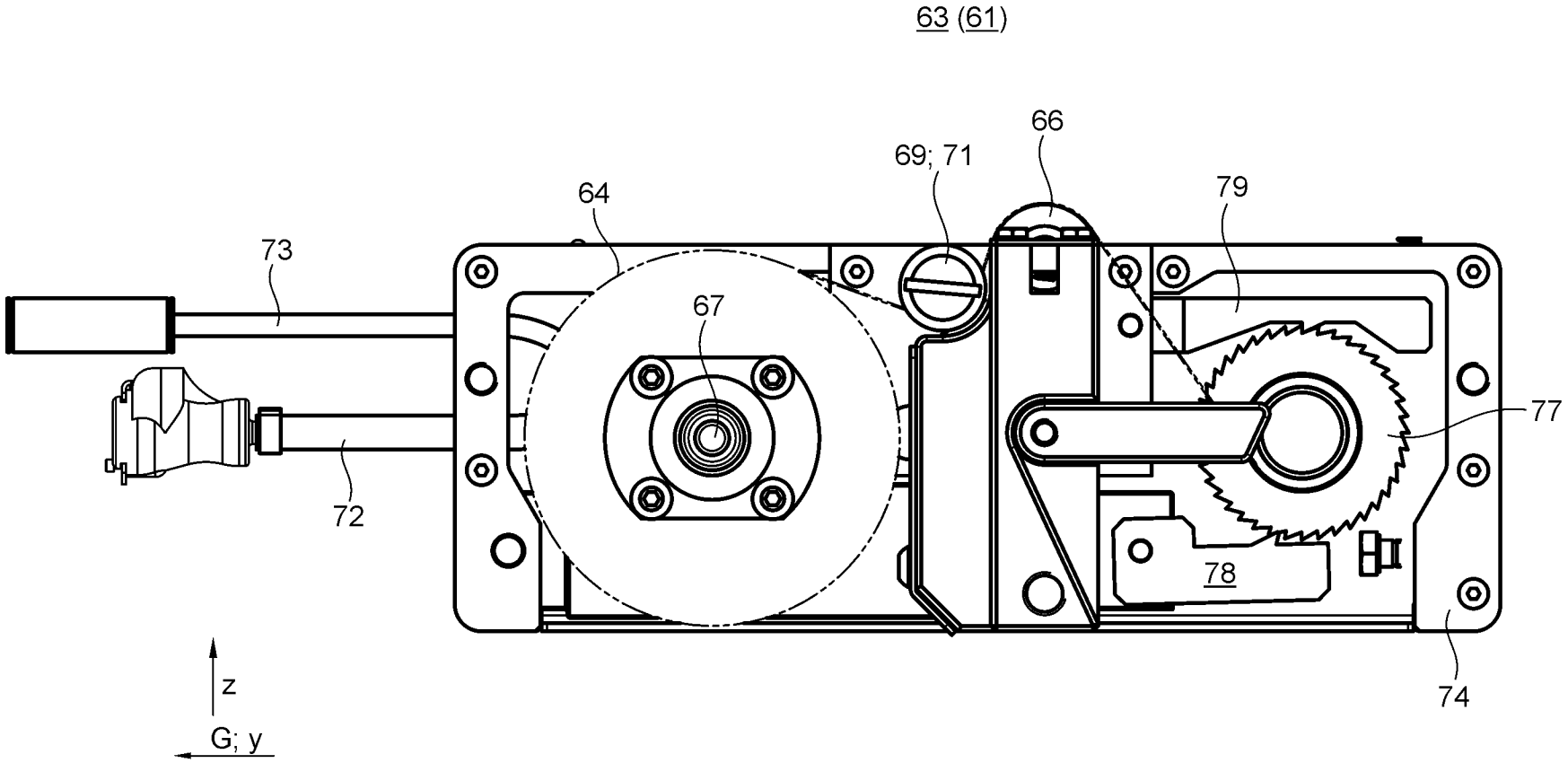
FIG. 13*c* shows an exemplary removal unit from FIG. 13*a* and FIG. 13*b* in another lateral sectional view.
Figure 13D:
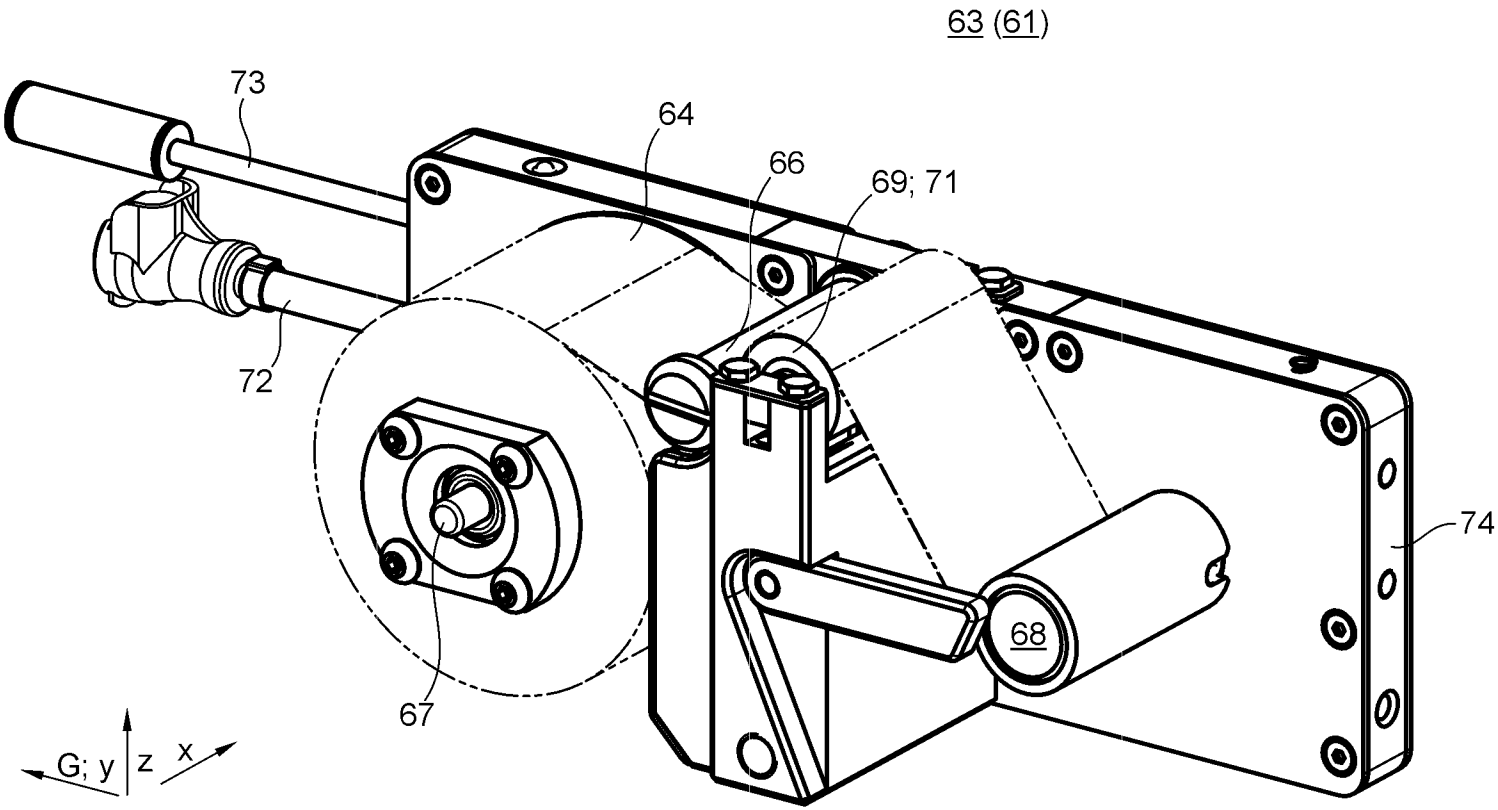
FIG. 13*d* shows an exemplary removal unit from FIG. 13*a* to FIG. 13*c* in a three-dimensional illustration, with the reservoir being opened.
Figure 14:
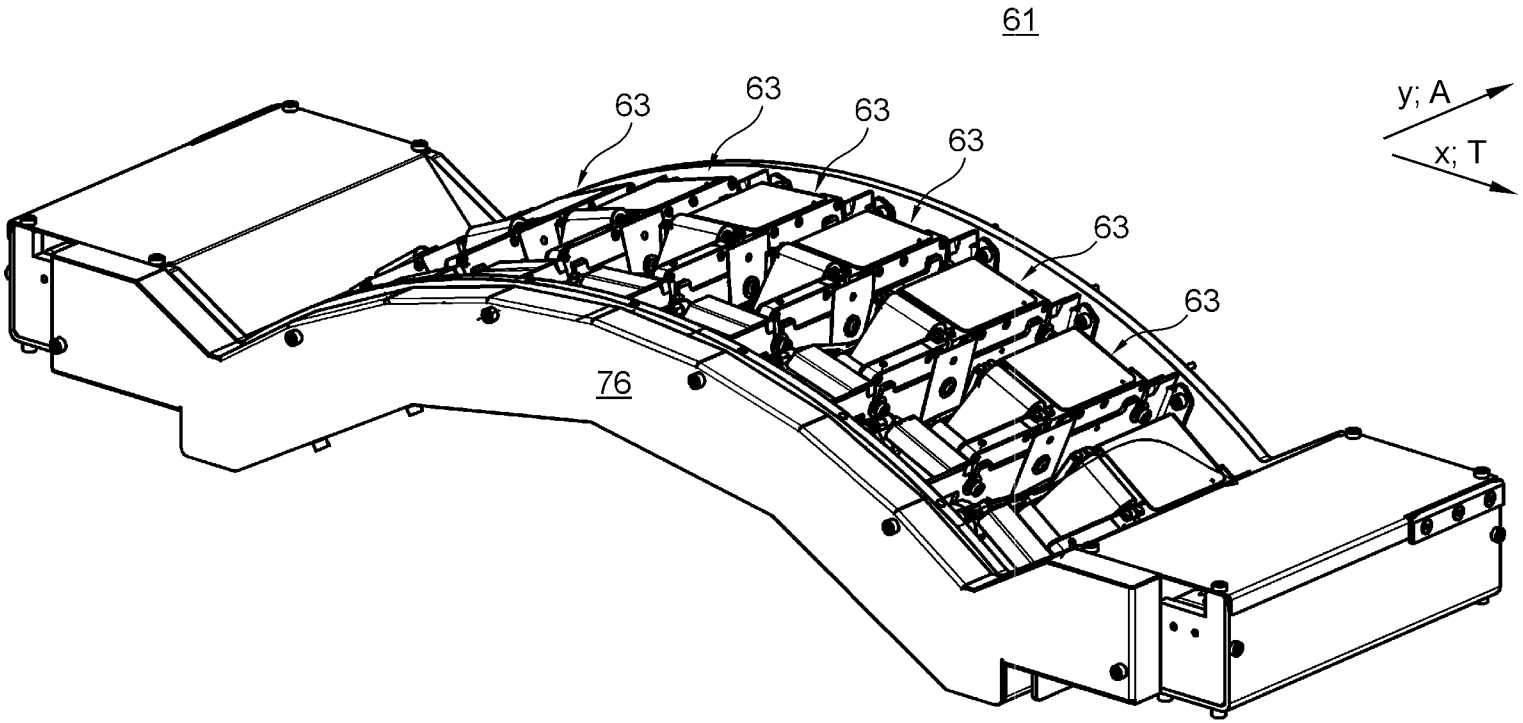
FIG. 14 shows multiple exemplary removal units on a shared carrier.
Figure 15:
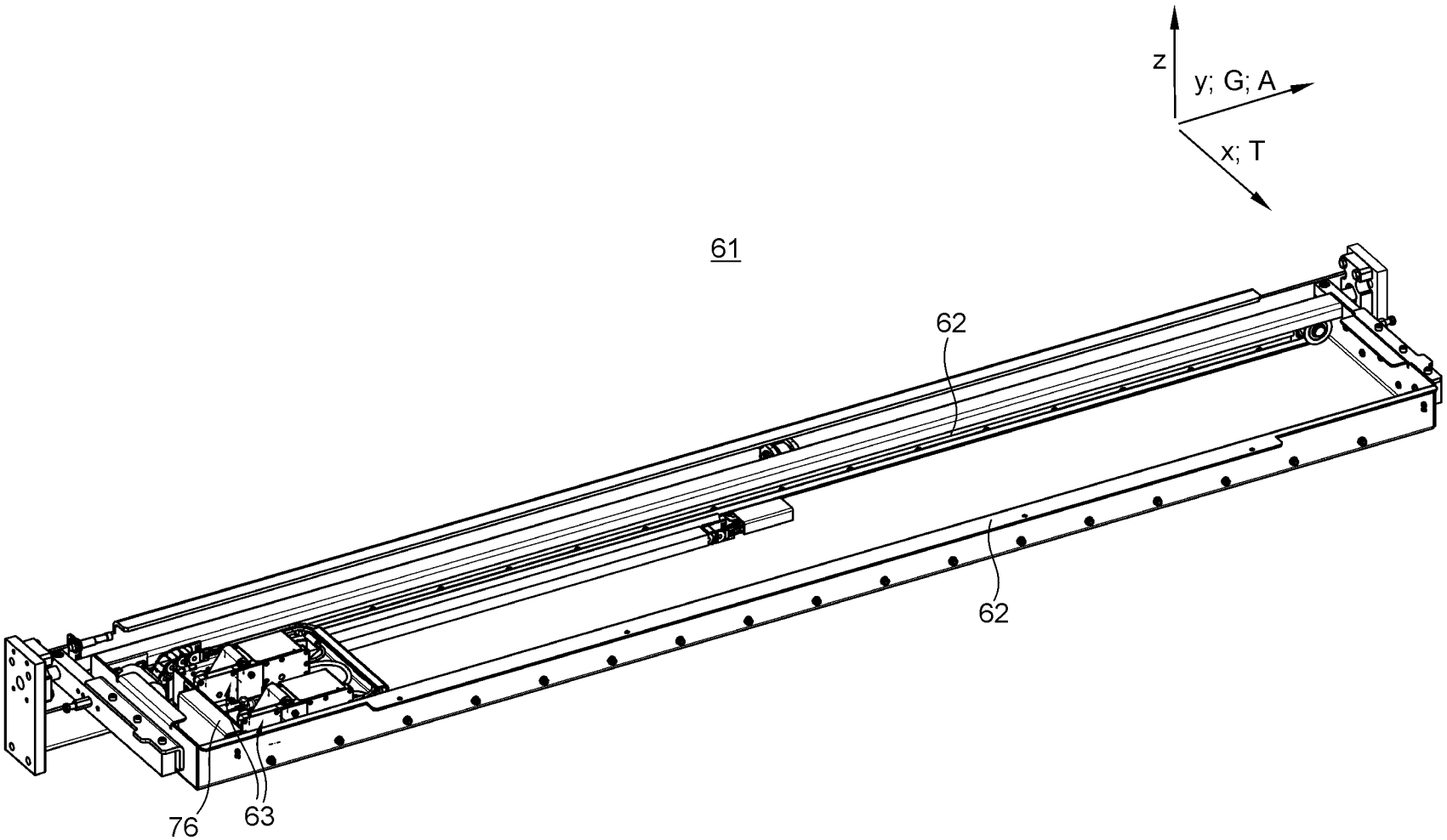
FIG. 15 shows an alternative exemplary cleaning system, comprising two removal units arranged horizontally next to one another, in the case of a printing unit having a linear transport path in the x direction.
Figure 16A:
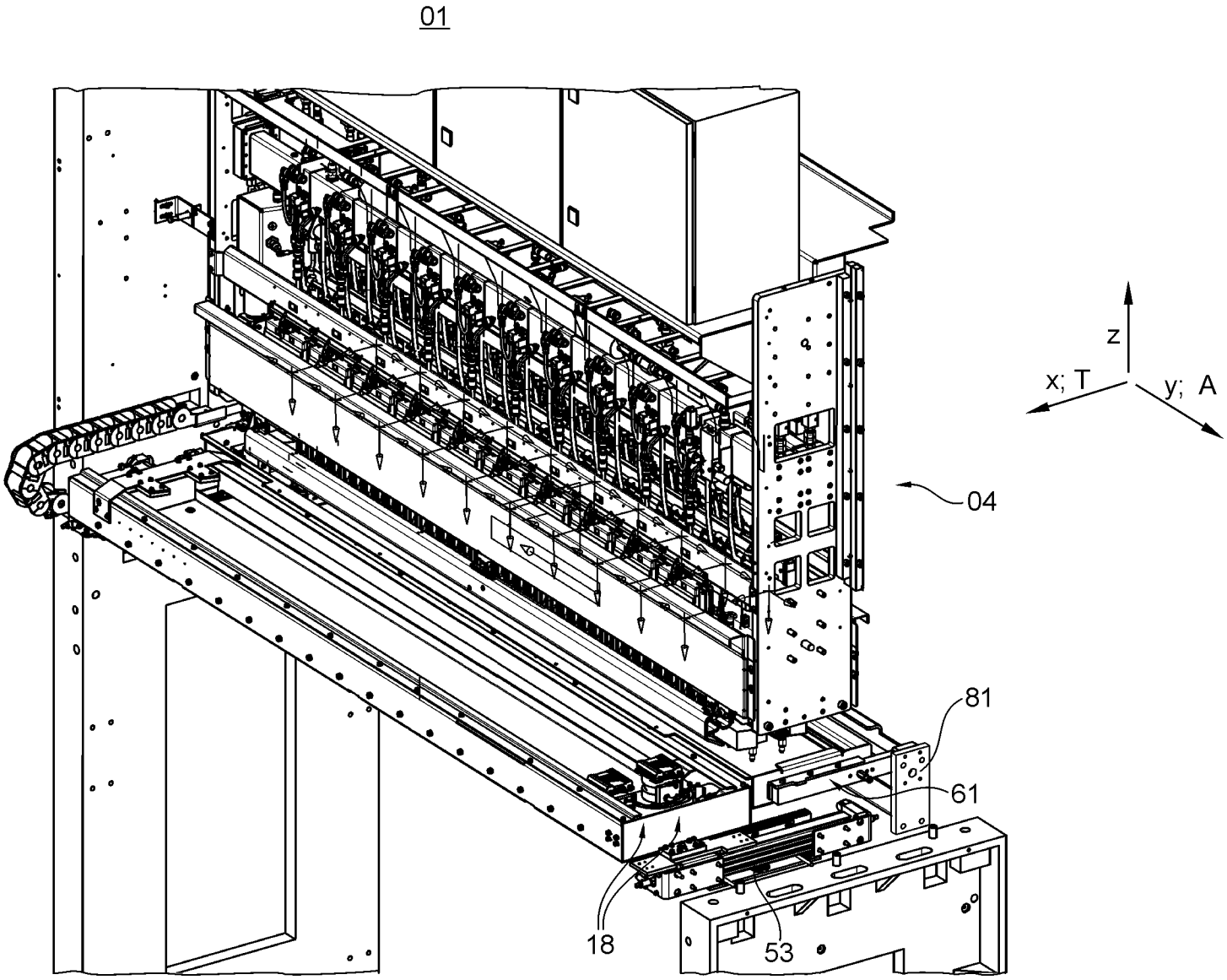
FIG. 16*a* shows another alternative embodiment of a printing unit having a linear transport path in the x direction, the printing unit comprising at least one cleaning device in a storage position and at least one cleaning system operating position.
Figure 16B:
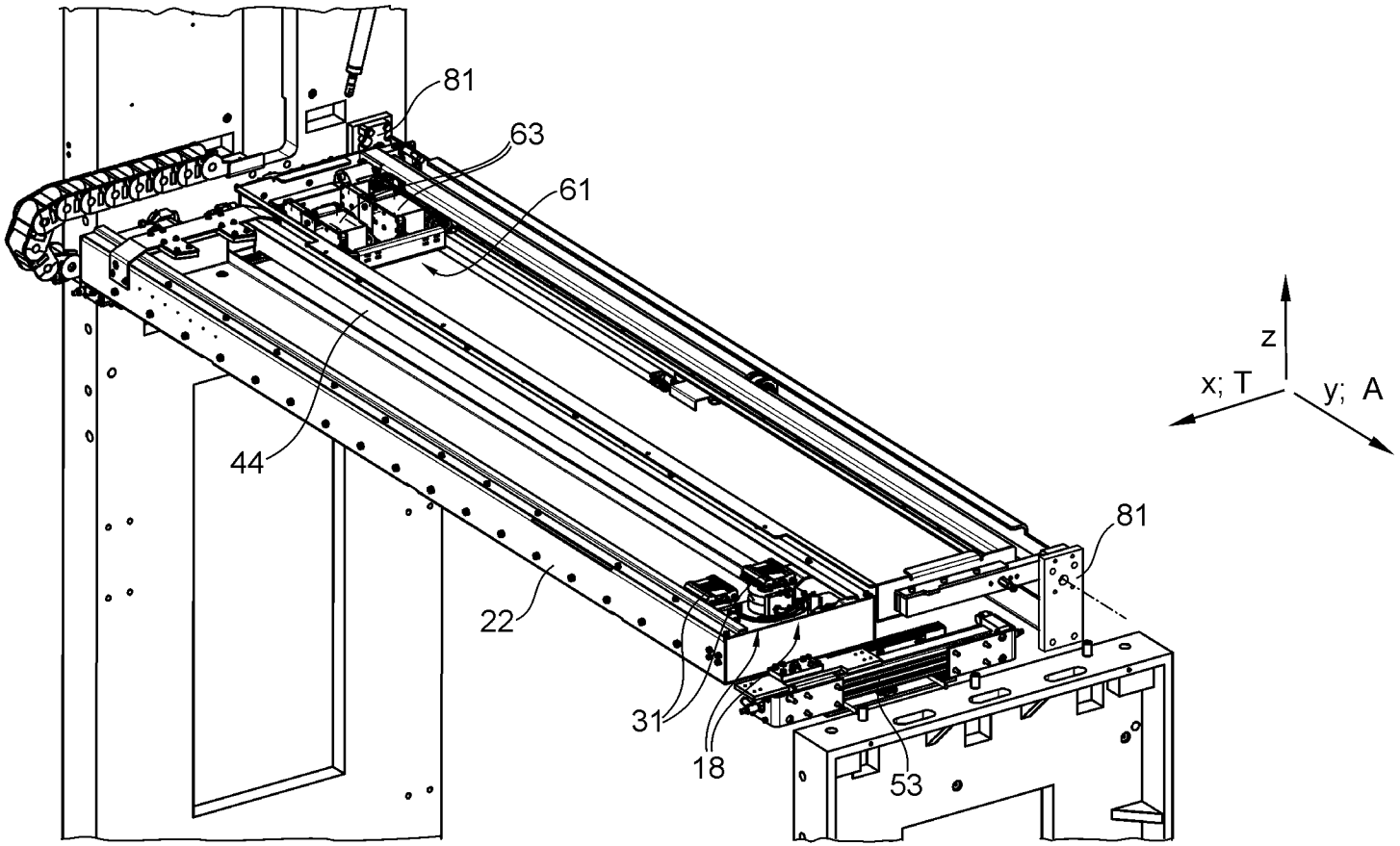
FIG. 16*b* shows another illustration of the printing unit having a linear transport path in the x direction from FIG. 16*a*, the nozzle bar being hidden.
Figure 16C:
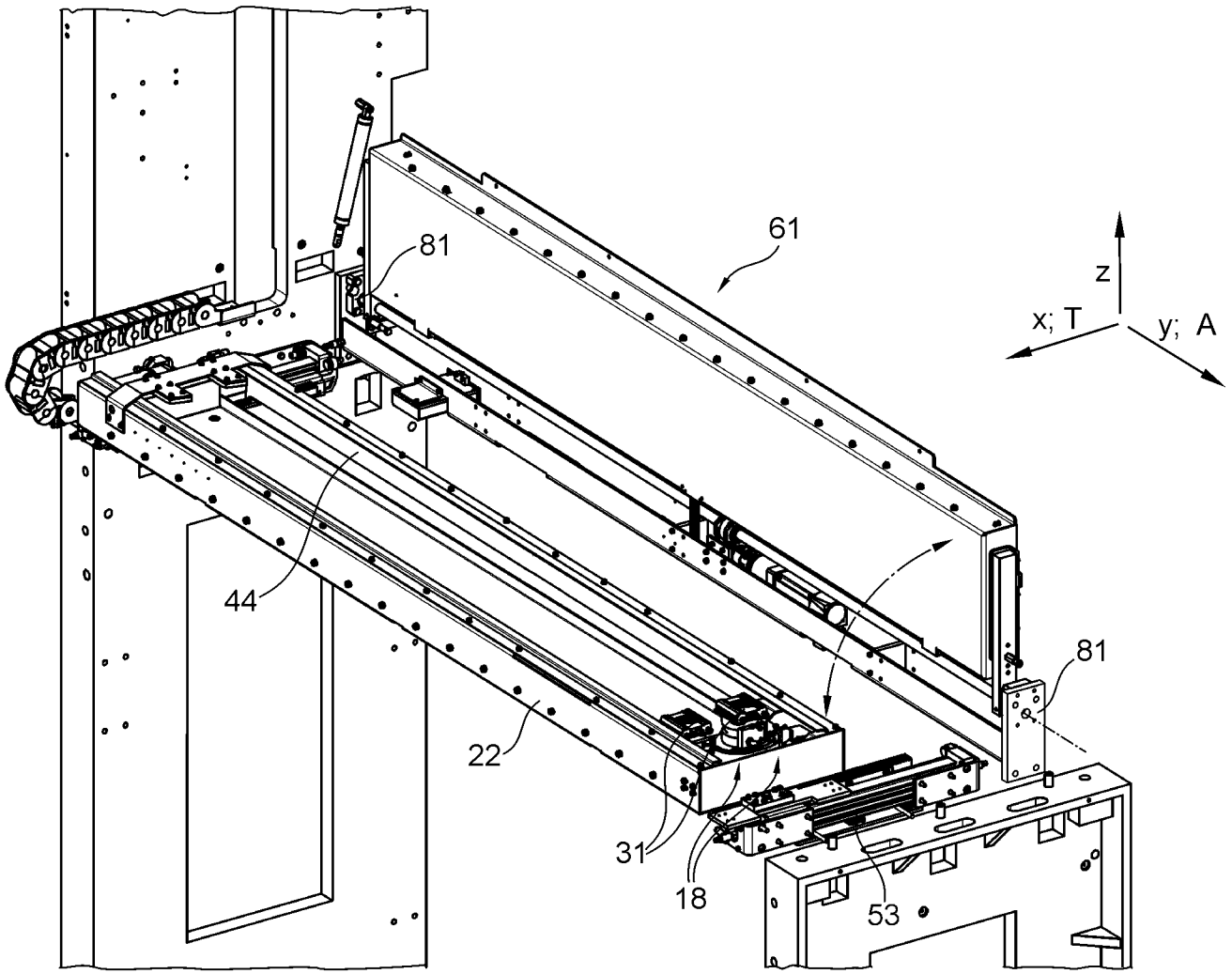
FIG. 16*c* shows another illustration of the printing unit having a linear transport path in the x direction from FIG. 16*a* or FIG. 16*b*, the cleaning system being pivoted into its supply position, and the cleaning device being arranged in its storage position.
Figure 16D:
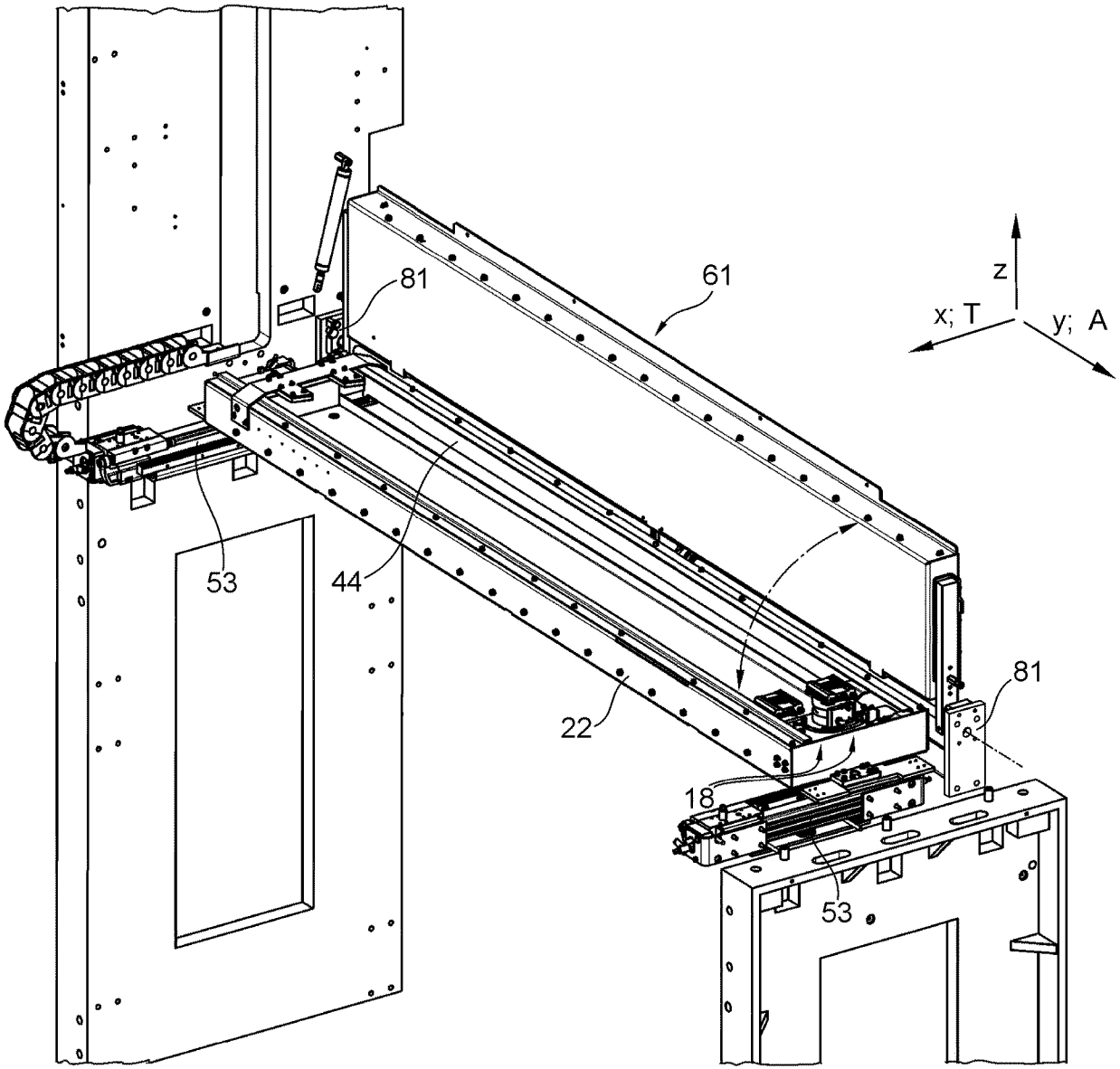
FIG. 16*d* shows another illustration of the printing unit having a linear transport path in the x direction from FIG. 16*a*, FIG. 16*b* or FIG. 16*c*, the cleaning system being pivoted into its supply position, and the cleaning device being arranged in its usage position.
Figure 17A:
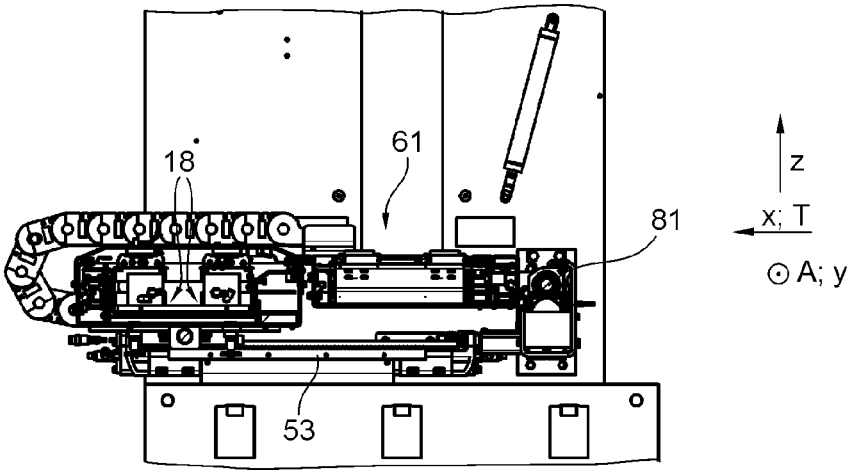
FIG. 17*a* shows a side view of the printing unit having a linear transport path in the x direction corresponding to FIG. 16*a* or FIG. 16*b*, the cleaning system being arranged in the operating position, and the cleaning device being arranged in the storage position.
Figure 17B:
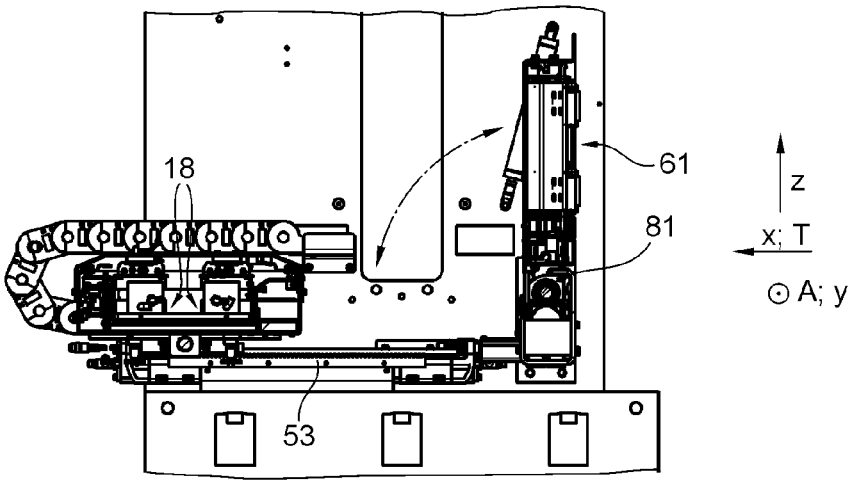
FIG. 17*b* shows a side view of the printing unit having a linear transport path in the x direction corresponding to FIG. 16*c*, the cleaning system being pivoted into its supply position, and the cleaning device being arranged in its storage position.
Figure 17C:
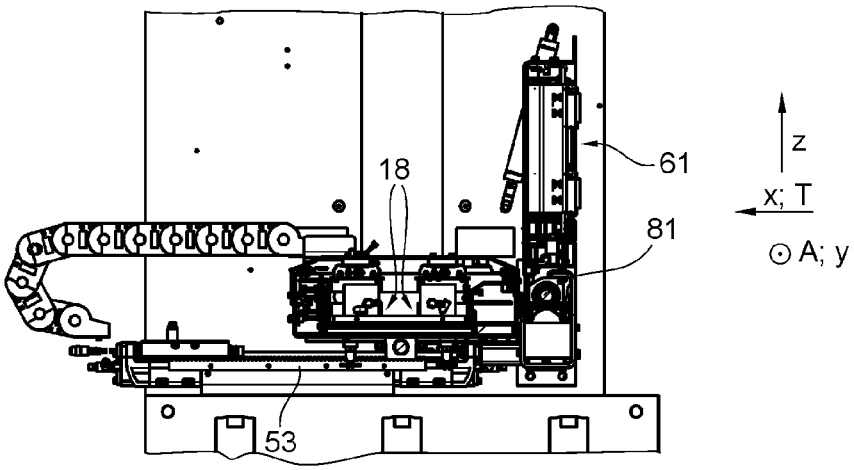
FIG. 17*c* shows a side view of the printing unit having a linear transport path in the x direction corresponding to FIG. 16*d*, the cleaning system being pivoted into its supply position, and the cleaning device being arranged in its usage position.

FIG. 5*a*, by way of example, shows a corresponding cleaning device 18 in the usage position, which is preferably assigned to a nozzle bar 04 in the first service position. For the sake of clarity, only four print heads 08 of the relevant nozzle bar 04 are shown.

The at least one cleaning device 18 preferably comprises at least one cleaning guide 44 and/or the at least one cleaning drive 21 and/or the at least one collecting trough 22 and/or at least one support system 23; 24 and/or at least one cleaning unit 26, preferably at least one cleaning unit 26 per row of print heads 08 in the y direction of the relevant nozzle bar 04.

The at least one support system 23; 24 is preferably in each case configured as at least one positioning aid 23 and/or as at least one cleaning aid 24. In a preferred embodiment, the at least one cleaning device 18 comprises at least two cleaning elements 31. In this way, the at least one cleaning device 18 is preferably configured to clean, in particular simultaneously, at least two print heads 08, in particular a multiplicity of print heads 08, of the at least one nozzle bar 04. For example, the at least two print heads 08 are preferably simultaneously cleaned in different rows, preferably in at least two rows, of print heads 08 of the at least one nozzle bar 04.

Preferably, the at least one cleaning device 18 has an extension in the transverse direction A that is at least as large as the working width of the at least one nozzle bar 04 in the transverse direction A. In this way, preferably the at least two print heads 08, preferably all exit surfaces 09 of all print heads 08, more preferably in addition or as an alternative to the exit surfaces 09, the bearing surfaces 11 of the print heads 08, of the at least one nozzle bar 04 are cleaned in one operation. Preferably, the at least one cleaning device 18, in the transport direction T of the printing substrate 03, has an extension that is at least as large as the extension of the surface of the at least one print head 08 of the at least one nozzle bar 04 in the transport direction T.

Preferably, the at least one cleaning device 18, in the transport direction T of the printing substrate 03, has an extension that is at least as large as the extension of a projection of the surface of the at least one print head 08 of the at least one nozzle bar 04 in the plane of the exit surface 09 in the transport direction T. More preferably, at least the at least one cleaning element 31, in the transport direction T of printing substrate 03, has an extension that is at least as large as the extension of a projection of the surface of the at least one print head 08 of the at least one nozzle bar 04 into the plane of the exit surface 09 in the transport direction T. Preferably, the extension of the at least one cleaning device 18 in the transport direction T is at least greater than the extension of at least two rows of print heads 08 of the at least one nozzle bar 04 in the transport direction T. Preferably, the at least one cleaning device 18 thus at least temporarily encloses the at least two rows of print heads 08 of the nozzle bar 04 arranged in the first or third service position.

The at least one cleaning unit 26 is preferably arranged so as to be movable and/or move along the cleaning guide 44, for example by means of the cleaning drive 21. More preferably, the at least one cleaning unit 26 is arranged so as to be movable and/or is moved in and/or counter to a cleaning direction G, in particular along the cleaning guide 44. The at least one collecting trough 22 is preferably arranged so as to at least partially enclose the at least one cleaning unit 26. More preferably, the collecting trough 22 is arranged such that the collecting trough 22 at least partially encloses the cleaning unit 26 and the at least one print head 08 of the relevant nozzle bar 04 which is arranged in the first service position or third service position.

The at least one cleaning unit 26 preferably comprises at least one mounting element 28, preferably at least two mounting elements 28, and/or at least one force element 29 and/or at least one carrier 27 and/or the at least one cleaning element 31. Preferably, the at least one mounting element 28, preferably at least two mounting elements 28, and/or the at least one force element 29 and/or the at least one carrier 27 and/or the at least one cleaning element 31 are preferably fixedly connected to one another within the corresponding cleaning unit 26.

The at least one mounting element 28 is, in particular the at least two mounting elements 28 are, preferably in direct contact with the at least one force element 29. The at least one force element 29 is, for example, configured as a bellows and/or hollow object and/or spring, and is preferably settable in terms of its extension and/or dimension in the z direction, preferably in a direction whose main component corresponds to the z direction. The at least one carrier 27 is preferably configured as a base body and/or preferably carries the at least one mounting element 28, preferably at least two mounting elements 28, and/or the at least one force element 29 and/or the at least one cleaning element 31 of the corresponding cleaning unit 26. The at least one cleaning element 31 is preferably arranged so as to be in direct contact with at least one mounting element 28, preferably at least two mounting elements 28. Preferably, the extension and/or dimension of the cleaning unit 26 in the z direction, more preferably in a direction whose main component corresponds to the z direction, can be set and/or changed and/or moved by way of a change of the extension and/or dimension of the at least one force element 29 of the relevant cleaning unit 26. As a result of this movability, the at least one cleaning element 31 can preferably be brought in contact and/or moved out of contact with other components, wherein in particular the at least one print head 08 and/or the at least one support system 23; 24 could be such components.

In a preferred embodiment, the at least one cleaning unit 26 comprises the at least one cleaning element 31, which is connected to the at least one carrier 27 by way of the at least one force element 29, preferably by way of at least four force elements 29, for example by way of exactly four force elements 29. Preferably, the at least one force element 29, in particular the at least four force elements 29, are each configured as a spring. Preferably, the at least one cleaning element 31 is preferably floatingly supported and/or attached in the at least one carrier 27, which is preferably configured as a base body, by the at least one force element 29. This preferably allows the contact pressure to be set precisely and easily, which the assigned nozzle bar 04 preferably exerts, when lowered into the service position and/or when arranged, in the service position, on the at least one cleaning element 31, in particular on at least one sliding point 32 of the cleaning element 31.

Preferably, the cleaning device 18 comprises at least one positioning aid 23 that is different from each print head 08, which preferably includes at least one contact surface that is oriented in the same direction as the at least one bearing surface 11 and/or exit surface 09 of the at least one print head 08. Preferably, the at least one contact surface of the positioning aid 23, preferably with respect to the cleaning direction G, is situated following or spaced apart from the at least one bearing surface 11 of a relevant print head 08. More preferably, the contact surface of the positioning aid 23 has an identical component in the z direction as the exit surface 09 of a print head 08 to be cleaned by way of the corresponding cleaning element 31. In particular when direct contact is provided between the at least one cleaning element 31 and the exit surface 09 of a print head 08 of the relevant nozzle bar 04, the contact surface of the positioning aid 23 is oriented in the same direction as the at least one exit surface 09. If, for example, direct contact is provided between the at least one cleaning element 31 and the exit surface 09 of a print head 08 of the relevant nozzle bar 04, the cleaning element 31 is preferably configured as a contact element, for example as a wiper. In particular when only indirect contact is provided between the at least one cleaning element 31 and the exit surface 09 of a print head 08 of the relevant nozzle bar 04, the contact surface of the positioning aid 23 is oriented in the same direction as the at least one bearing surface 11, in particular the at least one spacer surface 11. The at least one positioning aid 23 is preferably arranged in such a way that the at least one cleaning element 31 is arranged so as to be unambiguously positionable with respect to at least one print head 08, which is in particular to be cleaned.

The at least one cleaning device 18 preferably comprises at least one cleaning aid 24. The cleaning aid 24 is preferably configured in such a way that the at least one cleaning element 31 can be cleaned. The cleaning aid 24 preferably comprises at least one spraying device and/or at least one wiping device.

The at least one cleaning element 31 is preferably configured as a cleaning head 31. The cleaning element 31 is preferably fixedly connected to the at least one mounting element 28 and/or the at least one carrier 27 of the relevant cleaning device 18, in particular of the relevant cleaning unit 26. The at least one cleaning element 31 is preferably arranged to be movable in and/or counter to the cleaning direction G.

The cleaning head 31 preferably comprises at least one fluid input 38 and at least one fluid removal opening 39; 41. The at least one fluid input 38 is more preferably configured as at least one fluid input 38 for supplying cleaning liquid. The at least one fluid removal opening 39; 41 is more preferably configured as at least one fluid removal opening 39; 41 for cleaning liquid and/or dirt. More preferably, the cleaning head 31 includes at least two fluid removal openings 39; 41, wherein in each case a first fluid removal opening 39 is preferably configured as a fluid discharge 39 and/or wherein in each case a second fluid removal opening 41 is preferably configured as a fluid extraction 41. Preferably, the at least one first fluid removal opening 39 at least partially, and more preferably completely, surrounds the at least one fluid input 38 in a plane.

If, for example, the cleaning head 31 is arranged so as to be in direct or indirect contact with the at least one print head 08, for example, the at least one fluid input 38 is configured to dispense at least one cleaning fluid, in particular a cleaning agent, in the immediate vicinity of the exit surface 09 of the at least one print head 08 and/or of a positioning gap 07, and the at least one fluid removal opening 39; 41 is configured to extract the at least one cleaning fluid again, likewise in the immediate vicinity of the exit surface 09 of the at least one print head 08 and/or of a positioning gap 07. For this purpose, the cleaning head 31 is preferably brought so close to the at least one print head 08 that a cleaning gap is formed between the cleaning head 31 on the one hand, and the exit surface 09 of the print head 08 on the other hand, through which the fluid, in particular the cleaning liquid, flows and, as a result, the exit surface 09 of the at least one print head 08 and/or a positioning gap 07 are cleaned and/or can be cleaned.

The at least one cleaning head 31 preferably includes at least one sliding point 32 that is in particular intended for contact with the at least one print head 08, wherein the sliding point 32 is preferably configured as a sliding surface 32. The at least one sliding point 32 is preferably configured for at least partial contact with at least a portion of at least one bearing surface 11 of the at least one print head 08, which more preferably is configured as at least one spacer surface 11.

The at least one cleaning head 31 preferably comprises at least one ramp 33; 34. More preferably, the cleaning head 31 comprises at least one first ramp 33 and at least one second ramp 34. This preferably facilitates a positioning of the at least one cleaning element 31 at the at least one print head 08 and/or the movement of the at least one cleaning element 31 along the at least one nozzle bar 04, for example during a cleaning process. Preferably, the at least one cleaning element 31 can be arranged in at least one first position and/or can be arranged in at least one second position, wherein the first position of the cleaning element 31 is arranged spaced apart from the second position of the cleaning element 31, preferably along the cleaning direction G. For example, the first ramp 33 and/or the second ramp 34 are embodied as oblique surfaces.

The first ramp 33 is preferably configured as an input ramp 33. The first ramp 33 is preferably arranged so as reduce the distance between a reference point of the first ramp 33 and the print head 08 to be cleaned. The reference point of the first ramp 33 is preferably a point of the first ramp 33 that is arranged perpendicularly to the print head 08 to be cleaned. In the first position of the cleaning element 31, the first ramp 33 preferably has a first distance with respect to a print head 08 to be cleaned, preferably with respect to at least one exit surface 09 and/or spacer surface 11 to be cleaned, at the reference point of the first ramp 33. In the second position of the cleaning element 31, the first ramp 33 preferably has a second distance with respect to a print head 08 to be cleaned, preferably with respect to at least one exit surface 09 and/or spacer surface 11 to be cleaned, at the reference point of the first ramp 33, wherein the second distance between the reference point of the first ramp 33 and the print head 08 to be cleaned is less than the first distance between the reference point of the first ramp 33 and the print head 08 to be cleaned.

The second ramp 34 is preferably configured as an exit ramp 34. The second ramp 34 is preferably arranged so as increase the distance between a reference point of the second ramp 34 and the print head 08 to be cleaned. The reference point of the second ramp 34 is preferably a point of the second ramp 34 that is arranged perpendicularly to the print head 08 to be cleaned. In the first position of the cleaning element 31, the second ramp 34 preferably has a first distance with respect to a print head 08, which is in particular to be cleaned, preferably with respect to at least one exit surface 09 and/or spacer surface 11 to be cleaned, at the reference point of the second ramp 34. In the second position of the cleaning element 31, the second ramp 34 preferably has a second distance with respect to a print head 08, which is in particular to be cleaned, preferably with respect to at least one exit surface 09 and/or spacer surface 11 to be cleaned, at the reference point of the second ramp 34, wherein the second distance between the reference point of the second ramp 34 and the print head 08, which is in particular to be cleaned, is greater than the first distance between the reference point of the second ramp 34 and the print head 08, which is in particular to be cleaned.

As an alternative or in addition, the at least one print head 08 and/or the at least one cleaning head 31 comprise at least one guide device 36. This guide device 36 is preferably configured as a guide surface 36, whose surface normal has at least one component that is orthogonal to the z direction and to the cleaning direction G. The at least one guide surface 36 of a cleaning head 31 preferably directly abuts at least one sliding surface 32 of the respective cleaning head 31. The at least one guide device 36 is preferably arranged such that the cleaning head 31 can be positioned and/or is positioned with respect to a direction that is oriented parallel to the x direction and/or orthogonal to the cleaning direction G and orthogonal to the z direction in a tolerance range or an exact position.

The cleaning head 31 comprises at least one cleaning area 37. The at least one cleaning area 37 includes the at least one fluid input 38 configured as at least one fluid supply opening 38. The at least one cleaning area 37 preferably includes the at least one fluid input 38 and the at least one fluid removal opening 39; 41. More preferably, the cleaning area 37 in each case includes the at least one fluid input 38 and/or the at least one fluid discharge 39 and/or the at least one fluid extraction 41. The at least one fluid removal opening 39; 41 is preferably in each case connected to at least one trough for removing, for example, cleaning agents and/or dirt and/or particles. The at least one fluid input 38 is preferably connected to a source of cleaning agent. The fluid input 38 is configured as a fluid supply opening 38 within the cleaning area 37. The at least one cleaning area 37 is preferably arranged between the at least one first ramp 33 and the at least one second ramp 34. In particular, the at least one first ramp 33 is arranged upstream from the at least one cleaning area 37 in the cleaning direction G. The at least one second ramp 34 is preferably arranged downstream from the at least one cleaning area 37 in the cleaning direction G. The first ramp 33 preferably inclines from an outer edge of the cleaning element 31 to the at least one cleaning area 37. The second ramp 34 preferably inclines from an outer edge of the cleaning element 31 to the at least one cleaning area 37. The slopes of the first ramp 33 and of the second ramp 34 are preferably oriented opposite one another.

The fluid supply opening 38 preferably has at least one delimitation of the fluid supply opening 38 in a plane of the surface of the cleaning area 37, preferably orthogonal to the z direction, with a centroid. More preferably, the delimitation of the fluid supply opening 38 includes at least one first delimiting point, which is arranged with the centroid in alignment with respect to the cleaning direction G. Preferably, the delimitation of the fluid supply opening 38 includes at least one second delimiting point, which is arranged with the centroid in alignment with respect to a direction that is orthogonal to the cleaning direction G. The delimitation of the fluid supply opening 38 preferably includes at least one third delimiting point, which is arranged on the delimitation of the fluid supply opening 38 in an extension of a stretch from the first delimiting point to the centroid. The delimitation of the fluid supply opening 38 preferably includes at least one fourth delimiting point, which is arranged on the delimitation of the fluid supply opening 38 in an extension of a stretch from the second delimiting point to the centroid. The first delimiting point and the second delimiting point and the third delimiting point and the fourth delimiting point are each preferably positioned spaced apart from one another by a distance of greater than zero on the delimitation of the fluid supply opening 38. The distance between the first delimiting point and the third delimiting point on the delimitation of the fluid supply opening 38 is preferably less than the distance between the second delimiting point and the fourth delimiting point on the delimitation of the fluid supply opening 38. A longitudinal direction of the fluid supply opening 38 is preferably at least partially orthogonal to a straight line between the first delimiting point and the center of gravity of the delimitation of the fluid supply opening 38. In other words, for example, the at least one fluid supply opening 38, in particular the delimitation of the fluid supply opening 38, preferably has the longitudinal direction of the fluid supply opening 38 and a transverse direction of the fluid supply opening 38 in the plane spanned by the x direction and the y direction, and/or orthogonal to the z direction. The extension of the fluid supply opening 38 preferably differs in its longitudinal direction and in its transverse direction. The fluid supply opening 38, in particular the delimitation of the fluid supply opening 38, preferably has a maximum extension in its longitudinal direction. The extension of the fluid supply opening 38, in particular the delimitation of the fluid supply opening 38, is preferably less in the transverse direction of the fluid supply opening 38 than in its longitudinal direction.

In an exemplary embodiment, a cleaning area 37 includes at least two fluid supply openings 38, each having a delimitation of the respective fluid supply opening 38 in a plane of the surface of the cleaning area 37. Each of the at least two fluid supply openings 38 has a centroid, wherein the centroids of the fluid supply openings 38 are preferably arranged on a straight line. The straight line of the at least two centroids of the fluid supply openings 38 is preferably arranged at least partially orthogonally to the cleaning direction G and orthogonally to the z direction.

Preferably, a tangent at the first delimiting point of the delimitation of the fluid supply opening 38 is preferably arranged at least partially orthogonally to the cleaning direction G and orthogonally to the z direction. The tangent at the first delimiting point of the delimitation of the fluid supply opening 38 preferably has a plane angle of at least 50°, preferably of at least 60°, and of no more than 130°, preferably of no more than 120°, with respect to the cleaning direction G in a positive mathematical direction of rotation, this meaning counterclockwise. The tangent at the first delimiting point of the delimitation of the fluid supply opening 38 is preferably parallel to a plane that is spanned at the position of the positioning gap 07, for example shifted along the y direction, by the z direction and at least one direction of the shortest delimitation of a respective exit surface 09, which is spanned in a plane of the x direction and y direction, of the print head 08 of the relevant nozzle bar 04 to be cleaned, which delimits the positioning gap 07.

The tangent at the first delimiting point of the delimitation of the fluid supply opening 38 is preferably parallel to a longitudinal direction of the fluid supply opening 38, in particular in the case of a fluid supply opening 38 that, for example, is configured to be elongated and/or oval and/or slot-shaped and/or as a groove and/or in a shape other than circular. More preferably, the longitudinal direction of the fluid supply opening 38 is oriented parallel to at least one positioning gap 07 of the assigned nozzle bar 04. The longitudinal direction of the fluid supply opening 38 is preferably situated in a plane that is spanned by the x direction and the y direction. Preferably, the fluid supply opening 38 is configured as a groove and/or in an elongated and/or oval and/or slot-shaped manner, preferably in the plane orthogonal to the z direction. A groove preferably has at least two longitudinal sides that are parallel to one another. The longitudinal direction of the fluid supply opening 38 preferably has a preferably plane angle, in particular an opening angle 47, of at least 50°, preferably of at least 60°, and of no more than 130°, preferably of no more than 120°, with respect to the cleaning direction G in a positive mathematical direction of rotation, this meaning counterclockwise. In other words, this means, for example, that the longitudinal direction of the at least one fluid supply opening 38 has an identical oblique position with respect to the longitudinal direction of the at least one positioning gap 07, preferably by the opening angle 47 with respect to the cleaning direction G. In particular, the opening angle 47 thus preferably corresponds to the at least partially diagonal overlap in the x direction of the at least two print heads 08 that are arranged next to one another, and in particular adjacent to one another. From this, it is apparent, for example, that the opening angle 47 is preferably acute or obtuse. This acute or obtuse configuration of the opening angle 47 preferably matches the at least partially diagonal overlap in the x direction of the at least two print heads 08 that are arranged next to one another and/or the orientation of the longitudinal direction of the at least one positioning gap 07.

In a preferred embodiment, the fluid supply opening 38 is oriented parallel to at least one positioning gap 07 of the assigned nozzle bar 04. More preferably, the fluid supply opening 38 is preferably oriented parallel to the at least one positioning gap 07 between at least two print heads 08, which are in particular to be cleaned, preferably within a row, in the y direction of a nozzle bar 04. More preferably, the tangent at the first delimiting point of the delimitation of the fluid supply opening 38 is oriented parallel to at least one positioning gap 07 of the assigned nozzle bar 04. This allows, for example, cleaning agent to optimally enter the positioning gap 07.

The fluid discharge 39 is preferably arranged, in at least one plane, at least partially around the fluid supply opening 38. More preferably, the fluid discharge 39 is arranged, in at least one plane, completely around the fluid supply opening 38. The aforementioned plane is preferably spanned by the x direction and the y direction. The fluid discharge 39 is preferably configured so as to allow to discharge, and/or to discharge, for example, cleaning agent and/or dirt and/or particles, which, for example, adhere to and/or remain as residue at the respective exit surface 09 and/or the respective bearing surface 11, of a relevant print head 08.

The fluid discharge 39 preferably has at least one delimitation of the fluid discharge 39 in a plane of the surface of the cleaning area 37, preferably orthogonal to the z direction, with a centroid. More preferably, the delimitation of the fluid discharge 39 includes at least one fifth delimiting point, which is arranged with the centroid of the delimitation of the fluid discharge 39 in alignment with respect to the cleaning direction G. Preferably, the delimitation of the fluid discharge 39 includes at least one sixth delimiting point, which is arranged with the centroid in alignment with respect to a direction that is orthogonal to the cleaning direction G. Preferably, the delimitation of the fluid discharge 39 includes at least one seventh delimiting point, which is arranged on the delimitation of the fluid discharge 39, in an extension of a stretch from the fifth delimiting point to the centroid. Preferably, the delimitation of the fluid discharge 39 includes at least one eighth delimiting point, which is arranged on the delimitation of the fluid discharge 39, in an extension of a stretch from the sixth delimiting point to the centroid. The fifth delimiting point and the sixth delimiting point and the seventh delimiting point and the eighth delimiting point are each preferably positioned spaced apart from one another by a distance of greater than zero on the delimitation of the fluid discharge 39. The distance between the fifth delimiting point and the seventh delimiting point on the delimitation of the fluid discharge 39 is preferably less than the distance between the sixth delimiting point and the eighth delimiting point on the delimitation of the fluid discharge 39. A longitudinal direction of the fluid discharge 39 is preferably at least partially orthogonal to a straight line between the fifth delimiting point and the center of gravity of the delimitation of the fluid discharge 39. In other words, for example, the at least one fluid discharge 39, in particular the delimitation of the fluid discharge 39, preferably has the longitudinal direction of the fluid discharge 39 and a transverse direction of the fluid discharge 39 in the plane spanned by the x direction and the y direction, and/or orthogonal to the z direction. The extension of the fluid discharge 39 is preferably different in its longitudinal direction and in its transverse direction. The fluid discharge 39, in particular the delimitation of the fluid discharge 39, preferably has a maximum extension in its longitudinal direction. Preferably, the extension of the fluid discharge 39, in particular the delimitation of the fluid discharge 39, is less in the transverse direction of the fluid discharge 39 than in its longitudinal direction.

More preferably, a tangent at the fifth delimiting point of the delimitation of the fluid discharge 39 is at least partially orthogonal to the cleaning direction G and orthogonal to the z direction and, additionally or alternatively, parallel to the corresponding tangent at the first delimiting point of the delimitation of the respective fluid supply opening 38. In addition or as an alternative, the fluid discharge 39 is preferably oriented at least partially orthogonal to the cleaning direction G and orthogonal to the z direction and/or parallel to at least one positioning gap 07 of the assigned nozzle bar 04. The tangent at the fifth delimiting point of the delimitation of the fluid discharge 39 is preferably oriented parallel to the at least one positioning gap 07 of the assigned nozzle bar 04, in particular in a plane of the surface of the cleaning area 37. The tangent at the fifth delimiting point of the delimitation of the fluid discharge 39, which is arranged at least partially orthogonal to the cleaning direction G and orthogonal to the z direction, preferably has a plane angle of at least 50°, preferably of at least 60°, and of no more than 130°, preferably of no more than 120°, with respect to the cleaning direction G in a positive mathematical direction of rotation, this meaning counterclockwise.

The tangent at the fifth delimiting point of the delimitation of the fluid discharge 39 is preferably parallel to a longitudinal direction of the fluid discharge 39, in particular in the case of a fluid discharge 39 that, for example, is configured in an elongated and/or oval and/or slot-shaped manner and/or as a groove and/or trapezoid and/or in a shape other than circular. Preferably, the fluid discharge 39 is configured in a trapezoidal and/or groove-shaped manner and/or as a parallelogram, preferably in the plane orthogonal to the z direction. More preferably, the longitudinal direction of the fluid discharge 39 is oriented parallel to at least one positioning gap 07 of the assigned nozzle bar 04. The longitudinal direction of the fluid discharge 39 preferably has a preferably plane angle, in particular a discharge angle 48, of at least 50°, preferably of at least 60°, and of no more than 130°, preferably of no more than 120°, with respect to the cleaning direction G in a positive mathematical direction of rotation, this meaning counterclockwise. In other words, this means, for example, that the longitudinal direction of the at least one fluid discharge 39 has an identical oblique position with respect to the longitudinal direction of the at least one positioning gap 07, preferably by the discharge angle 48 with respect to the cleaning direction G. In particular, the discharge angle 48 thus corresponds to the at least partially diagonal overlap in the x direction of the at least two print heads 08 that are arranged next to one another, in particular adjacent to one another. From this, it is apparent, for example, that the discharge angle 48 is preferably acute or obtuse. This acute or obtuse configuration of the discharge angle 48 preferably matches the at least partially diagonal overlap in the x direction of the at least two print heads 08 arranged next to one another and/or the orientation of the longitudinal direction of the at least one positioning gap 07. This preferably enables optimal extraction from the at least one positioning gap 07.

For example, a strong negative pressure can be applied to the at least one fluid extraction 41. The fluid extraction 41 is preferably configured to remove at least such cleaning fluid and/or such dirt which has remained after at least one extraction by means of the at least one fluid extraction 39.

The at least one fluid extraction 41 is preferably configured as a relatively narrow slit. The fluid extraction 41 preferably includes at least one delimitation of the fluid extraction 41 in a plane of the surface of the cleaning area 37, preferably orthogonal to the z direction, with a centroid. More preferably, the delimitation of the fluid extraction 41 includes at least one ninth delimiting point, which is arranged with the centroid of the delimitation of the fluid extraction 41 in alignment with respect to the cleaning direction G. Preferably, the delimitation of the fluid extraction 41 includes at least one tenth delimiting point, which is arranged with the centroid in alignment with respect to a direction that is orthogonal to the cleaning direction G. Preferably, the delimitation of the fluid extraction 41 includes at least one eleventh delimiting point, which is arranged on the delimitation of the fluid extraction 41, in an extension of a stretch from the ninth delimiting point to the centroid. Preferably, the delimitation of the fluid extraction 41 includes at least one twelfth delimiting point, which is arranged on the delimitation of the fluid extraction 41, in an extension of a stretch from the tenth delimiting point to the centroid. The ninth delimiting point and the tenth delimiting point and the eleventh delimiting point and the twelfth delimiting point are each preferably positioned spaced apart from one another by a distance of greater than zero on the delimitation of the fluid extraction 41. The distance between the ninth delimiting point and the eleventh delimiting point on the delimitation of the fluid extraction 41 is preferably less than the distance between the tenth delimiting point and the twelfth delimiting point on the delimitation of the fluid extraction 41. A longitudinal direction of the fluid extraction 41 is preferably at least partially orthogonal to a straight line between the ninth delimiting point and the center of gravity of the delimitation of the fluid extraction 41. Expressed in other words, for example, the at least one fluid extraction 41, in particular the delimitation of the fluid extraction 41, preferably has the longitudinal direction of the fluid extraction 41 and a transverse direction of the fluid extraction 41 in the plane spanned by the x direction and the y direction, and/or orthogonal to the z direction. The extension of the fluid extraction 41 is preferably different in its longitudinal direction and in its transverse direction. The fluid extraction 41, in particular the delimitation of the fluid extraction 41, preferably has a maximum extension in its longitudinal direction. Preferably, the extension of the fluid extraction 41, in particular the delimitation of the fluid extraction 41, is less in the transverse direction of the fluid extraction 41 than in its longitudinal direction. This preferably enables optimal extraction from the at least one positioning gap 07.

The minimum distance between the ninth delimiting point and the eleventh delimiting point of the fluid extraction 41 is preferably less than the minimum distance between the fifth delimiting point and the seventh delimiting point of the fluid extraction 39, the distance preferably being no more than half as large, and more preferably no more than one fifth as large.

The delimitation of the fluid extraction 41 preferably has at least two delimiting points, which have a largest possible distance of all delimiting points of the delimitation of the fluid extraction 41 with respect to one another. The largest possible distance between two delimiting points of the delimitation of the fluid extraction 41 preferably has a minimum length of preferably at least 35 mm (thirty-five millimeters), in particular of at least 40 mm (forty millimeters), more preferably of at least 45 mm (forty-five millimeters), and/or a maximum length of preferably no more than 60 mm (sixty millimeters), in particular of no more than 55 mm (fifty-five millimeters), more preferably of no more than 50 mm (fifty millimeters). More preferably, the largest possible distance between two delimiting points of the delimitation of the fluid extraction 41 has a minimum length that is greater than at least one delimitation of a relevant exit surface 09 of a relevant print head 08, which in particular is to be cleaned, in a direction that is oriented parallel to the minimum length of the fluid extraction 41. More preferably, the largest possible distance between two delimiting points of the delimitation of the fluid extraction 41 has a minimum length that is greater than at least one delimitation of a relevant exit surface 09 of a relevant print head 08, which is in particular to be cleaned, in the x direction. This preferably allows the relevant exit surface 09 to be cleaned, and, additionally or alternatively, at least one bearing surface 11 delimiting the respective exit surface 09 to be cleaned.

Preferably, a tangent at the ninth delimiting point of the delimitation of the fluid extraction 41 is positioned at least partially orthogonal to the cleaning direction G and orthogonal to the z direction, and, alternatively or additionally, parallel to the corresponding tangent at the first delimiting point of the delimitation of the fluid supply opening 38. In addition or as an alternative, the fluid extraction 41 is preferably at least partially positioned orthogonal to the cleaning direction G and orthogonal to the z direction and parallel to the positioning gap 07. The tangent at the ninth delimiting point of the delimitation of the fluid extraction 41 is preferably oriented parallel to the at least one positioning gap 07 of the assigned nozzle bar 04, in particular in a plane of the surface of the cleaning area 37. The tangent at the ninth delimiting point of the delimitation of the fluid extraction 41, which is arranged at least partially orthogonal to the cleaning direction G and orthogonal to the z direction, preferably has a plane angle of at least 50°, preferably of at least 60°, and of no more than 130°, preferably of no more than 120°, with respect to the cleaning direction G in a positive mathematical direction of rotation, this meaning counterclockwise.

The tangent at the ninth delimiting point of the delimitation of the fluid extraction 41 is preferably parallel to a longitudinal direction of the fluid extraction 41. More preferably, the longitudinal direction of the fluid extraction 41 is oriented parallel to the at least one positioning gap 07 of the assigned nozzle bar 04. The longitudinal direction of the fluid extraction 41 preferably has a preferably plane angle, in particular an extraction angle 49, of at least 50°, preferably of at least 60°, and of no more than 130°, preferably of no more than 120°, with respect to the cleaning direction G in a positive mathematical direction of rotation, this meaning counterclockwise. In other words, this means, for example, that the longitudinal direction of the at least one fluid extraction 41 has an identical oblique position with respect to the longitudinal direction of the at least one positioning gap 07, preferably by the extraction angle 49 with respect to the cleaning direction G. In particular, the extraction angle 49 thus preferably corresponds to the at least partially diagonal overlap in the x direction of the at least two print heads 08 that are arranged next to one another, in particular adjacent to one another. From this, it is apparent, for example, that the extraction angle 49 is preferably acute or obtuse. This acute or obtuse configuration of the extraction angle 49 preferably matches the at least partially diagonal overlap in the x direction of the at least two print heads 08 that are arranged next to one another and/or the orientation of the longitudinal direction of the at least one positioning gap 07.

In a preferred embodiment, the tangent at the first delimiting point of the delimitation of the fluid supply opening 38 and/or the tangent at the fifth delimiting point of the delimitation of the fluid discharge 39 and/or the tangent at the ninth delimiting point of the delimitation of the fluid extraction 41 preferably in each case has a plane angle of at least 50°, preferably of at least 60°, and of no more than 130°, preferably of no more than 120°, with respect to the cleaning direction G in a positive mathematical direction of rotation. More preferably, the longitudinal direction of the fluid supply opening 38 and/or the longitudinal direction of the fluid discharge 39 and/or the longitudinal direction of the fluid extraction 41 in each case has a plane angle of at least 50°, preferably of at least 60°, and of no more than 130°, preferably of no more than 120°, with respect to the cleaning direction G in a positive mathematical direction of rotation. The longitudinal direction of the at least one fluid supply opening 38 and/or the longitudinal direction of the at least one fluid discharge 39 and/or the longitudinal direction of the at least one fluid extraction 41 are preferably oriented parallel to the at least one longitudinal direction of the at least one positioning gap 07 between at least two print heads 08 of the at least one nozzle bar 04 which are arranged next to one another.

In a preferred embodiment, the relevant cleaning element 31 comprises at least one cleaning area 37, by which preferably in each case at least one print head 08 of at least one nozzle bar 04 is to be cleaned and/or can be cleaned. In an alternative exemplary embodiment, the relevant cleaning element 31 preferably comprises at least two cleaning areas 37. Preferably, the relevant at least two cleaning areas 37 can be connected and/or are connected by at least one connecting element 42. In this way, preferably at least two print heads 08 are to be cleaned and/or can be cleaned by means of the one relevant cleaning head 31, which comprises at least two connectable and/or connected cleaning areas 37, wherein the at least two print heads 08 are preferably arranged in at least two different rows of print heads 08 in the y direction. For example, a cleaning head 31, in addition or as an alternative to the at least one cleaning area 37, comprises at least one wiper 52, which, for example, is arranged in direct contact with at least one exit surface 09 of a print head 08 to be cleaned.

In a preferred embodiment, the at least one printing unit 01 of the printing press comprises at least one nozzle bar 04 comprising at least two print heads 08 arranged next to one another, which delimit the at least one positioning gap 07, comprising at least one feed device 13 assigned to the respective positioning gap 07 and/or at least one cleaning device 18 assigned to the relevant print head 08 of the nozzle bar 04.

For example, the at least one feed device 13 is used in an operating mode of the printing press in which at least one printing fluid can be printed and/or is printed onto at least one printing substrate 03. As a result of the ejection of at least one fluid, for example a gas and/or a gas mixture, in particular air, and/or a liquid, through the outlet opening 17 of the respective feed device 13, the penetration and/or accumulation of printing fluid, for example, in the respective positioning gap 07 is preferably made more difficult and/or suppressed.

The at least one cleaning device 18, preferably the at least one cleaning area 37 of the at least one cleaning device 18, is configured to clean the at least one print head 08, more preferably the at least one exit surface 09 and/or the at least one bearing surface 11 and/or the at least one positioning gap 07, in a contactless manner. The at least one cleaning device 18 cleans the at least one print head 08 of the print heads 08 in a contactless manner. The at least one print head 08, preferably the at least one exit surface 09 of the at least one print head 08, of the at least one nozzle bar 04, is cleaned in a contactless manner by at least one cleaning device 18 comprising the at least one cleaning element 31 including the at least one fluid supply opening 38. The at least one cleaning area 37 of the at least one cleaning element 31 is preferably configured to clean the at least one exit surface 09 and/or the at least one bearing surface 11 and/or the at least one positioning gap 07 in a contactless manner. This means that only indirect contact, for example by way of a cleaning fluid, is present between the at least one cleaning area 37 and at least one of the components of the at least one print head 08 described below, preferably the at least one exit surface 09 and/or the at least one bearing surface 11 and/or the at least one positioning gap 07. Preferably, the at least one cleaning area 37, preferably at least the at least one fluid supply opening 38, is spaced apart from the at least one print head 08, preferably at least from the at least one exit surface 09 and/or from the at least one bearing surface 11 and/or from the at least one positioning gap 07, preferably permanently, at a distance of greater than zero. Preferably, the at least one cleaning area 37, preferably at least the at least one fluid supply opening 38, is arranged preferably permanently in a contactless manner with respect to the at least one print head 08, preferably at least with respect to the at least one exit surface 09 and/or with respect to the at least one bearing surface 11 and/or with respect to the at least one positioning gap 07.

In at least one cleaning process, preferably at least the at least one cleaning element 31 and/or the at least one cleaning unit 26 are preferably moved in the cleaning direction G. For example, the relevant cleaning element 31 and/or the relevant cleaning unit 26 have a constant velocity along the cleaning direction G. The fluid supply opening 38 preferably ejects cleaning agent that makes contact with the at least one exit surface 09 and/or the at least one contact surface 11 and/or the at least one positioning gap 07 of the relevant nozzle bar 04. The cleaning agent preferably cleans the at least one exit surface 09 and/or the at least one bearing surface 11 and/or the at least one positioning gap 07. The fluid discharge 39, for example, extracts the cleaning agent and/or dirt, for example following the cleaning of the exit surface 09 and/or of the bearing surface 11 and/or of the positioning gap 07 in a preferably first discharge step, preferably by applying negative pressure. In a second discharge step, the fluid extraction 41, for example, preferably extracts the cleaning agent and/or dirt that remained as residue and/or adhesions on the exit surface 09 and/or on the bearing surface 11 and/or in the positioning gap 07, for example after the first discharge step.

As an alternative or in addition, the cleaning element 31 and/or the cleaning unit 26, preferably at at least one position that, for example, is assigned to a positioning gap 07, are slowed down and/or stopped in terms of their velocity in the cleaning direction G, whereby, for example, a cleaning of the relevant positioning gap 07 can be carried out and/or is possible to be carried out. During the at least one cleaning process, the at least one feed device 13 preferably ejects a fluid, for example a gas and/or a gas mixture, in particular air, and/or a liquid, through the at least one outlet opening 17. In this way, a penetration and/or accumulation of the cleaning agent in the respective positioning gap 07 is made more difficult and/or suppressed during the cleaning process.

For example, intensive cleaning of the at least one relevant positioning gap 07 is preferably carried out, wherein the cleaning element 31 and/or the cleaning unit 26, preferably at the at least one position that is preferably assigned to the respective positioning gap 07, are slowed down and/or stopped in terms of their velocity in the cleaning direction G, and/or the feed device 13 ejects at least one fluid, for example a gas and/or a gas mixture, in particular air, and/or a liquid.

In a preferred embodiment of the cleaning element 31, the at least one cleaning element 31 includes at least two sliding surfaces 32, which are arranged behind one another in the cleaning direction G, preferably in alignment with one another. For example, the at least two sliding surfaces 32 are spaced apart from one another at a distance of greater than zero. In particular, at least one edge 51 is arranged in the cleaning direction G downstream from the at least one cleaning area 37, in particular downstream from the at least one fluid extraction 41, and/or upstream from the at least one second ramp 34. The at least one cleaning area 37 is preferably raised in the z direction in relation to a surface of the cleaning element 31 downstream from the at least one edge 51, in particular in the z direction in relation to the at least one second ramp 34. In this way, the distance between the cleaning element 31 and the at least one exit surface 09 of the at least one print head 08 is increased, preferably directly downstream from the cleaning area 37, in particular downstream from the at least one fluid extraction 41. In particular, the at least one edge 51 prevents smearing of printing fluid, which at this time, preferably when the at least one cleaning element 31 is passing the relevant exit surface 09, is located at the at least one exit surface 09. Preferably, at least one of the at least two sliding surfaces 32 that are arranged behind one another in the cleaning direction G is arranged downstream from the at least one cleaning area 37 in the cleaning direction G, in particular at the at least one second ramp 34. This ensures optimal guidance of the cleaning element 31 in the area downstream from the at least one cleaning area 37, so that a distance of greater than zero is ensured from the at least one surface of the cleaning element 31 and/or the at least one second ramp 34, in particular in the z direction, to the at least one exit surface 09. When the at least one cleaning element 31 is set against the at least one print head 08, or vice versa, and/or when the cleaning element 31 is moved in or counter to the cleaning direction G, the at least one sliding surface 32 is, preferably all sliding surfaces 32 are, preferably arranged orthogonally to the cleaning direction G upstream or downstream from the at least one exit surface 09, for example arranged spaced apart from the at least one exit surface 09 orthogonal to the cleaning direction G, that is, preferably arranged laterally. The at least one sliding surface 32 preferably has a larger extension in the cleaning direction G than orthogonal to the cleaning direction G.

In a preferred embodiment of the at least one cleaning element 31, the cleaning element 31 includes at least two cleaning areas 37, preferably four cleaning areas 37. The at least one cleaning element 31 preferably has exactly as many cleaning areas 37 as the nozzle bar 04 assigned to this cleaning element 31 has rows of print heads that are arranged next to one another, in particular in the x direction. The at least two cleaning areas 37 are preferably arranged next to one another, orthogonal to the cleaning direction G and/or orthogonal to the y direction and/or in the x direction. Preferably, in this way, at least two rows of print heads 08, preferably four rows of print heads 08, more preferably all rows of print heads 08 of a nozzle bar 04, are cleaned and/or can be cleaned simultaneously and/or with the at least one cleaning element 31.

For example, the at least one cleaning element 31, preferably when it includes at least two cleaning areas 37, in each case includes at least one sliding surface 32, in the x direction upstream from a first cleaning area 37 and/or in the x direction downstream from a last cleaning area 37. The at least one cleaning element 31 preferably does not include an additional sliding surface 32 between its first and last cleaning areas 37. For example, in addition or as an alternative, the at least one cleaning element 31, preferably when it includes at least two cleaning areas 37, in each case includes at least one guide surface 36, in the x direction upstream from a first cleaning area 37 and/or in the x direction downstream from a last cleaning area 37. The at least one cleaning element 31 preferably does not include an additional guide surface 36 between its first and last cleaning areas 37.

In a preferred embodiment, the at least one nozzle bar 04 comprises at least two rows of print heads 08. The at least two rows of print heads 08 are each arranged with respect to one another at an angle of at least 1° (one degree), preferably of at least 3° (three degrees), more preferably of 4° (four degrees). This is in particular the case when a curved and/or cylindrical printing substrate guide element 02 is situated opposite the at least one nozzle bar 04. Preferably, the at least two rows of print heads 08 are each arranged with respect to one another at an angle of at least 1° (one degree), preferably of at least 3° (three degrees), more preferably of 4° (four degrees), in relation to a normal vector of the respective exit surfaces 09.

A surface of the cleaning element 31, which comprises the at least one fluid input 38 and the at least one fluid discharge 39 and the at least one fluid extraction 41, preferably the plane of the surface of the respective cleaning area 37, is in each case preferably arranged parallel to the at least one exit surface 09 of the at least one print head 08 that is assigned to this surface and/or this cleaning area 37. More preferably, this surface and/or this cleaning area 37 is directed at this at least one exit surface 09. The normal vectors of at least two surfaces of the cleaning element 31, which each comprise at least one fluid input 38 and at least one fluid discharge 39 and at least one fluid extraction 41, preferably the surfaces of the at least two cleaning areas 37 of the cleaning element 31, preferably have an angle of at least 1° (one degree), preferably of at least 3° (three degrees), more preferably of 4° (four degrees), with respect to one another.

Preferably, at least one regulator is arranged in the fluid input 38, in particular in a channel of the fluid input 38. The at least one regulator is preferably configured to regulate the supply of cleaning agent to the at least one fluid supply opening 38, in particular as a function of the angular position and/or oblique position of the respective cleaning area 37.

For example, in addition or as an alternative, the at least two cleaning areas 37 of a cleaning element 31 are arranged offset from one another in the cleaning direction G. Preferably, they thereby represent an offset of the present rows of the print heads 08 with respect to one another.

The at least one cleaning element 31 preferably additionally comprises the at least one wiper 52 in the cleaning direction G downstream from the at least one cleaning area 37. The at least one wiper 52 is preferably configured as a wiping lip, for example made of rubber. The at least one wiper 52 preferably extends in the x direction across the entire length of the exit surface 09 of the at least one assigned print head 08 in this direction.

The at least one nozzle bar 04 is preferably at least temporarily arranged in the depot position, this being the third service position.

The at least one printing unit 01 preferably comprises the at least one sealing element 56. The at least one sealing element 56 is preferably configured as a rubber lip. The at least one nozzle bar 04 preferably comprises the at least two print heads 08, more preferably at least four print heads 08, more preferably at least eight print heads 08, each including at least one exit surface 09. The at least two print heads 08, preferably the at least four print heads 08, more preferably the at least eight print heads 08, are preferably arranged in at least one row of print heads 08 along the longest side of the at least one nozzle bar 04, preferably in the y direction and/or transverse direction A. The at least one sealing element 56 is preferably arranged so as to be at least temporarily in direct contact with the at least two print heads 08, preferably the at least four print heads 08, more preferably the at least eight print heads 08, and/or at least temporarily makes direct contact. The at least one sealing element 56 is preferably arranged so as to be at least temporarily in direct contact with all print heads 08 of the at least one row along the longest side of the at least one nozzle bar 04, preferably in the y direction and/or transverse direction A.

The at least one sealing element 56 is preferably functionally connected to the at least one print head 08, in particular its exit surface 09, preferably the at least two print heads 08, more preferably the at least four print heads 08, when the at least one nozzle bar 04 is arranged in its depot position, and the at least one cleaning device 18 is arranged its usage position, and, preferably additionally, the at least one cleaning element 31 is arranged in its supply position.

The at least one sealing element 56 is preferably attached to at least one supporting surface 57 and/or is fixedly connected thereto. The at least one supporting surface 57 and/or the at least one sealing element 56 preferably each have a longitudinal direction, which is oriented along their longest extension. The longitudinal direction of the at least one sealing element 56 and/or the longitudinal direction of the at least one supporting surface 57 are preferably oriented parallel to the longest side of the at least one nozzle bar 04, in particular parallel to the transverse direction A and/or parallel to the y direction. The length of the at least one sealing element 56 along its longitudinal direction and/or the length of the at least one supporting surface 57 are preferably greater than the length of the at least one exit surface 09, more preferably of the at least two exit surfaces 09, more preferably of the at least four exit surfaces 09, more preferably of all exit surfaces 09 of the print heads 08 of the at least one nozzle bar 04 that are arranged next to one another.

The at least one printing unit 01 preferably comprises at least two sealing elements 56. Preferably, one of the at least two sealing elements 56 is in each case arranged in the x direction upstream from the at least one exit surface 09. Preferably, one of the at least two sealing elements 56 is in each case arranged in the x direction downstream from the at least one exit surface 09. Preferably, a sealing element 56 is in each case at least temporarily in direct contact with, that is, preferably directly touching, the at least one bearing surface 11 of the at least one print head 08 of the at least two print heads 08, preferably with all bearing surfaces 11 of the print heads 08 arranged next to one another, the bearing surfaces being arranged next to one another in the y direction and/or transverse direction A. The at least one exit surface 09, preferably the at least two exit surfaces 09, preferably all exit surfaces 09 of the print heads 08 arranged next to one another are thus preferably delimited and/or enclosed by at least one respective sealing element 56, at least in and counter to the x direction. Preferably, the two sealing elements 56 are in each case arranged opposite one another and spaced apart from one another at the at least one supporting surface 57 in the x direction. For example, the at least two sealing elements 56 situated opposite one another each comprise two connecting pieces. Preferably, a respective connecting piece is arranged in the y direction at the front end of the nozzle bar 04, and a respective connecting piece is arranged in the y direction at the rear end of the nozzle bar 04, so as to connect the two opposing sealing elements 56.

Preferably, the at least two sealing elements 56 and the at least two print heads 08, preferably the at least four print heads 08, preferably all print heads 08 of a nozzle bar 04 that are arranged next to one another, form a preferably at least partially self-contained spatial area when they are functionally connected to one another. More preferably, the at least two sealing elements 56 and the two connecting pieces and the at least two print heads 08, preferably the at least four print heads 08, preferably all print heads 08 of a nozzle bar 04 that are arranged next to one another, form a preferably at least partially closed spatial area when they are functionally connected to one another. The at least partially self-contained spatial area is preferably configured as a conservation area. The at least two sealing elements 56 preferably delimit the at least one conservation area with the at least two print heads 08, more preferably additionally with the two connecting pieces. More preferably, the at least two sealing elements 56 and the at least two print heads 08 and the at least one supporting surface 57 form the at least one conservation area. Preferably, the nozzle bar 04 includes exactly one conservation area per row of print heads 08 that are arranged next to one another in the y direction and/or transverse direction A. More preferably, the exactly one conservation area, per row of print heads 08, encompasses all exit surfaces 09 of all print heads 08 of this row. The conservation area preferably has an atmosphere that includes at least one conservation medium. The at least one conservation medium preferably comprises at least air enriched with water and/or air enriched with printing fluid. For example, the conservation area is rinsed and/or flooded with at least one fluid, for example with air and/or with air enriched, for example, with water, and/or with cleaning agent and/or with printing fluid. This atmosphere is preferably configured to protect the at least one exit surface 09, and prevents the printing fluid of the at least two print heads 08 from drying out. Preferably, the at least one conservation area is thus configured to at least temporarily seal the at least one exit surface 09 of the at least two print heads 08, preferably the at least two exit surfaces 09 that are preferably arranged next to one another in the y direction, more preferably the at least four exit surfaces 09 that are preferably arranged next to one another in the y direction, in each case with respect to their surrounding area, and/or the at least one conservation area is preferably configured to conserve printing fluid of the at least two print heads 08, preferably of the at least four print heads 08. The at least one sealing element 56 is preferably configured to seal and/or seals at least two exit surfaces 09 of at least two print heads 08 of at least one row of print heads 08 of the at least one nozzle bar 04.

The at least one sealing element 56 is preferably arranged in the at least one crossbar 22. The at least two print heads 08, preferably the at least four print heads 08, are preferably arranged in or at the at least one crossbar 22 during the direct contact with the at least one sealing element 56. As a result, the depot position is preferably established by the position of the at least one crossbar 22. For conservation, the at least one sealing element 56, preferably the at least two sealing elements 56 that are preferably situated opposite one another, are preferably brought in contact with the at least two print heads 08, preferably the at least four print heads 08. Preferably, the at least one sealing element 56 is, preferably the at least two sealing elements 56 that are preferably situated opposite one another are, configured to be displaced and/or displaceable relative to the at least two print heads 08 into or out of the area between the at least one nozzle bar 04 and the transport path of the at least one printing substrate 03. Preferably, the at least one sealing element 56 is, preferably the at least two sealing elements 56 that are preferably situated opposite one another are, configured to be displaced and/or displaceable relative to the at least two print heads 08 in a direction orthogonal to the longest side of the at least one nozzle bar 04, preferably orthogonal to the y direction, and/or parallel to the at least one transport path of the at least one printing substrate 03. The at least one crossbar 22 preferably comprises at least four sealing elements 56, which are configured to delimit at least two different conservation areas. Preferably, two sealing elements 56 are in each case situated opposite one another in the crossbar 22, the at least four sealing elements 56 in the crossbar 22 thereby being configured to delimit at least two different conservation areas. Preferably in addition or as an alternative, at least two crossbars 22, preferably each including at least four sealing elements 56 are configured to be displaced and/or be displaceable jointly. In this way, at least one sealing element 56 is, preferably two sealing elements 56 are, preferably assigned to each row of print heads 08, for example two rows of print heads 08 of the at least one nozzle bar 04, for example four nozzle bars 04, of the printing unit 01.

In a preferred embodiment, the at least one cleaning device 18 comprises the at least one sealing element 56, preferably the at least two sealing elements 56. The at least one cleaning device 18 preferably in each case comprises two sealing elements 56 per row of print heads 08 that are arranged next to one another in the y direction, for example at least two rows, preferably exactly two rows. Preferably, the cleaning device 18 comprises the at least one supporting surface 57, preferably the at least two supporting surfaces 57, more preferably at least one respective supporting surface 57 for two sealing elements 56 situated opposite one another. More preferably, the at least one supporting surface 57 and/or the at least one sealing element 56 are arranged in the at least one crossbar 22 configured as a collecting trough 22. The at least one collecting trough 22 preferably at least partially encloses the at least one supporting surface 57. The at least one cleaning device 18 preferably comprises the at least one cleaning element 31. The at least one cleaning element 31 is preferably arranged in the supply position when the at least one sealing element 56 is arranged in the direct contact with the at least one print head 08. The at least one cleaning element 31 is preferably arranged in the supply position when the at least one sealing element 56 is arranged in the at least temporary direct contact with the at least one print head 08.

The at least one crossbar 22, which is in particular configured as a collecting trough 22, is preferably configured to collect fluid, for example printing fluid, and/or dirt. In particular, the at least one collecting trough 22 is configured to collect printing fluid, which is ejected by the at least one print head 08 in the depot position. Preferably, the at least one collecting trough is connected to a repository of fluid, for example for recycling or reuse, and/or to a drain, to which the collected fluid and/or dirt are conducted.

The at least one cleaning device 18 is preferably at least temporarily arranged in the usage position. The at least one nozzle bar 04 is then preferably selectively arranged at least in the cleaning position or in the depot position. The at least one cleaning device 18 is preferably configured to at least partially clean the nozzle bar 04 arranged in the cleaning position. The at least one sealing element 56 is, preferably the at least two sealing elements 56 are, preferably arranged so as to be in direct contact with the at least one print head 08, preferably the at least two print heads 08, more preferably the at least four print heads 08, of the nozzle bar 04 arranged in the depot position. The at least one nozzle bar 04 is preferably arranged in the idle position or the first service position, before being arranged in the depot position. The at least one nozzle bar 04 is preferably lowered onto the at least one sealing element 56, preferably onto the at least two sealing elements 56, for conservation purposes. In particular, while the at least one nozzle bar 04 is being lowered into the depot position, the at least one sealing element 56, preferably the at least two sealing elements 56, and/or the at least one crossbar 22 are preferably situated in a position that corresponds to the usage position of the at least one cleaning device 18. When the at least one cleaning device 18 is preferably arranged in the usage position, the at least one nozzle bar 04 is preferably selectively arranged at least in the first service position, preferably the cleaning position, or in the third service position, preferably the depot position. The at least one cleaning device 18 is configured to at least partially clean the nozzle bar 04 that is arranged in the first service position, this being the cleaning position. Preferably, the at least one sealing element 56 is arranged so as to be in direct contact with the at least one print head 08 of the nozzle bar 04 that is arranged in the third service position, this being the depot position. The at least one cleaning device 18 is being arranged and/or is arranged in the usage position. Preferably, the at least one nozzle bar 04 is selectively being arranged and/or is arranged at least in the first service position or in the third service position. Preferably, the at least one cleaning device 18 at least partially cleans the nozzle bar 04 that is arranged in the first service position, or the at least one sealing element 56 preferably makes direct contact with the at least one print head 08 of the nozzle bar 04 that is arranged in the third service position.

The at least one printing unit 01 comprises the at least one cleaning system 61. The at least one cleaning system 61 is assigned to at least one nozzle bar 04 of the printing unit 01. For example, the cleaning system 61 is assigned to at least two, preferably all, nozzle bars 04 of the printing unit 01.

The at least one cleaning system 61 comprises the at least one removal unit 63 including the at least one contact element 64. The at least one cleaning system 61 comprises the at least one removal unit 63. More preferably, the cleaning system 61 comprises at least two, preferably at least four, removal units 63. More preferably, the cleaning system 61 comprises at least as many removal units 63 as the printing unit 01 comprises nozzle bars 04. More preferably, at least one removal unit 63 is in each case assigned to each row of print heads 08 of the at least one nozzle bar 04, in particular of all nozzle bars 04 of the printing unit 01, and/or each row at least temporarily makes contact with at least one removal unit 63.

The at least one cleaning system 61 preferably comprises the at least one carrier 76. Preferably, the at least one removal unit 63 is arranged on the at least one carrier 76 and/or connected to the at least one carrier 76. Preferably, at least two removal units 63 are arranged on the at least one carrier 76, in particular on at least one shared carrier 76, and/or are connected thereto. Preferably, exactly as many removal units 63 are arranged on the at least one, in particular shared, carrier 76 as the at least one printing unit 01 comprises nozzle bars 04. Preferably, at least one removal unit 63 that is arranged on the at least one carrier 76 is assigned to each nozzle bar 04, and/or at least temporarily enters into a functional connection therewith.

The at least one cleaning system 61 comprises the at least one guide element 62 and the at least one removal unit 63. The cleaning system 61 preferably comprises at least two removal units 63, preferably at least four removal units 63, more preferably as many removal units 63 as nozzle bars 04 are present in the relevant printing unit 01. Preferably, the at least one removal unit 63 is configured to move in and/or counter to the cleaning direction G, in particular along the at least one guide element 62. Preferably in addition or as an alternative, the at least one guide element 62 is preferably configured to move the at least one removal unit 63 in and/or counter to the cleaning direction G.

The at least one removal unit 63 comprises the at least one contact element 64. More preferably, the at least one removal unit 63 comprises exactly one contact element 64. The at least one contact element 64 is at least temporarily in direct contact with the at least one print head 08, in at least one contact zone. The at least one contact element 64 is at least temporarily in direct contact with the at least one print head 08 of the at least one nozzle bar 04 that is arranged in the second service position. Preferably, the at least one removal unit 63, in particular the at least one contact element 64, includes the at least one contact zone with the at least one print head 08, in which the at least one contact element 64 and the at least one print head 08 are at least temporarily in direct contact with one another. More preferably, the at least one removal unit 63, in particular the at least one contact element 64, has exactly one contact zone with the at least one print head 08. The at least one exit surface 09 of the at least one print head 08 is preferably at least temporarily arranged within the contact zone of the at least one contact element 64 with the at least one print head 08. The at least one contact element 64 is configured to clean the at least one print head 08, more preferably the at least one exit surface 09 and/or the at least one bearing surface 11 and/or the at least one positioning gap 07, under at least temporary direct contact.

The cleaning system 61 preferably comprises the at least two removal units 63. The at least two removal units 63 are preferably arranged jointly on the at least one carrier 76. The at least two removal units 63 preferably have an angle of inclination with respect to the z direction which corresponds to an inclination with respect to the z direction of the at least one nozzle bar 04 and/or of at least one print head 08 of the nozzle bar 04. The inclination preferably corresponds to the inclination of the assigned nozzle bar 04 and/or its print head 08. For example, in the case where the transport path of the printing substrate 03 within the printing unit 01 is curved, and the at least two nozzle bars 04 thus preferably have an inclination with respect to the z direction, the at least two removal units 63 have an inclination, preferably with respect to the z direction, which corresponds to the inclination of the nozzle bar 04 assigned thereto and/or its at least one print head 08. For example, in the case of a planar, for example horizontal transport path, the at least two nozzle bars 04 and/or the at least two removal units 63 are preferably aligned and/or positioned in a planar, preferably horizontal, manner. This preferably allows the at least one contact element 64 to be optimally placed against the at least one print head 08 and/or for it to be cleaned.

The at least one contact element 64 is configured as a wiping element 64 configured as a wiping cloth 64. For example, the at least one contact element 64 is configured as a wiping cloth 64 having a length of at least 50 cm (fifty centimeters), preferably of at least 1 m (one meter), more preferably of at least 1.5 m (one point five meters). More preferably, the at least one contact element 64 has a length that is greater than the extension of the nozzle bar 04 in the transverse direction A. The at least one wiping cloth 64 is preferably lint-free. The cloth quality, in particular the roughness, of the at least one wiping cloth 64 preferably differs in accordance with the degree of soiling to be cleaned. For example, the at least one wiping cloth 64 has a first roughness in the case of little soiling, and a second roughness in the case of high soiling, wherein the second roughness is higher than the first roughness. The at least one wiping cloth 64 is preferably replaceable and/or adaptable and/or is replaced and/or is adapted in accordance with the degree of soiling.

Preferably, in particular when the at least one contact element 64 is configured as a wiping element 64, the at least one cleaning system 61 is configured as a wiping device 61. Preferably, in particular when the at least one contact element 64 is configured as a wiping element 64, the at least one removal unit 63 is configured as a wiping unit 63.

The at least one removal unit 63 preferably comprises at least one pressing element 66, which is preferably configured as at least one pressing roller 66. The at least one pressing element 66 is preferably configured to at least temporarily press the at least one contact element 64, which is in particular configured as a wiping cloth 64, against the at least one exit surface 09 and/or the at least one bearing surface 11 and/or the at least one positioning gap 07 of the at least one print head 08. The at least one pressing element 66 is preferably resiliently mounted. The at least one resiliently mounted pressing element 66 is preferably configured so as to be set and/or settable with respect to its position in the z direction. Preferably in addition or as an alternative, a contact pressure of the at least one pressing element 66 against the at least one print head 08 is preferably configured to be set and/or settable. In particular, a contact pressure of the at least one pressing element 66, with which the at least one contact element 64 is pressed against the at least one exit surface 09 and/or the at least one bearing surface 11 and/or the at least one positioning gap 07, is preferably set and/or settable via the resilient mounting, for example the rigidity of the mounting and/or the position of the mounting in the z direction.

The at least one removal unit 63 preferably comprises at least one reservoir 67 of the contact element 64, which is preferably configured as an unwinding device 67. For example, unused contact element 64, which is in particular configured as wiping cloth 64, is collected at the reservoir 67, which is output, preferably unwound and/or can be unwound, as needed. The at least one contact element 64, which is arranged and/or collected at the reservoir 67, is preferably configured as a roll, for example as a supply roll. The at least one reservoir 67 is preferably arranged in at least one housing 74. For example, clean contact element 64 is thus protected against dirt and/or other external influences. The at least one reservoir 67 preferably comprises at least one element generating a braking force. For example, the at least one element generating a braking force is configured as at least one spring and/or at least one pressure element. For example, the at least one housing 74 is configured as the at least one element generating a braking force. The at least one reservoir 67 is preferably configured to set and/or introduce the tension of the at least one contact element 64, which is in particular configured as a wiping cloth 64, along its guide path, preferably by way of the at least one element generating a braking force. The braking force preferably counteracts a transport movement of the at least one contact element 64.

The at least one removal unit 63 preferably comprises at least one storage device 68 of the at least one contact element 64, which is preferably configured as a winding device 68. The at least one storage device 68 is preferably driven and/or connected to at least one drive. For example, at the storage device 68, contact element 64 is collected and/or can be collected, which was preferably previously used and/or can be used for cleaning at least one print head 08 and/or at least one exit surface 09 and/or at least one bearing surface 11 and/or at least one positioning gap 07. The at least one storage device 68 is preferably configured to wind contact element 64 and/or contact element 64 can be wound in the at least one storage device 68. The at least one contact element 64, which is preferably configured as a wiping cloth 64 and which is arranged and/or collected at the storage device 68, is preferably configured as a roll, for example as a storage roll.

The at least one contact element 64 is preferably configured to be guided and/or guidable from the at least one reservoir 67, by way of the at least one pressing element 66, to the at least one storage device 68. Above and below, this stretch is referred to as the guide path of the contact element 64.

The at least one cleaning system 61 preferably comprises the at least one drive. The at least one storage device 68 is preferably driven and/or connected to the at least one drive. The at least one drive is preferably configured to change the at least one contact element 64 with respect to the contact zone with the at least one print head 08. The at least one contact element 64 is preferably configured to change at least its surface within the at least one contact zone. The at least one contact element 64 preferably changes at least its surface located within the at least one contact zone. The at least one drive is preferably configured to wind the at least one contact element 64 onto the at least one storage device 68 and/or to unwind it from the at least one reservoir 67. Preferably in addition or as an alternative, the at least one drive is configured to be pneumatic. This advantageously increases the resistance of the at least one removal unit 63 to fluids and/or environmental influences. For example, as an alternative, the at least one drive is configured as an electric motor.

The velocity with which the at least one contact element 64 is changed in terms of the contact zone with the at least one print head 08 is preferably adapted and/or adaptable to a movement of the at least one removal unit 63 in the cleaning direction G and/or to the number of print heads 08 to be cleaned in a cleaning step. The at least one contact element 64 is preferably configured to change its surface within the at least one contact zone. For example, the at least one contact element 64 is configured to continuously change its surface within the at least one contact zone. Preferably as an alternative, the at least one contact element 64 is configured to change at least its surface within the at least one contact zone in a clocked and/or incremental manner. For example, the at least one removal unit 63 has a clock pulse period.

The at least one removal unit 63 preferably comprises at least one clock generator 78. The at least one clock generator 78 is preferably the at least one drive or is connected to the at least one drive, for example by way of at least one line 73 configured as a drive line 73. The at least one clock generator 78 is preferably configured as a linearly guided element, more preferably as at least one piston and/or at least one pneumatic cylinder. The at least one drive is preferably configured to pneumatically drive the at least one clock generator 78 configured as a linearly guided element.

The at least one removal unit 63 preferably comprises at least one sensing element 77. The at least one clock generator 78 is preferably configured to transmit at least one movement to the at least one pick-up element 77. The at least one pick-up element 77 is preferably configured as a gear wheel and/or as a ratchet wheel. The at least one pick-up element 77 is preferably functionally connected to the at least one contact element 64, and the at least one pick-up element 77 is preferably configured to drive the at least one contact element 64. The at least one pick-up element 77 is preferably configured to drive the at least one storage device 68. The at least one storage device 68 is preferably in particular configured to wind the at least one contact element 64 using its drive.

The at least one clock generator 78 is preferably configured to drive the at least one pick-up element 77. The at least one pick-up element 77 is preferably configured to drive the at least one storage device 68. The at least one storage device 68 is preferably configured to transmit at least one movement onto the at least one contact element 64. Preferably, the at least one clock generator 78 is configured to transmit at least one movement, for example by way of at least one pulse, to the at least one pick-up element 77, which is configured to transmit this at least one movement to the at least one storage device 68, and thus to the at least one contact element 64. The at least one clock generator 78 preferably makes contact with the at least one pick-up element 77 in a linear stroke movement, that is, forward and/or backward, and is configured to thereby move this at least one pick-up element 77 by at least a portion of its circumference. The at least one clock generator 78 is preferably configured to cause the at least one pick-up element 77 to move along a first direction of rotation at least twenty times, preferably thirty times, more preferably at least forty times, before the pick-up element has completed a full revolution of 360° (three hundred sixty degrees). For example, every single pulse that causes the at least one pick-up element 77 to move is referred to as individual clock.

The at least one removal unit 63 preferably comprises at least one blocking element 79, for example an anti-reversing lock. The at least one blocking element 79 is preferably permanently in contact with the at least one pick-up element 77. The at least one blocking element 79 is preferably configured to preferably selectively block the at least one pick-up element 77 in its movement. More preferably, the blocking element 79 is configured to only allow the first direction of rotation of the at least one pick-up element 77. The at least one blocking element 79 is preferably configured to block a rotation of the at least one pick-up element 77 counter to the first direction of rotation.

The at least one pick-up element 77 and/or the at least one clock generator 78 and/or the at least one blocking element 79 are preferably arranged within the at least one housing 74.

For example, the at least one removal unit 63 comprises at least one deflection means 69. Preferably, the at least one deflection means 69 is preferably arranged along the guide path of the contact element 64 between the at least one reservoir 67 and the at least one pressing element 66. For example, in particular when the at least one contact element 64 is configured as a wiping cloth 64, the wiping cloth 64, proceeding from the at least one reservoir 67, is deflected and/or deflectable along its guide path about the at least one deflection means 69 with respect to its transport direction T. In this way, preferably direct contact of the contact element 64 with the at least one print head 08 is only ensured in the at least one contact zone, that is, at the at least one pressing element 66. For example, in addition or as an alternative to the at least one element generating a braking force, the tension of the at least one contact element 64, which is in particular configured as a wiping cloth 64, along its guide path can preferably be set and/or is set by the at least one deflection means 69.

The at least one removal unit 63 preferably comprises at least one nozzle 71. Preferably, the at least one nozzle 71 is preferably arranged along the guide path of the at least one contact element 64 between the at least one reservoir 67 and the at least one pressing element 66, and more preferably, it is directed at the guide path of the contact element 64 and/or at the at least one contact element 64. The at least one nozzle 71 is preferably configured to spray fluid onto the at least one contact element 64 along the guide path of the at least one contact element 64 upstream from the at least one contact zone. The at least one deflection means 69 preferably comprises the at least one nozzle 71. The at least one deflection means 69 preferably comprises at least two nozzles 71, more preferably a multiplicity of nozzles 71. The at least one nozzle 71 is preferably arranged at the circumference of the at least one deflection means 69 and is directed at the guide path of the at least one contact element 64. For example, at least two nozzles 71 are arranged next to one another along the circumference of the at least one deflection means 69.

The at least one nozzle 71 is preferably connected via at least one supply line 72 to a source of cleaning agent. Preferably, the at least one nozzle 71 is configured to spray fluid, preferably cleaning agent, for example unpigmented printing fluid, onto the at least one contact element 64, preferably along the guide path of the at least one contact element 64 upstream from the at least one pressing element 66 and/or preferably upstream from the at least one contact zone. For example, in particular when the at least one removal unit 63 has an inclination with respect to a horizontal plane, preferably so that the at least one deflection means 69 with its longitudinal axis has an inclination with respect to the horizontal plane, a first part of nozzles 71 of the at least two nozzles 71 can in each case be activated, which is positioned higher than a second part of nozzles 71 of the at least two nozzles 71. For example, the at least one supply line 72 is then configured to transport cleaning agent at least to the part of nozzles 71 which is positioned higher than the respective at least one further part of nozzles 71. This advantageously takes advantage of the gravity of the cleaning agent. Preferably, the cleaning agent then preferably distributes independently among all nozzles 71.

The at least one contact element 64 is preferably dry when arranged at the at least one reservoir 67. The at least one contact element 64 is preferably moistened and/or is converted into a moist or wet state by spraying on the cleaning agent from the at least one nozzle 71. For example, the cleaning agent is embodied as ink that does not include any pigments. For example, in an alternative embodiment, a wet contact element 64 can be used and/or is used, which is already configured to be moist or wet, for example saturated with cleaning agent, when it is arranged at the at least one reservoir 67. For example, in a further alternative embodiment, the contact element 64 is dry when making direct contact with the at least one print head 08. Preferably, cleaning agent is not sprayed onto the contact element 64 by the at least one nozzle 71 in the process. For example, a combination of one of the embodiments of the at least one contact element 64 as described above is possible so that, for example, first a moist or wet contact is generated in a first cleaning step, and a dry contact is generated in a second cleaning step, between the at least one wiping cloth 64 and the at least one print head 08.

The at least one contact element 63 cleans the at least one print head 08, in particular its exit surface 09 and/or the at least one bearing surface 11, preferably by direct contact. The at least one removal unit 63 is preferably moved into the at least one operating position for this purpose. The at least one nozzle bar 04 is preferably lowered onto the at least one contact element 64 and is preferably thereby arranged in the second service position. The removal unit 63 preferably has a relative movement with respect to the at least one print head 08. The at least one removal unit 63 is preferably moved in the cleaning direction G, for example alternatively counter to the cleaning direction G. The at least one contact element 64 preferably consecutively makes contact with the at least two print heads 08 arranged in one row. For example, the at least one contact element 64 wipes the at least one exit surface 09, preferably the at least two exit surfaces 09, and/or the at least one bearing surface 11, preferably the at least two bearing surfaces 11. During the movement of the at least one removal unit 63 in or counter to the cleaning direction G, the surface of the at least one contact element 64 is preferably changed. The contact element 64 is preferably unwound and/or wound in the process. With each forward movement in or counter to the cleaning direction G, a different area of the contact element 64 thus makes direct contact with the at least one print head 08. The change of the surface of the at least one contact element 64 is preferably prompted by way of the at least one clock generator 78 and/or by way of the at least one pick-up element 77. For example, the at least one contact element 64 is only configured to clean the at least one print head 08 during a movement in the cleaning direction G. For example, as an alternative, the at least one contact element 64 is configured to clean the at least one print head 08 during a movement in the cleaning direction G and during a movement counter to the cleaning direction G.

The at least one printing unit 01 comprises the at least one cleaning device 18 and the at least one cleaning system 61. The at least one cleaning device 18 and the at least one cleaning system 61 can preferably be moved independently of one another.

Preferably, the at least one print head 08 of the at least one nozzle bar 04, preferably the at least one print head 08 of the at least one nozzle bar 04 arranged in the at least one service position, is configured to selectively make contact with the at least one cleaning device 18 and/or contact with the at least one cleaning system 61. Preferably, the at least one cleaning device 18 and/or the at least one cleaning system 61 selectively make contact with the at least one print head 08. In addition or as an alternative, the at least one cleaning device 18 and/or the at least one cleaning system 61 are selectively displaced at least temporarily into the area between the at least one nozzle bar 04 and the transport path of the at least one printing substrate 03. In addition or as an alternative, the at least one cleaning device 18 and/or the at least one cleaning system 61 are selectively displaced into the area between the at least one nozzle bar 04 and the transport path of the at least one printing substrate 03. More preferably, the at least one cleaning device 18 and/or the at least one cleaning system 61 are displaced independently of one another into the area between the at least one nozzle bar 04 and the transport path of the printing substrate 03. In addition or as an alternative, the at least one cleaning device 18 and/or the at least one cleaning system 61 are selectively arranged in the area between the at least one nozzle bar 04 and the transport path of printing substrate 03.

Preferably, in a first arrangement of the selective arrangement, the at least one cleaning device 18, preferably the at least one cleaning element 31, is arranged within the area between the at least one nozzle bar 04 and the transport path of printing substrate 03. The at least one cleaning system 61, preferably at least the at least one removal unit 63, is then preferably arranged outside the area between the at least one nozzle bar 04 and the transport path of printing substrate 03. The at least one nozzle bar 04 is arranged in the first service position or, for example, in the third service position. In the first arrangement, the at least one cleaning device 18 is configured to clean the at least one print head 08 or, for example, to seal the at least one print head 08 by means of the at least one sealing element 56. In the first arrangement, the at least one removal unit 63 is preferably arranged in the at least one supply position.

In addition or as an alternative, preferably in a second arrangement of the selective arrangement, the at least one cleaning system 61, preferably the at least one removal unit 63, is arranged within the area between the at least one nozzle bar 04 and the transport path of printing substrate 03. The at least one cleaning device 18, preferably at least the at least one cleaning element 31, is then preferably arranged outside the area between the at least one nozzle bar 04 and the transport path of printing substrate 03. The at least one nozzle bar 04 is arranged in the second service position. In the second arrangement, the at least one cleaning system 61, preferably the at least one removal unit 63, is configured to clean the at least one print head 08. In the second arrangement, the at least one cleaning device 18 is preferably arranged in the at least one storage position. In the second arrangement, the at least one cleaning element 31 is preferably arranged in the at least one supply position.

Preferably in addition or as an alternative, preferably in a third arrangement of the selective arrangement, both the at least one cleaning device 18, preferably at least the at least one cleaning element 31, and the at least one cleaning system 61, preferably at least the at least one removal unit 63, are arranged outside the area between the at least one nozzle bar 04 and the transport path of printing substrate 03. In the third arrangement, the at least one cleaning device 18 is preferably arranged in the at least one storage position. In the third arrangement, the at least one cleaning element 31 is preferably arranged in the at least one supply position. In the third arrangement, the at least one removal unit 63 is preferably arranged in the at least one supply position. In the third arrangement, the at least one nozzle bar 04 is preferably arranged in the printing position.

More preferably, the at least one nozzle bar 04 is first displaced from the at least one printing position into the at least one idle position. The at least one nozzle bar 04 is then preferably displaced from the at least one idle position into the at least one service position. Preferably, the at least one cleaning device 18 and/or the at least one cleaning system 61 are selectively displaced into the area between the at least one nozzle bar 04 and the transport path when the at least one nozzle bar 04 is arranged in the at least one idle position. Preferably in addition or as an alternative, the at least one nozzle bar 04 is selectively lowered onto the at least one cleaning device 18 or onto the at least one cleaning system 61. The at least one nozzle bar 04 is preferably arranged in the at least one service position at least as a result of being lowered.

The at least one cleaning device 18 and/or the at least one cleaning system 61 at least temporarily clean the at least one print head 08.

In a preferred embodiment, the at least one sealing element 56, preferably the at least two sealing elements 56, and/or the at least one cleaning device 18 and/or the at least one cleaning system 61 are selectively arranged in contact with the at least one nozzle bar 04. The at least one print head 08 of the at least one nozzle bar 04 is preferably configured to selectively make contact and/or makes contact with the at least one cleaning device 18 and/or with the at least one cleaning system 61 and/or with the at least one sealing element 56, preferably the at least two sealing elements 56. The at least one print head 08 of the at least one nozzle bar 04 arranged in the at least one service position is preferably configured to selectively make contact and/or makes contact with the at least one cleaning device 18 and/or with the at least one cleaning system 61 and/or with the at least one sealing element 56, preferably the at least two sealing elements 56. The at least one cleaning device 18 is configured to move and/or be movable along the at least one guide element 53 and/or the at least one removal unit 63 is configured to move and/or be movable along the at least one guide element 62. The at least one print head 08 is preferably selectively cleaned by the at least one cleaning device 18 and/or is cleaned by the at least one cleaning system 61 and/or is conserved and/or is sealed with respect to the surrounding area of the print head 08 by the at least one sealing element 56, preferably the at least two sealing elements 56. The at least one cleaning device 18 or the at least one cleaning system 61 selectively cleans the at least one print head 08, preferably the at least two print heads 08, more preferably the at least two print heads 08 of a row, of the at least one nozzle bar 04, preferably of the at least one nozzle bar 04 of the at least four nozzle bars 04.

Above and below, the term "selectively" preferably describes that at least two operating modes to be distinguished from one another, for example at least three operating modes, are present. The at least two operating modes can be assumed as a function of operating specifications or further conditions, preferably independently of one another. If a first element and/or a second element selectively make contact with a third element, this preferably describes that either the first element or the second element or both elements make contact with the third element as a function of operating specifications or other conditions. For this purpose, the press comprises the first element, and the second element, and the third element.

The at least one cleaning device 18 is preferably configured to make the selective contact with the at least one print head 08 and/or makes the contact when the at least one nozzle bar 04 previously had a printing operating mode for at least one hour, preferably for at least two hours, and/or when the at least one nozzle bar 04 previously or thereafter had or will have a non-printing operating mode for at least one hour, preferably for at least two hours. The at least one cleaning device 18 is preferably configured to selectively clean and/or selectively cleans the at least one print head 08 when the at least one nozzle bar 04 previously had a printing operating mode for at least one hour, preferably for at least two hours, and/or when the at least one nozzle bar 04 previously or thereafter had or will have a non-printing operating mode for at least one hour, preferably for at least two hours. The at least one cleaning device 18 is preferably selectively arranged in the area between the at least one nozzle bar 04 and the transport path of printing substrate 03 when the at least one nozzle bar 04 previously had a printing operating mode for at least one hour, preferably for at least two hours, and/or when the at least one nozzle bar 04 previously or thereafter had or will have a non-printing operating mode for at least one hour, preferably for at least two hours.

The at least one cleaning system 61 is preferably configured to make the selective contact with and/or makes the contact with and/or preferably cleans the at least one print head 08, and/or is preferably selectively arranged in the area between the at least one nozzle bar 04 and the transport path of printing substrate 03, when the at least one nozzle bar 04 previously had a printing operating mode for at least six hours, preferably for at least eight hours, that is, printing fluid was transferred onto at least one printing substrate 03, and/or when the at least one nozzle bar 04 previously or thereafter had or will have a non-printing operating mode for at least four hours, preferably for at least five hours, more preferably for at least six hours. In addition or as an alternative, when the at least one nozzle bar 04 includes printing fluid that has a viscosity, preferably a dynamic viscosity, of at least 3 mPa*s (three millipascal seconds), preferably at least 4.5 mPa*S (four point five millipascal seconds), and/or that has a viscosity of no more than 6 mPa*s (six millipascal seconds), preferably no more than 5.5 mPa*s (five point five millipascal seconds). The preceding viscosity values preferably refer to the viscosity between 20° C. (twenty degrees Celsius) and 40° C. (forty degrees Celsius), preferably of at least 25° C. (twenty-five degrees Celsius) and/or no more than 35° C. (thirty-five degrees Celsius), and/or were preferably determined according to DIN EN ISO 2884-1:2006-09. In addition or as an alternative, when the at least one nozzle bar 04 includes printing fluid having a pigment content of the printing fluid of at least 1%, preferably of at least 2%, more preferably of at least 3%, more preferably of at least 4%, and/or preferably having a pigment content of the printing fluid of no more than 18%, preferably of no more than 14%, more preferably of no more than 10%, more preferably of no more than 7%. In addition or as an alternative, when the at least one printing substrate 03 is configured as paper and/or cardboard and/or corrugated cardboard and/or paperboard, for example since its processing places a particular burden on the printing press. In addition or as an alternative, when the at least one printing substrate 03 includes a pigment coating of at least 5%, preferably at least 8%, more preferably at least 10% of the total weight of the at least one printing substrate 03 and/or when the at least one printing substrate 03 includes a pigment coating no more than 30%, preferably no more than 25%, more preferably no more than 20% of the total weight of the at least one printing substrate 03. In addition or as an alternative, when the printing fluid is configured for package printing and/or for printing a packaging material.

The at least one sealing element 56, preferably the at least two sealing elements 56 are preferably configured to selectively make contact, and/or make contact, with the at least one print head 08, preferably the at least two print heads 08, more preferably the at least four print heads 08, when the at least one nozzle bar 04 has a non-printing operating mode for at least thirty minutes, preferably for at least sixty minutes. During the at least thirty minutes of the non-printing operating mode, the at least one sealing element 56 preferably makes the selective contact with the at least one print head 08, preferably upstream or downstream from the at least one cleaning device 18 and/or upstream or downstream from the at least one cleaning system 61.

For example in addition or as an alternative, the at least one bearing surface 11 is cleaned independently of the at least one exit surface 09. For example, the at least one bearing surface 11 is cleaned by at least one further, second cleaning head, which differs, for example, from the cleaning element 31 described above and preferably configured as a first cleaning head 31, in terms of the type of cleaning of the cleaning device 18 to be carried out and/or is configured to exclusively clean the at least one bearing surface 11. For example, the at least one second cleaning head, in addition or as an alternative to the first cleaning head 31, is arranged in the at least one cleaning unit 26. For example, the at least one second cleaning head can be removed from or inserted into the at least one cleaning unit 26. The at least one second cleaning head is preferably attached by way of a locking mechanism, preferably a plug system, in the at least one cleaning unit 26. In particular, the first cleaning head 31, which is thus arranged in the at least one cleaning unit 26, can be at least temporarily exchanged for and/or replaced by the second cleaning head, or vice versa, for example during intensive cleaning of the at least one bearing surface 11.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A printing press, the printing press comprising at least one printing unit (01) comprising at least four nozzle bars (04), each comprising at least one print head (08), at least one nozzle bar (04) of the at least four nozzle bars (04) having at least one printing position and at least one service position, the at least one nozzle bar (04) being selectively arranged in the printing position or in the at least one service position, the at least one service position being configured as a first service position, in the first service position the at least one nozzle bar (04) having a first distance with respect to a transport path of a printing substrate (03), at least one second service position being configured as a second service position, in the second service position the at least one nozzle bar (04) having a second distance with respect to the transport path, the at least one printing unit (01) comprising at least one cleaning device (18) and at least one cleaning system (61), the at least one cleaning device (18) comprising at least one cleaning element (31) including at least one fluid supply opening (38), the at least one cleaning system (61) comprising at least one removal unit (63) comprising at least one contact element (64), the contact of the at least one print head (08) with the at least one cleaning device (18) corresponding to a contactless cleaning operation of at least one exit surface (09) of the at least one print head (08), the first service position corresponding to a positioning of the at least one nozzle bar (04) during a contactless cleaning operation of the at least one exit surface (09) of the at least one print head (08) of the at least one nozzle bar (04), the at least one nozzle bar (04) being arranged in the second service position when contact with the at least one cleaning system (61) occurs, characterized in that the at least one cleaning device (18) or the at least one cleaning system (61) is selectively arranged in an area between the at least one nozzle bar (04) and the transport path of printing substrate (03), that the at least one service position is arranged in vertical direction above the printing position, and that the second distance of the second service position of the nozzle bar (04) is less than in the first service position.

2. The printing press according to claim 1, characterized in that the at least one removal unit (63) has at least one supply position and at least one operating position, that, in the at least one operating position, the at least one removal unit (63) is arranged within the area between the at least one nozzle bar (04) and the transport path of the printing substrate (03), and/or that the at least one cleaning element (31) has at least one supply position and at least one operating position, and that, in the at least one operating position, the at least one cleaning element (31) is arranged within the area between the at least one nozzle bar (04) and the transport path of the printing substrate (03).

3. The printing press according to claim 2, characterized in that, in the at least one supply position, the at least one cleaning element (31) is arranged along a longest side of the at least one nozzle bar (04) and/or along a y direction outside the area between the at least one nozzle bar (04) and the transport path of the printing substrate (03), and/or that the at least one fluid supply opening (38) of the at least one cleaning element (31) arranged in the supply position has a relative distance in the y direction and/or in the transverse direction (A) with respect to the at least one opening of the at least one exit surface (09) of the at least one print head (08), that the relative distance of the at least one fluid supply opening (38) of the at least one cleaning element (31) arranged in the supply position with respect to the at least one opening of the at least one exit surface (09) of the at least one print head (08) is at least twice as large as an extension in the transverse direction (A) of the at least one exit surface (09) of the at least one print head (08) of the at least one nozzle bar (04) to be cleaned by the at least one cleaning device (18), and/or that, in the at least one supply position, the at least one removal unit (63) is arranged along a longest side of the at least one nozzle bar (04) and/or along a y direction outside the area between the at least one nozzle bar (04) and the transport path of the printing substrate (03), and/or that the at least one contact element (64) of the at least one removal unit (63) arranged in the supply position has a relative distance in the y direction and/or in the transverse direction (A) with respect to the at least one opening of the at least one exit surface (09) of the at least one print head (08), that the relative distance of the at least one contact element (64) of the at least one removal unit (63) arranged in the supply position with respect to the at least one opening of the at least one exit surface (09) of the at least one print head (08) is no more than one time as large as an extension in the transverse direction (A) of the at least one exit surface (09) of the at least one print head (08) of the at least one nozzle bar (04) to be cleaned by the at least one removal unit (63).

4. The printing press according to claim 2, characterized in that the at least one cleaning system (61) comprises at least one guide element (62), and that the at least one removal unit (63) is arranged along the at least one guide element (62), along a longest side of the at least one nozzle bar (04) and/or along a y direction, in the at least one supply position or in the at least one operating position.

5. The printing press according to claim 2, characterized in that the at least one cleaning system (61) comprises at least two removal units (63), that the at least two removal units (63) are jointly arranged on at least one carrier (76), that the at least one carrier (76) has the at least one supply position and the at least one operating position and/or that the at least two removal units (63) have an angle of inclination with respect to a z direction which corresponds to an inclination with respect to the z direction of the assigned nozzle bar (04) and/or of at least one print head (08) of the assigned nozzle bar (04).

6. The printing press according to claim 1, characterized in that the at least one nozzle bar (04) of the at least four nozzle bars (04) comprises at least one print head (08) including at least one exit surface (09) including at least one opening, that the at least one fluid supply opening (38) of the at least one cleaning element (31) arranged in the operating position has a relative distance in the y direction and/or in the transverse direction (A) with respect to the at least one opening of the at least one exit surface (09) of the at least one print head (08), that the relative distance of the at least one fluid supply opening (38) of the at least one cleaning element (31) arranged in the operating position with respect to the at least one opening of the at least one exit surface (09) of the at least one print head (08) is no more than one time as large as an extension in the transverse direction (A) of the at least one exit surface (09) of the at least one print head (08) of the at least one nozzle bar (04) to be cleaned by the at least one cleaning device (18), and/or that the at least one contact element (64) of the at least one removal unit (63) arranged in the operating position has a relative distance in the y direction and/or in the transverse direction (A) with respect to the at least one opening of the at least one exit surface (09) of the at least one print head (08), that the relative distance of the at least one contact element (64) of the at least one removal unit (63) arranged in the operating position with respect to the at least one opening of the at least one exit surface (09) of the at least one print head (08) is no more than one time as large as an extension in the transverse direction (A) of the at least one exit surface (09) of the at least one print head (08) of the at least one nozzle bar (04) to be cleaned by the at least one removal unit (63).

7. The printing press according to claim 1, characterized in that the at least one cleaning device (18) has at least one storage position and at least one usage position, that, in the at least one usage position, the at least one cleaning device (18) is arranged within the area between the at least one nozzle bar (04) and the transport path of printing substrate (03), and/or that the at least one fluid supply opening (38) of the at least one cleaning element (31) of the at least one cleaning device (18) arranged in the usage position has a relative distance in the x direction and/or in the transport direction (T) with respect to the at least one opening of the at least one exit surface (09) of the at least one print head (08), that the relative distance of the at least one fluid supply opening (38) of the at least one cleaning element (31) of the at least one cleaning device (18) arranged in the usage position with respect to the at least one opening of the at least one exit surface (09) of the at least one print head (08) is no more than one time as large as the extension of the at least one cleaning device (18) in the transport direction (T), and/or that, in the at least one storage position, the at least one cleaning device (18) is arranged along an x direction upstream or downstream from the at least one nozzle bar (04) and/or that, in the at least one storage position, the at least one cleaning device (18) is arranged along a transport direction (T) of printing substrate (03) at the position of the transport path beneath the at least one nozzle bar (04) upstream or downstream from the at least one nozzle bar (04), and/or that the at least one fluid supply opening (38) of the at least one cleaning element (31) of the at least one cleaning device (18) arranged in the storage position has a relative distance in the x direction and/or in the transport direction (T) with respect to the at least one opening of the at least one exit surface (09) of the at least one print head (08), and that the relative distance of the at least one fluid supply opening (38) of the at least one cleaning element (31) of the at least one cleaning device (18) arranged in the storage position with respect to the at least one opening of the at least one exit surface (09) of the at least one print head (08) is at least twice as large as an extension of the at least one cleaning device (18) in the transport direction (T).

8. The printing press according to claim 7, characterized in that the at least one cleaning device (18) comprises at least one guide system (19) comprising at least one guide element (53), that the at least one storage position and the at least one usage position are arranged along the at least one guide element (53), and that the at least one storage position and the at least one usage position are spaced apart from one another at a distance of greater than zero.

9. The printing press according to claim 8, characterized in that the printing unit (01) comprises at least two cleaning devices (18), that the at least two cleaning devices (18) are jointly connected to the at least one guide system (19) and/or that the at least two cleaning devices (18) simultaneously have the at least one storage position or the at least one usage position.

10. The printing press according to claim 1, characterized in that, in a first arrangement of the selective arrangement, the at least one cleaning device (18) is arranged within the area between the at least one nozzle bar (04) and the transport path of printing substrate (03) and that at least the at least one removal unit (63) is arranged outside the area between the at least one nozzle bar (04) and the transport path of printing substrate (03), and/or that, in a second arrangement of the selective arrangement, the at least one removal unit (63) is arranged within the area between the at least one nozzle bar (04) and the transport path of printing substrate (03), and that the at least one cleaning device (18) is arranged outside the area between the at least one nozzle bar (04) and the transport path of printing substrate (03), and/or that, in a third arrangement of the selective arrangement, both the at least one cleaning device (18) as well as the at least the at least one removal unit (63) are arranged outside the area between the at least one nozzle bar (04) and the transport path of printing substrate (03).

11. The printing press according to claim 1, characterized in that the printing unit (01) comprises at least one sealing element (56), that, in a third service position, this being the depot position, the at least one sealing element (56) is arranged in direct contact with the at least one nozzle bar (04), and/or that the at least one sealing element (56) is configured to seal at least two exit surfaces (09) of at least two print heads (08) of at least one row of print heads (08) of the at least one nozzle bar (04).

12. A method for cleaning at least one nozzle bar (04) of at least one printing unit (01), the at least one printing unit (01) comprising at least four nozzle bars (04), each including at least one print head (08), at least one print head (08) of at least one nozzle bar (04) of the at least four nozzle bars (04) being cleaned by at least one cleaning device (18) comprising at least one cleaning element (31), which is arranged in an operating position, including at least one fluid supply opening (38), the at least one print head (08) of the at least one nozzle bar (04) of the at least four nozzle bars (04) being cleaned by at least one cleaning system (61) comprising at least one removal unit (63), which is arranged in at least one operating position, comprising at least one contact element (64), an x direction corresponding to a direction along a shortest side of the respective nozzle bar (04), a y direction corresponding to a direction along a longest side of the respective nozzle bar (04), the at least one cleaning device (18) being moved along at least one guide element (53) of at least one guide system (19) from at least one storage position into at least one usage position, or vice versa, characterized in that, in the at least one storage position, the at least one cleaning device (18) is arranged along the x direction upstream or downstream from the at least one nozzle bar (04), that, in the operating position, the at least one cleaning element (31) is arranged within an area between the at least one nozzle bar (04) and a transport path of printing substrate (03), that the at least one contact element (64) is configured as a wiping cloth (64), that, in the at least one operating position, the at least one removal unit (63) is arranged within the area between the at least one nozzle bar (04) and the transport path of printing substrate (03), and that the at least one removal unit (63) is moved along at least one guide element (62), along a longest side of the at least one nozzle bar (04) and/or along a y direction.

13. The method according to claim 12, characterized in that the at least one cleaning device (18) or the at least one cleaning system (61) selectively cleans the at least one print head (08) of the at least one nozzle bar (04) of the at least four nozzle bars (04), and/or that the at least one cleaning device (18) or the at least one cleaning system (61) is selectively displaced into an area between the at least one nozzle bar (04) and a transport path of printing substrate (03).

14. The method according to claim 12, characterized in that the at least one nozzle bar (04) is selectively arranged in a printing position or in at least one service position, and that the at least one nozzle bar (04) is moved in a direction having a larger vertical component and a smaller horizontal component from the printing position into the at least one service position and/or from the at least one service position into the printing position, and/or that, in the at least one service position, the at least one nozzle bar (04) is arranged in vertical direction above the printing position.

15. The method according to claim 14, characterized in that the at least one service position is configured as a first service position, that at least one second service position is configured as a second service position, and that the at least one nozzle bar (04) is positioned in the first service position during the contactless cleaning operation of the at least one print head (08) of the at least one nozzle bar (04) and/or that the at least one nozzle bar (04) is positioned in the second service position when contact with the at least one cleaning system (61) occurs.

* * * * *